US012569008B2

(12) United States Patent
Hawes et al.

(10) Patent No.: US 12,569,008 B2
(45) Date of Patent: Mar. 10, 2026

(54) HEAT-NOT-BURN (HNB) AEROSOL GENERATING DEVICES AND CAPSULES

(71) Applicant: Altria Client Services LLC, Richmond, VA (US)

(72) Inventors: Eric Hawes, Midlothian, VA (US); Zack W. Blackmon, Williamsburg, VA (US); Yannick Hourmand, Haslingfield (GB); Guillaume Michel, Cambridge (GB); Nicola Westgarth-Flynn, Richmond, VA (US); Ryan Mcginley, St Neots (GB); Rangaraj S. Sundar, Midlothian, VA (US); Jarrett Keen, Richmond, VA (US); Raymond W. Lau, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 1122 days.

(21) Appl. No.: 17/151,336

(22) Filed: Jan. 18, 2021

(65) Prior Publication Data

US 2022/0225669 A1 Jul. 21, 2022

(51) Int. Cl.
*A24F 40/40* (2020.01)
*A24F 40/53* (2020.01)
(Continued)

(52) U.S. Cl.
CPC ..... *A24F 40/40* (2020.01); *A24F 40/53* (2020.01); *A24F 40/57* (2020.01); *A24F 40/60* (2020.01)

(58) Field of Classification Search
CPC ..... A24F 40/485; A24F 40/40; A24F 40/60; B65D 85/1036
See application file for complete search history.

(56) References Cited

U.S. PATENT DOCUMENTS 855,984 A 6/1907 Russell
1,071,389 A 8/1913 Blosser
(Continued)

FOREIGN PATENT DOCUMENTS

CN 103945716 A 7/2014
CN 203986136 U 12/2014
(Continued)

OTHER PUBLICATIONS

Crafty Vaporizer manual (2014).
(Continued)

*Primary Examiner* — Michael H. Wilson
*Assistant Examiner* — Jennifer A Kessie
(74) *Attorney, Agent, or Firm* — Harness, Dickey & Pierce, P.L.C.

(57) ABSTRACT

A heat-not-burn (HNB) aerosol generating device may include a housing including a power supply and an air inlet, a mouthpiece assembly movably attached to the housing, and providing an air outlet, a door assembly moveably attached to the housing, the door assembly including a door and a receptacle movably attached to the door, the receptacle defining a cavity to receive a capsule including an aerosol generating substrate, and a linkage arrangement operationally connected to the door assembly, the mouthpiece assembly and the housing, and the linkage arrangement cooperatively moving the mouthpiece assembly and the receptacle in response to movement of the door to a closed state such that the capsule is retained within the housing and operationally connected with the power supply, the air inlet and the air outlet.

25 Claims, 23 Drawing Sheets

(51) Int. Cl.
*A24F 40/57* (2020.01)
*A24F 40/60* (2020.01)

(56) References Cited

U.S. PATENT DOCUMENTS 1,934,887 A 11/1933 Robinson
4,214,146 A 7/1980 Schimanski
4,564,748 A 1/1986 Gupton
4,947,874 A 8/1990 Brooks et al.
5,230,798 A * 7/1993 Rogman ..... B01D 29/96 52/12
5,388,572 A 2/1995 Mulhauser et al.
5,388,573 A 2/1995 Mulhauser et al.
5,441,060 A 8/1995 Rose et al.
5,460,173 A 10/1995 Mulhauser et al.
5,593,792 A 1/1997 Farrier et al.
5,619,984 A 4/1997 Hodson et al.
5,645,050 A 7/1997 Zierenberg et al.
5,665,262 A 9/1997 Hajaligol et al.
5,823,182 A 10/1998 Van Oort
6,006,747 A 12/1999 Eisele et al.
6,065,472 A 5/2000 Anderson et al.
6,095,153 A 8/2000 Kessler et al.
6,481,437 B1 11/2002 Pate
7,186,958 B1 3/2007 Nelson
7,997,280 B2 8/2011 Rosenthal
8,488,952 B2 7/2013 Landry
8,490,627 B2 7/2013 Levin et al.
8,714,150 B2 5/2014 Alelov
8,910,630 B2 12/2014 Todd
9,693,587 B2 7/2017 Plojoux et al.
9,775,379 B2 10/2017 Davidson et al.
9,943,114 B2 4/2018 Batista
10,172,390 B2 1/2019 Nakano et al.
10,179,215 B2 1/2019 Raichman
10,219,543 B2 3/2019 Gill et al.
10,247,443 B2 4/2019 Flick
10,271,578 B2 4/2019 John et al.
10,292,436 B2 5/2019 Cirillo et al.
10,328,443 B2 6/2019 Ricketts et al.
10,602,776 B2 3/2020 Batista
2004/0159322 A1 8/2004 Kladders et al.
2005/0063686 A1 3/2005 Whittle et al.
2007/0045288 A1 3/2007 Nelson
2007/0102013 A1 5/2007 Adams et al.
2008/0073558 A1 3/2008 Howell et al.
2009/0293888 A1 12/2009 Williams et al.
2009/0293892 A1 12/2009 Williams et al.
2010/0012118 A1 1/2010 Storz
2010/0059070 A1 3/2010 Potter et al.
2010/0078022 A1 4/2010 Striebig et al.
2010/0139655 A1 6/2010 Genosar et al.
2010/0313901 A1 12/2010 Fernando et al.
2011/0126848 A1 6/2011 Zuber et al.
2011/0192399 A1 8/2011 Wilke et al.
2012/0255546 A1* 10/2012 Goetz ..... A61M 11/042 128/202.21
2012/0304990 A1 12/2012 Todd
2012/0325227 A1 12/2012 Robinson et al.
2013/0032145 A1 2/2013 Adler et al.
2013/0186392 A1 7/2013 Haartsen et al.
2013/0233309 A1 9/2013 Todd
2013/0233312 A1 9/2013 Cohn
2013/0255702 A1 10/2013 Griffith, Jr. et al.
2013/0276799 A1 10/2013 Davidson et al.
2014/0041655 A1 2/2014 Barron et al.
2014/0060554 A1 3/2014 Collett et al.
2014/0186015 A1 7/2014 Breiwa, III et al.
2014/0217197 A1 8/2014 Selby et al.
2014/0238423 A1 8/2014 Tucker et al.
2014/0299141 A1 10/2014 Flick
2014/0321837 A1 10/2014 Flick
2014/0345606 A1 11/2014 Talon
2014/0366609 A1 12/2014 Beck et al.
2015/0059747 A1 3/2015 Von Schuckmann
2016/0021932 A1 1/2016 Silvestrini et al.
2016/0050975 A1 2/2016 Worm et al.
2016/0057811 A1 2/2016 Alarcon et al.
2016/0295922 A1 10/2016 John et al.
2016/0331913 A1 11/2016 Bourque
2016/0338410 A1 11/2016 Batista et al.
2016/0345630 A1 12/2016 Mironov et al.
2017/0055584 A1 3/2017 Blandino et al.
2017/0071251 A1 3/2017 Goch
2017/0095624 A1 4/2017 Davidson et al.
2017/0119979 A1 5/2017 Davidson et al.
2017/0143042 A1 5/2017 Batista et al.
2017/0144827 A1 5/2017 Batista
2017/0164657 A1 6/2017 Batista
2017/0196262 A1 7/2017 Brereton et al.
2017/0251718 A1* 9/2017 Armoush ..... A24F 1/30
2017/0311648 A1 11/2017 Gill et al.
2017/0360098 A1 12/2017 Newcomb et al.
2018/0007960 A1 1/2018 Suzuki et al.
2018/0084831 A1 3/2018 Mironov
2018/0104214 A1 4/2018 Raichman
2018/0214645 A1 8/2018 Reevell
2018/0235279 A1 8/2018 Wilke et al.
2018/0242644 A1 8/2018 Bessant et al.
2018/0263286 A1 9/2018 Reevell
2018/0295885 A1 10/2018 Rojo-Calderon et al.
2018/0361334 A1 12/2018 Bahabri
2019/0117915 A1 4/2019 Raichman
2019/0208823 A1 7/2019 Raichman
2019/0224430 A1 7/2019 Raichman
2020/0229509 A1 7/2020 Griscik et al.
2020/0245680 A1* 8/2020 Williams ..... A61M 11/042
2020/0281264 A1 9/2020 Wright
2022/0110368 A1* 4/2022 Jang ..... A24F 40/85

FOREIGN PATENT DOCUMENTS

CN 104349687 A 2/2015
EP 0525720 A1 2/1993
EP 1007124 A1 6/2000
EP 1029451 A1 8/2000
EP 1385595 A2 2/2004
EP 1504768 A1 2/2005
JP 2017-532009 A 11/2017
JP 2020-533005 A 11/2020
KR 101319228 10/2013
RU 2536115 C2 12/2014
WO WO-2003/037306 A2 5/2003
WO WO-2015/116934 A1 8/2015
WO WO-2016/001921 A2 1/2016
WO WO-2016/001922 A1 1/2016
WO WO-2016/001923 A2 1/2016
WO WO-2016/001924 A2 1/2016
WO WO-2016/001925 A1 1/2016
WO WO-2016/001926 A1 1/2016
WO WO-2016/005533 A1 1/2016
WO WO-2016/026219 A1 2/2016
WO 2019/202048 A1 10/2019
WO 2020/221674 A1 11/2020

OTHER PUBLICATIONS

International Search Report and Written Opinion for corresponding International application No. PCT/US2021/060695 dated Mar. 15, 2022.
European Communication dated Oct. 8, 2024 issued in European Patent Appplication No. 21 824 734.4 -1105.
Japanese Notice of Allowance dated Dec. 11, 2025, issued in Japanese Patent Application No. 2023-543069.
European Search Report dated Nov. 11, 2025 issued in European Patent Application No. 25163577.7-1105.

* cited by examiner

Fig. 3E
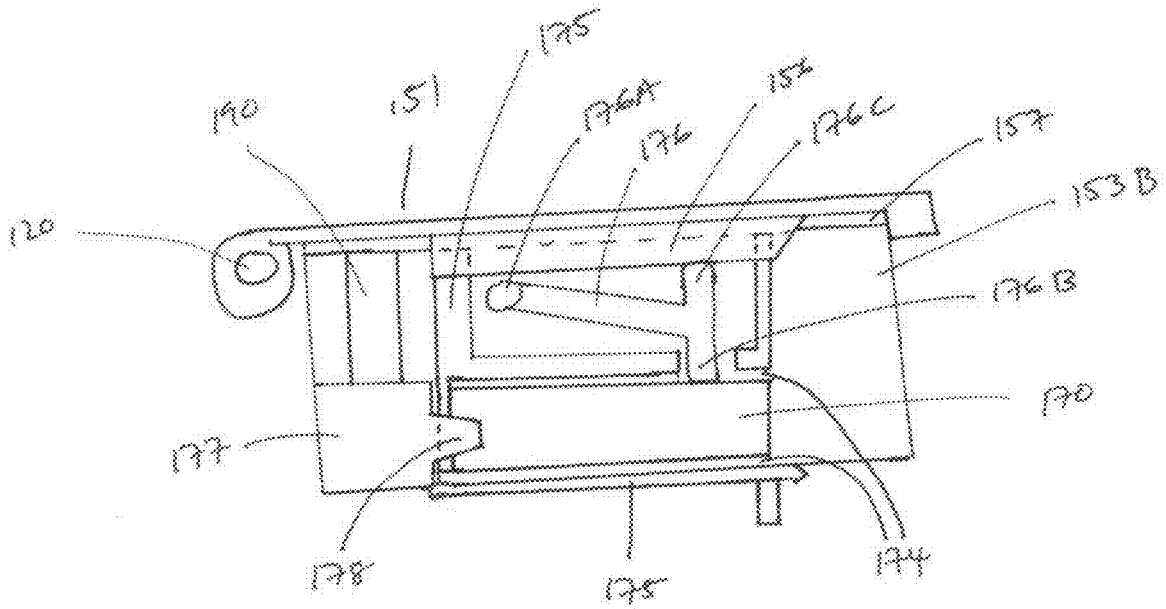
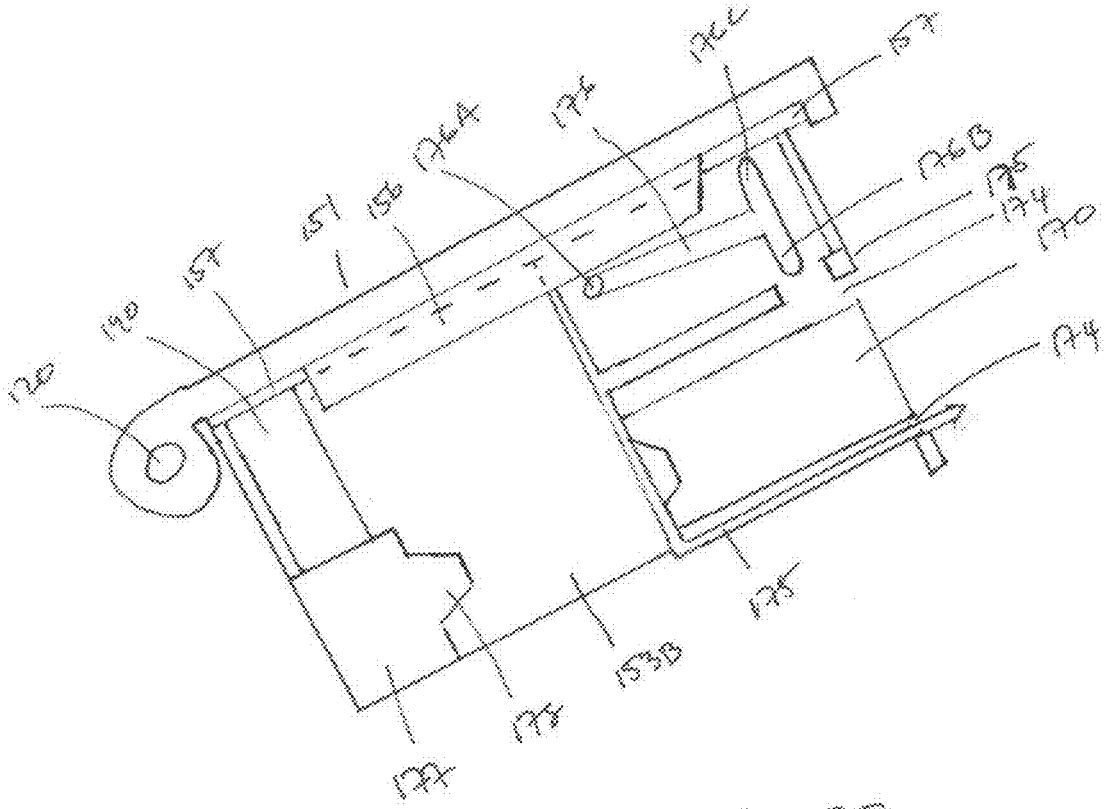
Fig. 3F

1200

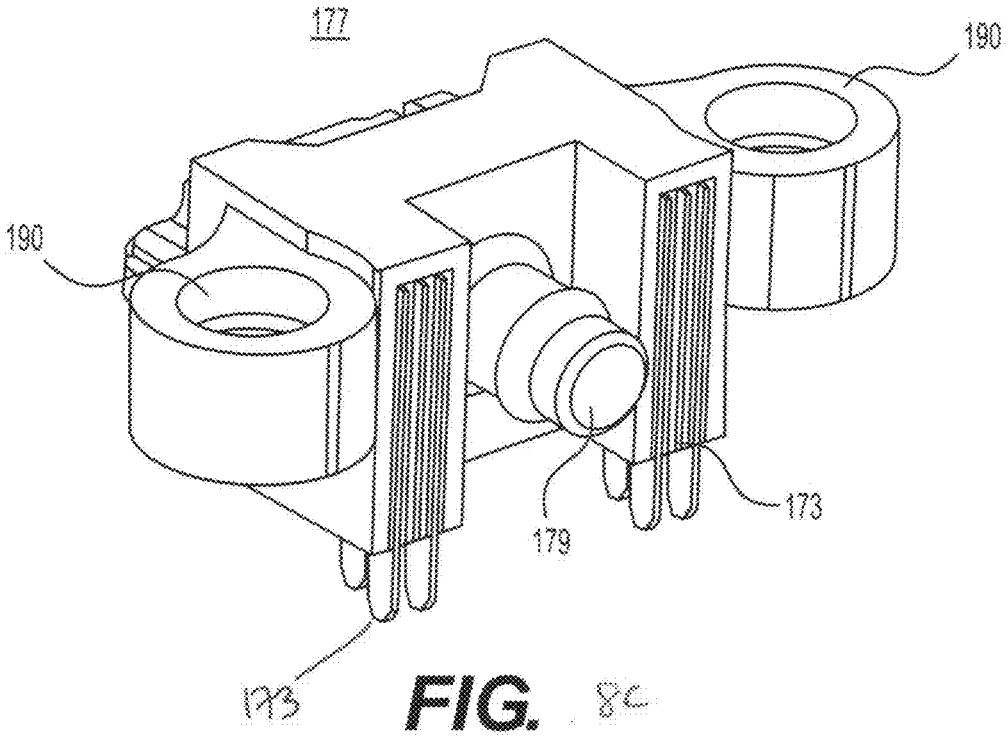
FIG. 8C
FIG. 8D
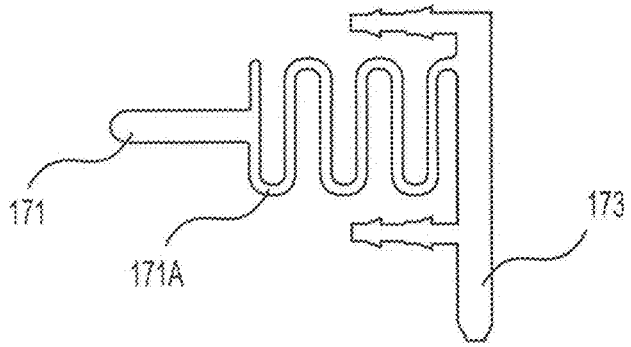
FIG. 8E
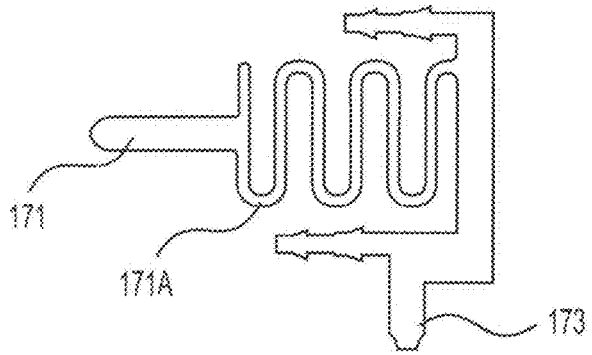

HEAT-NOT-BURN (HNB) AEROSOL GENERATING DEVICES AND CAPSULES

BACKGROUND

Field

The present disclosure relates to heat-not-burn (HNB) aerosol generating devices configured to generate an aerosol without involving a substantial pyrolysis of an aerosol-forming substrate.

Description of Related Art

Some electronic devices are configured to heat a plant material to a temperature that is sufficient to release constituents of the plant material while keeping the temperature below a combustion point of the plant material so as to avoid any substantial pyrolysis of the plant material. Such devices may be referred to as aerosol generating devices (e.g., heat-not-burn aerosol generating devices, etc.), and the plant material heated may be tobacco or other plant material with active ingredients. In some instances, the plant material may be introduced directly into a heating chamber of an aerosol generating device. In other instances, the plant material may be pre-packaged in individual containers (e.g., capsules, cartridges, etc.) to facilitate insertion and removal of the plant material from an aerosol generating device.

SUMMARY

At least some example embodiments relates to an aerosol-generating device.

In at least one example embodiment, the aerosol-generating device may include a housing including a power supply and an air inlet, a mouthpiece assembly movably attached to the housing, and providing an air outlet, a door assembly moveably attached to the housing, the door assembly including a door and a receptacle movably attached to the door, the receptacle defining a cavity to receive a capsule including an aerosol generating substrate, and a linkage arrangement operationally connected to the door assembly, the mouthpiece assembly and the housing, and the linkage arrangement cooperatively moving the mouthpiece assembly and the receptacle in response to movement of the door to a closed state such that the capsule is retained within the housing and operationally connected with the power supply, the air inlet and the air outlet.

In at least one example embodiment, the linkage arrangement may include at least one first linkage and at least one second linkage, each of the linkages including a first end and a second end.

In at least one example embodiment, the housing further may include at least one first pivot point, the at least one first linkage may be rotatably connected to the receptacle at the first end of the at least one first linkage, and the at least one first linkage may be rotatably connected to the housing at the at least one first pivot point at the second end of the at least one first linkage.

In at least one example embodiment, in response to the movement of the door to the closed state, the at least one first linkage may move the receptacle such that the capsule is operationally connected with the power supply and the air inlet.

In at least one example embodiment, the housing may further define at least one elongated slot, the housing may further include at least one compression spring, the mouthpiece assembly may further include at least one pin movably inserted into the at least one elongated slot, the at least one second linkage may be rotatably connected to the door assembly at the first end of the at least one second linkage, and the at least one second linkage may be rotatably and movably connected to the at least one pin at the second end of the at least one second linkage.

In at least one example embodiment, in response to the movement of the door to the closed state, the at least one second linkage may release the at least one compression spring from a compressed state, and the at least one compression spring may move the mouthpiece assembly along a length of the at least one elongated slot such that the air outlet is operationally connected to the capsule.

In at least one example embodiment, the mouthpiece assembly may include a mouthpiece chassis, and the mouthpiece chassis may define an opening to receive a mouthpiece.

In at least one example embodiment, the mouthpiece chassis may define a portion of an attachment mechanism for removably attaching the mouthpiece to the mouthpiece chassis.

In at least one example embodiment, the attachment mechanism may be at least one of a bayonet connector, a snug-fit, a detent, a clamp, a threaded connector, a sliding fit, a sleeve fit, an alignment fit, a magnetic clasp, or any combinations thereof.

In at least one example embodiment, the door may include a cam disposed on an interior face of the door, the receptacle may include a restraining element, and in response to the movement of the door to the closed state, the linkage arrangement may cooperatively move the receptacle such that the cam actuates the restraining element, and the actuated restraining element restrains movement of the capsule within the receptacle.

In at least one example embodiment, the housing may include an airflow sensor, a door sensor, a capsule sensor, and processing circuitry, the airflow sensor may be configured to detect a draw event, the door sensor may be configured to detect whether the door is in the closed state, the capsule sensor may be configured to detect the capsule in the receptacle, and the processing circuitry may be configured to enable current to flow from the power supply to the capsule in response to the detected draw event, the door detected in the closed state, and the capsule detected in the receptacle, such that the current enables a heater included in the capsule to heat the aerosol generating substrate and generate an aerosol.

In at least one example embodiment, the housing may further include a display panel, and the display panel may be configured to display operational information related to the aerosol generating device or the capsule.

In at least one example embodiment, in response to movement of the door to an open state, the linkage arrangement may cooperatively move the mouthpiece assembly and the receptacle such that the capsule is operationally disconnected from the power supply, the air inlet, and the air outlet.

At least some example embodiments relates to an aerosol-generating device.

In at least one example embodiment, the aerosol-generating device may include a housing including a power supply and an air inlet, a mouthpiece assembly movably attached to the housing, and providing an air outlet, a door assembly moveably attached to the housing, the door assembly including a door and a receptacle movably attached to the door, the receptacle defining a cavity to receive a capsule including an aerosol generating substrate and retain the capsule within the housing, and the capsule operationally connected to the power supply, the air inlet, and the air outlet when the door is in a closed state, and a linkage arrangement operationally connected to the door assembly, the mouthpiece assembly and the housing, and the linkage arrangement cooperatively moving the mouthpiece assembly and the receptacle in response to movement of the door to an open state such that the capsule is operationally disconnected from the power supply, the air inlet and the air outlet.

In at least one example embodiment, the linkage arrangement may include at least one first linkage and at least one second linkage, each of the linkages including a first end and a second end.

In at least one example embodiment, the housing may further include at least one first pivot point, the at least one first linkage may be rotatably connected to the receptacle at the first end of the at least one first linkage, and the at least one first linkage may be rotatably connected to the housing at the at least one first pivot point at the second end of the at least one first linkage.

In at least one example embodiment, in response to the movement of the door to the open state, the at least one first linkage may move the receptacle such that the capsule is operationally disconnected with the power supply and the air inlet.

In at least one example embodiment, the housing may further define at least one elongated slot, the housing may further include at least one compression spring, the mouthpiece assembly may further include at least one pin movably inserted into the at least one elongated slot, the at least one second linkage may be rotatably connected to the door assembly at the first end of the at least one second linkage, and the at least one second linkage may be rotatably and movably connected to the at least one pin at the second end of the at least one second linkage.

In at least one example embodiment, in response to the movement of the door to the open state, the at least one second linkage may move the mouthpiece assembly along a length of the at least one elongated slot such that the air outlet is operationally disconnected from the capsule and the at least one compression spring enters a compressed state.

In at least one example embodiment, the mouthpiece assembly may include a mouthpiece chassis, and the mouthpiece chassis may define an opening to receive a mouthpiece.

In at least one example embodiment, the mouthpiece chassis may define a portion of an attachment mechanism for removably attaching the mouthpiece to the mouthpiece chassis.

In at least one example embodiment, the attachment mechanism may be at least one of a bayonet connector, a snug-fit, a detent, a clamp, a threaded connector, a sliding fit, a sleeve fit, an alignment fit, a magnetic clasp, or any combinations thereof.

In at least one example embodiment, the receptacle may include a restraining element, the door may include a cam disposed on an interior face of the door, the cam engaging the restraining element when the door is in the closed state such that the restraining element is caused to restrain the capsule within the capsule, in response to the movement of the door to the open state, the linkage arrangement may move the receptacle such that the restraining element disengages from the cam, and the restraining element may not restrain the capsule within the receptacle when the restraining element is fully disengaged from the cam.

In at least one example embodiment, the housing may include an airflow sensor, a door sensor, a capsule sensor, and processing circuitry, the airflow sensor may be configured to detect a draw event, the door sensor may be configured to detect whether the door is in the closed state, the capsule sensor may be configured to detect the capsule in the receptacle, and the processing circuitry may be configured to disable current flow from the power supply to the capsule in response to no longer detecting any one of the draw event, the door in the closed state, and the capsule in the receptacle.

In at least one example embodiment, the housing may further include a display panel, and the display panel may be configured to display operational information related to the aerosol generating device or the capsule.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

FIGS. 3A-3F illustrate various views of a door assembly according to some example embodiments;

FIGS. 8A to 8E illustrate various views of the door assembly, capsule receptacle, and capsule connector according to some example embodiments;

DETAILED DESCRIPTION

Figure 1A:
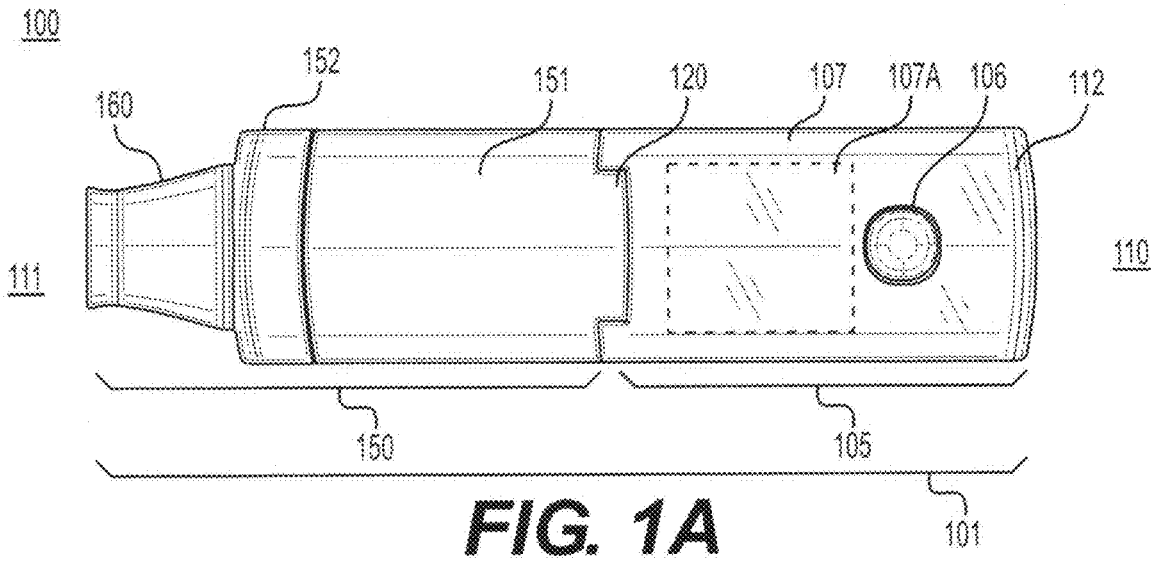
FIGS. 1A to 1E illustrate an aerosol generating device according to at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," "attached to," "adjacent to," or "covering" another element or layer, it may be directly on, connected to, coupled to, attached to, adjacent to or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Hardware may be implemented using processing circuitry or control circuitry such as, but not limited to, hardware including logic circuits; a hardware/software combination such as at least one processor executing software; or a combination thereof. For example, the processing circuitry or control circuitry may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), etc.

FIGS. 1A to 1E illustrate an aerosol generating device with a door according to at least one example embodiment.

Referring now to FIG. 1A, FIG. 1A illustrates a front view of an aerosol generating device with a door in a closed state according to at least one example embodiment. As shown in FIG. 1A, an aerosol generating device 100 includes a device body housing 101 and a removable mouthpiece 160, with the removable mouthpiece 160 at a proximal (e.g., downstream) end 111. According to at least one example embodiment, the device body housing 101 may be formed from a metal, such as aluminum, stainless steel, etc., a plastic, such as polycarbonate (PC) and acrylonitrile-butadiene-styrene (ABS), etc., or any combinations thereof. According to at least one example embodiment, the removable mouthpiece 160 may be formed from a food contact rated plastic, such as liquid crystalline polymer (LCP), a copolyester plastic, such as Tritan, or any other suitable polymer and/or plastic. Additionally, according to some example embodiments, the mouthpiece may be formed using plant based materials, such as wood, bamboo, etc.

The device body housing 101 includes a first section 105 (e.g., bottom section, upstream section, distal portion, etc.) at a bottom end 110 (e.g., distal end, upstream end, etc.) of the aerosol generating device 100, and a second section 150 (e.g., top section, downstream section, proximal portion, etc.) at an opposing top end 111 (e.g., proximal end, downstream end, etc.) of the aerosol generating device 100. The first section 105 includes a distal end piece 112 at the bottom end 110, at least one button 106, and a front exterior piece 107. The second section 150 includes a door 151 and a proximal end piece 152 at the top end 111 of the aerosol generating device 100. The door 151 is attached to the front exterior piece 107 of the first section 105 via a hinge 120, and the door 151 may rotate and/or pivot to an open position (e.g., open state) and a closed position (e.g., closed state) around the hinge 120. While FIG. 1A illustrates the door 151 as including a hinge knuckle and the front exterior piece 107 as including the corresponding hinge pin, the example embodiments are not limited thereto, and for example, the door 151 may include the hinge pin and the front exterior piece 107 may include the hinge knuckle, etc.

As will be described in further detail below, the door 151 includes a capsule receptacle housing configured to receive a capsule containing plant material. When the door 151 is closed, a heater included in the capsule is enabled to generate an aerosol by heating the plant material in response to an activation signal and/or activation operation, but the example embodiments are not limited thereto. The aerosol flows from the capsule and out the mouthpiece 160 upon a draw event (e.g., air being drawn) and/or a negative pressure being applied at the mouthpiece 160.

The button 106 may be a power button for transmitting a power ON/OFF toggling signal to a control subsystem (e.g., control subsystem 2100 of FIG. 6) of the aerosol generating device 100 and/or a consumer interaction button for receiving user inputs, etc. For example, the button 106 may be used by an adult operator of the aerosol generating device to change operational settings of the aerosol generating device 100, etc. According to some example embodiments, operational settings of the aerosol generating device 100 may include initiating a pre-heat operation of a heater (e.g., energizing the heater prior to the detection of a draw event, etc.), checking the battery status, checking the capsule status, initiating a pairing operation between the aerosol generating device and an external computing device and/or user device (e.g., performing Bluetooth and/or WiFi pairing, etc.), selecting an operating temperature of the aerosol generating device, selecting an aerosol profile and/or heater profile, etc., but the example embodiments are not limited thereto. Additionally, according to some example embodiments, the aerosol generating device 100 may include a plurality of buttons 106, for example a first power button, a second consumer interaction button, and/or a third button which causes the door 151 to open or close, etc., but the example embodiments are not limited thereto.

According to some example embodiments, the front exterior piece 107 is a display panel (e.g., a consumer interface panel, etc.) configured to display a consumer interface for an adult operator of the aerosol generating device, operational status information related to the operation of the aerosol generating device 100, such as battery status information (e.g., battery charging status, current battery level information, remaining battery level information, etc.), capsule status information (e.g., capsule present/installed, capsule absent/not installed, capsule depletion information, etc.), aerosol generating substrate status information, aerosol generating substrate flavor information, fault indication information (e.g., capsule error information, aerosol generating device error information, short circuit information, open circuit information, charging fault/error, heater/device temperature out of range information, etc.), capsule information, consumer engagement information, etc., but the example embodiments are not limited thereto. The display panel may be an organic light emitting diode (OLED) display panel, a thin film transistor (TFT) display panel, a light emitting diode (LED) display panel, a liquid crystal display (LCD) display panel, etc., but is not limited thereto. According to some example embodiments, the display panel 107 may be a touch-screen display panel displaying a consumer interface including touch screen controls for operating and/or manipulating the aerosol generating device 100, but is not limited thereto.

Additionally, according to some example embodiments, the front exterior piece 107 is a transparent and/or translucent piece and may be disposed above an underlying display panel 107A and may allow an adult operator to view the images and/or text being displayed on the display panel 107A, etc. For example, the front exterior piece 107 may be formed from a transparent and/or translucent (e.g., clear) plastic (e.g., polycarbonate (PC) plastic, a polymer such as PC/ABS, etc.) or glass (e.g., alkali-aluminosilicate sheet glass, borosilicate glass, tempered glass, synthetic sapphire, other toughened glass, etc.), a colored (e.g., tinted) plastic or glass, etc., but the example embodiments are not limited thereto. Additionally, an in-mold decoration and/or paint may be disposed on the reverse side (e.g., interior side) of the front exterior piece 107, on portions of the front exterior piece 107, such that only the display panel 107A is viewable by an adult operator and the interior of the aerosol generating device 100 is not viewable, but the example embodiments are not limited thereto.

Figure 1B:
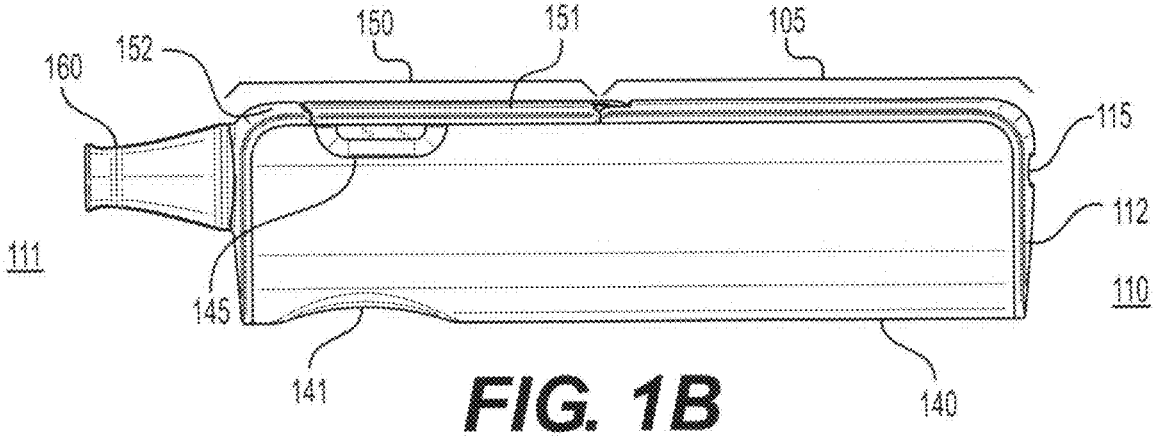

Referring now to FIG. 1B, FIG. 1B illustrates a side view of an aerosol generating device with the door in the closed state according to at least one example embodiment. As shown in FIG. 1B, the device body housing 101 further includes a rear exterior piece 140 connected to the proximal end piece 152, the distal end piece 112, and the front exterior piece 107. The distal end piece 112 includes a recess portion 115 which may include a power connector port and/or an air inlet, etc., but is not limited thereto. The rear exterior piece 140 may be curved at a rear portion of the housing for ergonomic purposes, but the example embodiments are not limited thereto and the rear exterior piece 140 and/or the device body housing 101 may be substantially cuboid and/or polygonal in shape, etc.

The rear exterior piece 140 includes a first recess section 141 and a second recess section 145. The first recess section 141 may be referred to as a thumb divot, and is ergonomically positioned on the proximal portion 150 of the rear surface of the device body housing 101 such that an adult operator's thumb or other finger may be placed in the first recess section 141 while the adult operator is holding the aerosol generating device 100. However, the example embodiments are not limited thereto and the first recess section 141 may be located at a different location of the rear exterior piece 140. According to other example embodiments, the rear exterior piece 140 may include a plurality of first recess sections and one or more of the first recess sections may be located on a left and/or right side of the device body housing 101, etc., or the first recess section 141 may be omitted completely. According to some example embodiments, the first recess section 141 may be oval shaped as shown in shaped FIG. 1C, but the example embodiments are not limited thereto, and the first recess section may have other shapes and/or configurations, such as a substantially circular shape, a substantially triangular shape, a substantially rectangular shape, etc.

According to some example embodiments, the first recess section 141 may be formed as a single piece, but the example embodiments are not limited thereto, and for example, may be formed from a plurality of pieces attached together. The first recess section 141 may be formed from a plastic, such as PC or ABS, etc., a polymer such as PC/ABS, a metal, such as aluminum, stainless steel, a rubber, such as silicone rubber, etc., or any combinations thereof. The first recess section 141 may also be patterned and/or have a texture applied to the first recess section 141, such as laser etched patterns, or in-mold ridges, bumps, etc., but the example embodiments are not limited thereto.

Figure 1C:
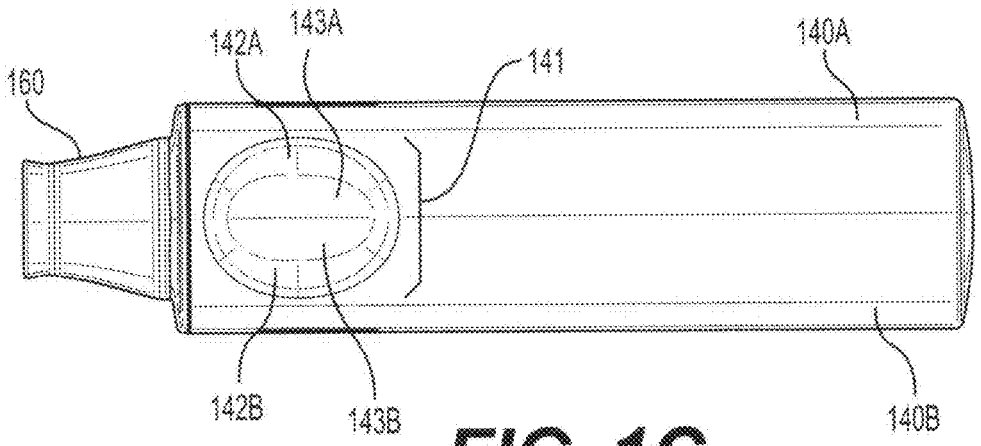

Referring now to FIG. 1C, FIG. 1C illustrates a rear view of the aerosol generating device according to at least one example embodiment. As shown in FIG. 1C, the first recess section 141 may be formed from a plurality of first recess sections, such as an outer portion 142 including a right outer portion piece 142A and a left outer portion piece 142B, and an inner portion 143 including a right inner portion piece 143A and a left inner portion piece 143B, but the example embodiments are not limited thereto, and for example, the outer portion 142 and/or the inner portion 143 may be formed as a single piece, etc. According to some example embodiments, the outer portion 142 may encircle the inner portion 143, may have the same or different width than the inner portion 143, and may be made from the same or a different material than the inner portion 143, etc. For example, the outer portion 142 may be approximately 20 mm (W)×24 mm (L), while the inner portion 143 may be approximately 10.7 mm (W)×18 mm (L), but the example embodiments are not limited thereto. The outer portion 142 may be substantially convex, and the inner portion 143 may be substantially concave, but the example embodiments are not limited thereto. For example, the inner portion 143 may have a depth of approximately 2 mm, but the example embodiments are not limited thereto. The engagement of the right inner portion piece 143A, left inner portion piece 143B, right outer portion piece 142A, and left outer portion piece 142B, may be connected together via a snap-fit, friction-fit, or slide-lock type arrangement, although example embodiments are not limited thereto. According to some example embodiments, the right outer portion 142A and the right inner portion piece 143A may be formed as a single piece, and the left outer portion 142B and the left inner portion piece 143B may be formed as a single piece, and may be connected together via a snap-fit, friction-fit, or slide-lock type arrangement, etc.

The second recess section 145 is a recess located under the door 151 and allows an adult operator to ergonomically open and close the door 151. According to some example embodiments, there are a plurality of second recess sections 145, for example, a left second recess section located on a left side of the door 151, and a right second recess section located on a right side of the door 151, etc., but the example embodiments are not limited thereto. Additionally, according to at least one example embodiment, the second recess section 145 may be omitted, and the door 151 may further include at least one tab, overhang piece, or the like, which protrudes from door 151 past the interface between the door 151 and the rear exterior piece 140, and thereby allows an adult operator to ergonomically grip the sides of the door 151 and manually open and close the door 151, etc.

According to some example embodiments, the rear exterior piece 140 may be formed from a single piece, or may be formed from two or more pieces. For example, in FIG. 1C, the rear exterior piece 140 includes a right rear exterior piece 140A and a left rear exterior piece 140B, but the example embodiments are not limited thereto. The engagement of the right rear exterior piece 140A and a left rear exterior piece 140B may be via a snap-fit, friction-fit, or slide-lock type arrangement, although example embodiments are not limited thereto.

Figure 1D:
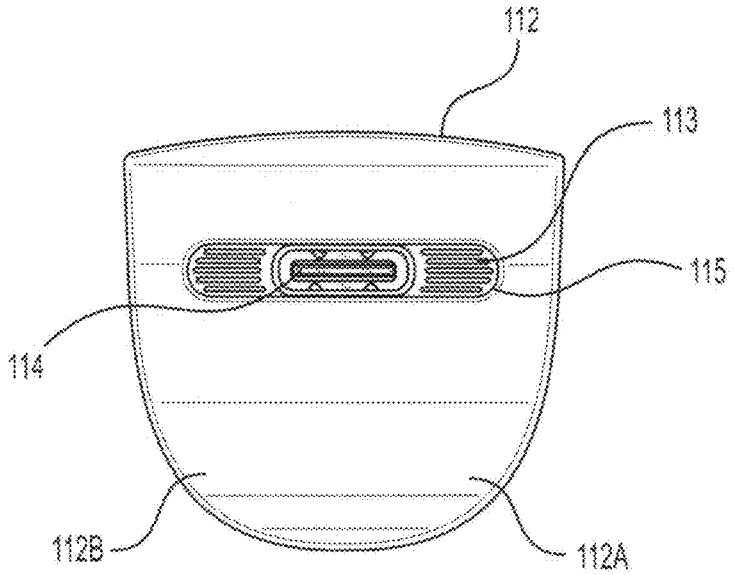

Referring now to FIG. 1D, FIG. 1D illustrates a bottom view of the aerosol generating device with the door in the closed state according to at least one example embodiment.

According to some example embodiments, the distal end piece 112 (e.g., bottom end piece) includes at least one distal recess 115, but is not limited thereto. The at least one distal recess 115 includes at least one connector port 114 and at least one body housing air inlet 113, but is not limited thereto. For example, the distal end piece 112 may include a plurality of distal recesses 115 to separately accommodate the at least one connector port 114 and the at least one body housing air inlet 113, etc. The at least one connector port 114 may be a data port configured to transmit and/or receive data from an external computing device, such as a smartphone, tablet, personal computer, external storage device, etc. The at least one connector port 114 may also be a power port configured to receive power from an external power source and to recharge an internal power source 182 (e.g., a rechargeable and/or replaceable battery, etc.) of the aerosol generating device 100 and/or provide power for the operation of the aerosol generating device 100, etc. In some example embodiments, the at least one connector port 114 is a single connector port, such as a USB connector port (e.g., a USB-C port, a USB-mini port, etc.), etc., that combines the functionality of a data port and a power port. According to other example embodiments, there may be two or more connector ports, e.g., a separate power port and a separate data port, etc.

The distal recess 115 also includes a plurality of body housing air inlets 113, but is not limited thereto, and for example may include a single air inlet, etc. As shown in FIG. 1D, the distal recess 115 may include a plurality of body housing air inlets 113 on the left and right sides of the connector port 114, but the example embodiments are not limited thereto, and the air inlets may be arranged in any number, location and/or pattern. Additionally, the plurality of body housing air inlets 113 may be disposed on any part of the distal end piece 112, and are not limited to the distal recess 115. The air inlets 113 allow external air to flow into at least one air hose included in the interior of the device body housing 101 upon a draw event and/or the application of negative air pressure at the proximal end of the aerosol generating device 100, e.g., at the mouthpiece 160. The air inlets 113 may include a grille, e.g., a mesh layer, etc., which reduces, decreases, and/or prevents debris from entering the air hose and/or the interior of the device body housing 101, and/or otherwise obstructing the flow of air into the air hose from the air inlets 113. The grille may be separate from the air inlet 113 and may be attached to an interior face of the air inlet 113, an exterior face of the air inlet 113, or both. According to some example embodiments, the grille may be integrated into the openings of individual air inlets 113. Each air inlet 113 may have an elongate shape, but the example embodiments are not limited thereto, and the air inlets 113 may have other shapes, such as circular, polygonal, etc., shapes, or any combinations thereof.

Figure 1E:
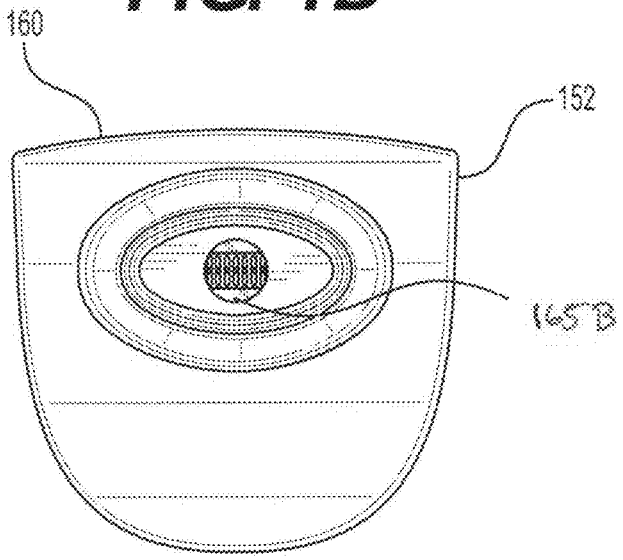

Referring now to FIG. 1E, FIG. 1E illustrates a top view of the aerosol generating device with the door in the closed state according to at least one example embodiment.

According to at least one example embodiment, the mouthpiece 160 is inserted through an opening of the proximal end piece 152 and removably attached to a mouthpiece chassis of the device body housing 101. The mouthpiece 160 is replaceable and/or reusable, and may be connected to the mouthpiece chassis using any type of connector. According to at least one example embodiment, the mouthpiece 160 may be removably attached to the mouthpiece chassis using a bayonet connector, but the example embodiments are not limited thereto, and for example, the mouthpiece 160 may be attached using, without limitation, a snug-fit, detent, clamp, threaded connector, sliding fit, sleeve fit, alignment fit, threaded connector, magnetic, clasp, or any other type of connection, and/or combinations thereof. When the bayonet connector is locked into place in the mouthpiece chassis of the device body housing 101, haptic feedback (e.g., a click, increased resistance, etc.) may be provided to the adult operator to notify the adult operator that the mouthpiece has been properly connected to the device body housing 101. In some example embodiments, the mouthpiece 160 may be part of and/or integrated with the proximal end piece 152 and/or the device body housing 101.

Additionally, according to some example embodiments, the mouthpiece 160 may further include at least one aerosol outlet 165B. While FIG. 1E shows a single aerosol outlet 165, the example embodiments are not limited thereto and a plurality of aerosol outlets may be provided in the mouthpiece 160. Additionally, according to some example embodiments, an air diffuser may be provided which diffuses (e.g., separates) aerosol being drawn from the capsule 170 through the mouthpiece and through the aerosol outlets of the mouthpiece, etc.

According to some example embodiments, the distal end piece 112, the rear exterior piece 140, the front exterior piece 107, the door 151, and the proximal end piece 152 define the exterior of the device body of the aerosol generating device 100, and further define an interior space housing the air flow subsystem, control subsystem, and electrical subsystem of the aerosol generating device 100.

FIGS. 2A-2E illustrate various views of a door assembly and a mouthpiece assembly of the aerosol generating device according to some example embodiments.

Figure 2A:
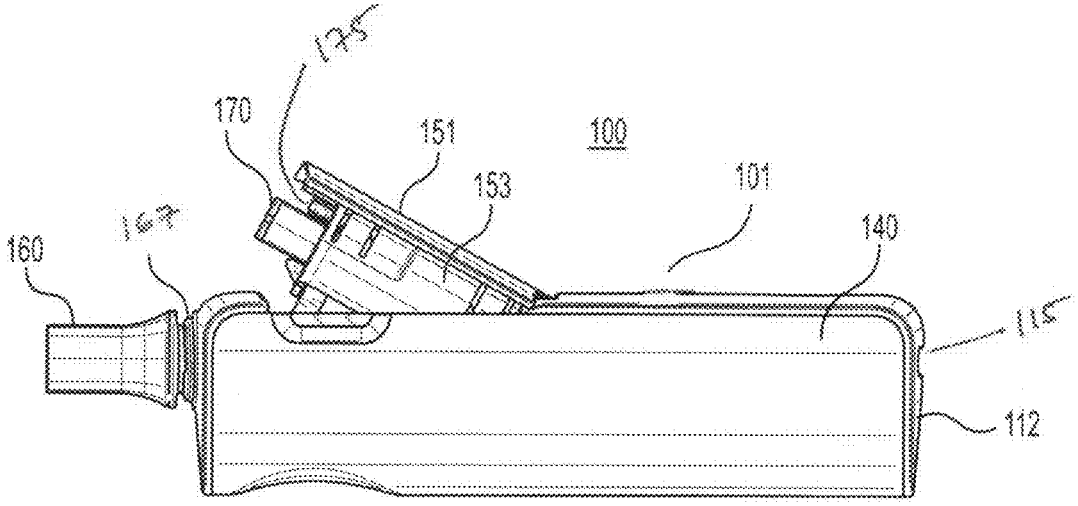
FIGS. 2A-2E illustrate various views of a door assembly and a mouthpiece assembly of the aerosol generating device according to some example embodiments.
Figure 2B:
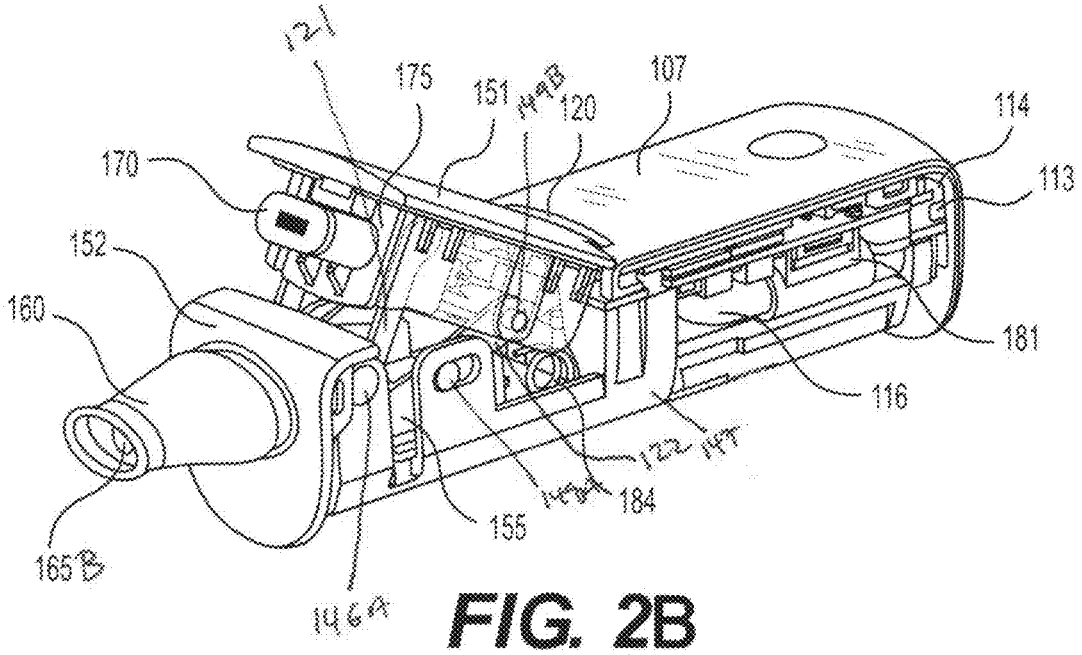

Referring now to FIGS. 2A and 2B, FIG. 2A illustrates a side view of the aerosol generating device with a door assembly in the open state according to at least one example embodiment; and FIG. 2B a top-front perspective of the aerosol generating device with the door assembly in the open state according to at least one example embodiment. As shown in FIG. 2A, an aerosol generating device 100 may include the device body housing 101, a door assembly (e.g., 1100) including a door 151, and a mouthpiece assembly (e.g., 1200) including a removable (e.g., detachable) mouthpiece 160, but the example embodiments are not limited thereto. The device body housing 101 includes a proximal portion (e.g., top portion 150 of FIG. 1A) and an opposing distal portion (e.g., bottom portion 105 of FIG. 1A). The removable mouthpiece 160 is disposed at the proximal portion 150, while the distal end piece 112 is disposed at the distal portion 105. The capsule 170, when inserted into the capsule receptacle 175 and placed into an operating position (e.g., when the door assembly is closed, etc.) is disposed in an interior space of the device body housing 101 between the mouthpiece 160 and the distal end piece 112. For example, the installed capsule 170 may be disposed in the proximal portion (e.g., 150 of FIG. 1A) or the distal portion (e.g., 105 of FIG. 1A) of the device body housing 101, but is not limited thereto.

Referring now to FIG. 2B, according to at least one example embodiment, a capsule 170 may include an aerosol generating substrate compartment (e.g., a plant material compartment, a substrate compartment, etc.) and a heater, but is not limited thereto. An air channel may extend from the distal end of the device body housing 101 (e.g., the air inlets 113 of FIG. 1D) to the removable capsule 170, and provide a flow of exterior air to the capsule upon a draw (e.g., draw event) and/or the application of negative pressure. The air channel is in the form of one or more channels extending from the air inlets 113 through the distal portion 105 of the body housing 101. The aerosol generating substrate compartment is configured to hold an aerosol generating substrate (e.g., plant material) therein. The aerosol generating substrate is a material or combination of materials that may be heated by the heater to generate an aerosol. The capsule and aerosol generating substrate will be discussed in greater detail in connection with FIGS. 9A to 9C.

A heater (which will be subsequently discussed in more detail in connection with FIGS. 9A to 9C) is disposed in at least one of the capsule 170 and the device body housing 101. The aerosol generating substrate compartment of the capsule is configured to be in fluidic communication with the heater during an operation of the aerosol generating device 100 such that the aerosol generating substrate from the aerosol generating substrate compartment comes into thermal contact with the heater. The heater is configured to heat the aerosol generating substrate to produce an aerosol that passes through the aerosol generating substrate compartment to the mouthpiece 160 via at least one aerosol passage 165 of a mouthpiece chimney 161 (as shown in FIG. 2E) and at least one aerosol outlet 165B. The at least one air hose 116 of the device body housing 101 is configured to be inserted into, connected, and/or otherwise engage with, a distal end of the capsule 170 via a capsule connector 177 such that air inlets of the capsule 170 are aligned with the air hose 116 of the device body housing 101 when the capsule 170 is in the operating position.

Additionally, at least one aerosol chimney 161 for the mouthpiece 160 is configured to be connected to, mate with, and/or otherwise engage with, a proximal end of the capsule such that aerosol outlets of the capsule are aligned with the aerosol passage 165 so as to facilitate delivery of the generated aerosol to the mouthpiece 160 through the chimney 161. The chimney 161 may be an elongated portion of the mouthpiece 160 and defines the at least one aerosol passage 165 in the form of one or more passageways extending through the mouthpiece 160. According to some example embodiments, the aerosol passage 165 and the chimney 161 are integrated into the mouthpiece 160 and passes through at least one opening (e.g., opening 154 of FIG. 4A) in the proximal end 152 of the device body housing 101 and is mated with, connected, and/or otherwise engaged with, the proximal end of the capsule. The mouthpiece will be discussed in greater detail below.

Figure 2C:
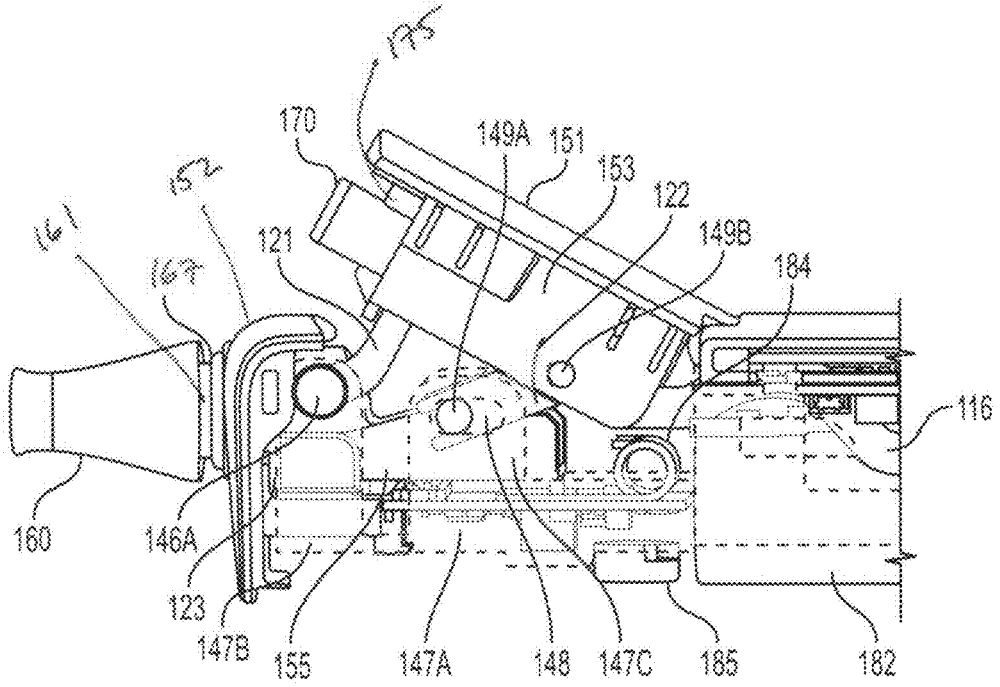
Figure 2D:
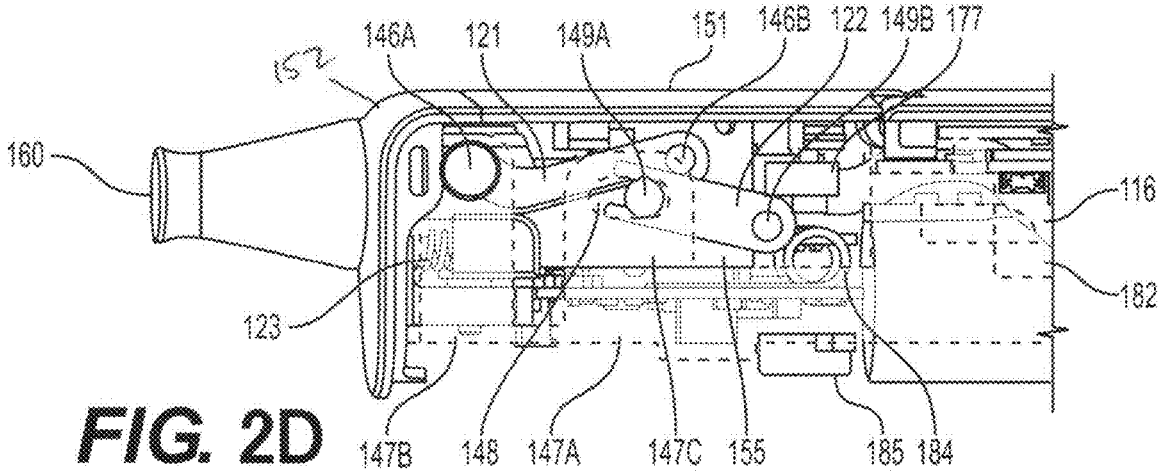
Figure 2E:
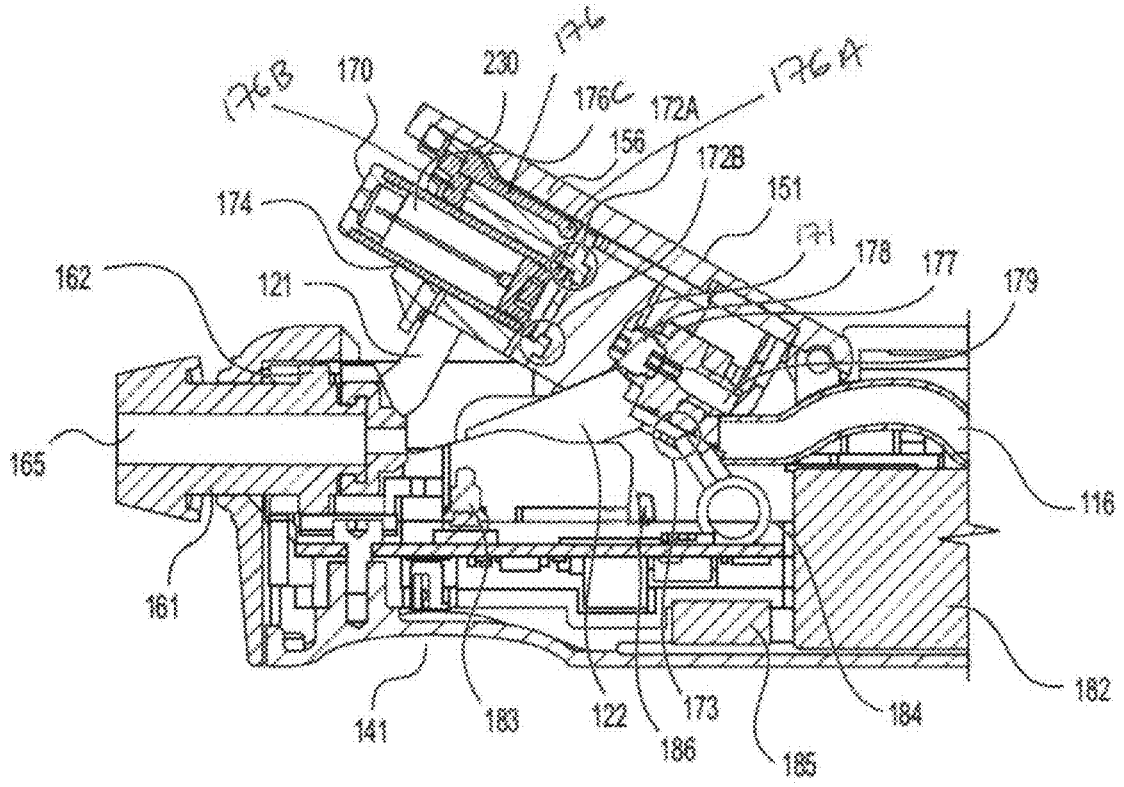

Referring additionally to FIGS. 2C and 2D, FIG. 2C illustrates a side view of the internal construction of the proximal end of aerosol generating device in an open state; and FIG. 2D illustrates a side view of the internal construction of the proximal end of aerosol generating device in a closed state, wherein the door chassis has been omitted for the sake of clarity. According to at least one example embodiment, the aerosol generating device 100 includes a door assembly (e.g., door assembly 1100 of FIG. 3A) and a mouthpiece assembly (e.g., mouthpiece assembly 1200 of FIG. 4A), but is not limited thereto. The door assembly may include a door 151, a door chassis 153 attached to the door 151, a capsule receptacle 175 movably connected to the door chassis 153 via a pair of rails 157 defined by the door chassis 153, and a capsule connector 177 attached to the door 151 via the door chassis 153, etc., but the example embodiments are not limited thereto.

According to at least one example embodiment, besides the mouthpiece 160 and mouthpiece chimney 161, the mouthpiece assembly 1200 may include a mouthpiece chassis 155. The mouthpiece chassis 155 is moveably connected to the body chassis 147 via a pair of slots 148 and pin 149A, and at least one compression spring 123 contacting the proximal end piece 152 and biased against the mouthpiece chassis 155, etc., but the example embodiments are not limited thereto. Namely, instead of a slot and pin arrangement, any slidingly engaged structure such as rails, races, bushings, etc. may be used.

Generally, the door assembly 1100 and the door 151 of the aerosol generating device 100 may be lifted, rotated, pivoted, moved, pushed, pulled, etc., into an open position (e.g., open state, etc.) or a closed position (e.g., closed state, etc.) around the hinge 120. According to some example embodiments, an adult operator may manually operate the door 151 and the door assembly 1100 into the open and/or closed positions, but the example embodiments are not limited thereto, and for example, the door 151 and the door assembly 1100 may be moved into the open or closed positions using a motor, magnetic locks, or any other comparable device. When the door 151 (and by extension the door assembly 1100) is in the open state, the capsule receptacle 175 is moved by at least one first linkage 121 to the proximal end of the door 151, and a capsule 170 may be inserted into the capsule receptacle 175. Concurrently, at least one second linkage 122 causes the mouthpiece assembly 1200 including the mouthpiece chassis 155 to be moved in a lateral direction such that the attached mouthpiece 160 is moved away from the proximal end of the device body housing 101 (e.g., move the mouthpiece 160 to an extended position and/or extended state away from the proximal end piece 152), thereby disengaging the mouthpiece 160 from the capsule 170 and allowing for the convenient and efficient removal of the capsule 170 from the body housing 101.

Additionally, when the door 151 is in the open state, the door assembly 1100 and the mouthpiece assembly 1200 cause at least one compression spring 123 to become compressed. According to some example embodiments, there are two or more compression springs 123 disposed on a U-shaped spring mount 123A (e.g., spring frame, etc.) included in the base of the body chassis 147 on the left and right sides of the mouthpiece chassis 155, but the example embodiments are not limited thereto. In response to the door 151 being moved into the closed position and movement of the second linkage 122, the at least one compression spring 123 causes the mouthpiece assembly 1200 including the mouthpiece chassis 155 to move in a lateral direction, retracting (e.g., moving, pushing, etc.) the mouthpiece 160 towards the distal end of the device body housing 101 (e.g., move the mouthpiece 160 to a closed/retracted position and/or closed/retracted state). Additionally, when the mouthpiece 160 is moved to the closed position, the mouthpiece chimney 161 engages the capsule 170. The movements of the door assembly 1100 and the mouthpiece assembly 1200 will be discussed in further detail in connection with FIGS. 5A to 5C and 6A to 6C.

Referring now to FIGS. 2C to 2E, FIG. 2C illustrates a side view of the internal construction of the proximal end of aerosol generating device in an open state; FIG. 2D illustrates a side view of the internal construction of the proximal end of aerosol generating device in a closed state, wherein the door chassis has been omitted for the sake of clarity; and FIG. 2E illustrates a cross section of the proximal end of the aerosol generating device in the open state.

As shown in FIGS. 2C to 2E, according to at least one example embodiment, a stationary body chassis 147 is disposed along a lower interior portion of the device body housing 101, and provides an internal frame for the aerosol generating device 100. According to at least one example embodiment, the body chassis 147 includes a rear base frame 147A and one or more vertical frame members (e.g., 147B and 147C, etc.) for providing structure to the aerosol generating device 100, but the example embodiments are not limited thereto. According to some example embodiments, the body chassis 147 may also include a front base frame and the rear base frame, and/or may omit one of the front base frame or the rear base frame, etc. Additionally, the exterior pieces of the device body housing 101, such as the distal end piece 112, the rear exterior piece 140, the front exterior piece 107, the door 151, and/or the proximal end piece 152, etc., may be mounted using bosses, attached, connected, welded, screwed, clipped, and/or otherwise fastened to the body chassis 147. Moreover, internal elements of the aerosol generating device 100, such as a power subsystem, airflow subsystem, and/or control subsystem, etc., may be mounted using bosses, attached, connected, welded, screwed, clipped, and/or otherwise fastened to the body chassis 147.

According to at least one example embodiment, the mouthpiece chassis 155 is also moveably attached to the stationary body chassis 147. For example, the mouthpiece chassis 155 is connected to the body chassis 147 via a pair of slots 148 on the lateral sides (e.g., the left and right sides) of the body chassis 147, such that the mouthpiece chassis 155 may move (e.g., slide) in a longitudinal direction of the aerosol generating device 100 (e.g., moving between the distal end to proximal end, etc.) using the pins 149A of the mouthpiece chassis that are inserted into the slots 148.

Additionally, the mouthpiece chassis 155 and the proximal end piece 152 of the device body housing 101 include a mouthpiece opening 154 configured to receive the chimney 161 of the mouthpiece 160. The chimney 161 is an elongated section of the mouthpiece 160 and defines at least one aerosol passageway 165 between at least one opening at the proximal end of the mouthpiece and the proximal end of the capsule 170 when the mouthpiece 160 and the capsule 170 are installed in the device body housing 101. While the Figures depict the chimney 161 as having a tube-like shape, the example embodiments are not limited thereto and the chimney 161 may have any shape.

Referring again to FIGS. 2C to 2E, the body chassis 147 may include a pair of parallel slots 148 of a desired length corresponding to a travel distance of the door 151 (e.g., the distance travelled by the door 151 between the open and closed states) arranged in the same direction as the orientation of the mouthpiece 160 to the body housing 101 (e.g., on the right and left sides of the body chassis 147 and running in the longitudinal direction through the body housing 101) in the proximal end of the aerosol generating device 100. For example, as shown in FIGS. 2C to 2E, the slots 148 are an elongated horizontal opening in the vertical member 147C of the body chassis 147, but the example embodiments are not limited thereto, and the slots 148 may be positioned in a different locations and/or may have different shapes or configurations, etc.

According to some example embodiments, the mouthpiece chassis 155 engages with the pair of slots 148 of the body chassis 147 such that the mouthpiece chassis 155 may move and/or slide along the pair of slots 148 in response to the door 151 of the door assembly 1100 being opened or closed in response to the movement of the linkage 122 and biasing of compression spring 123. Additionally, the mouthpiece chassis 155 may move in response to a lateral force (e.g., horizontal force, etc.) being applied on the mouthpiece 160, etc., but the example embodiments are not limited thereto.

More specifically, as shown in FIGS. 2C to 2E, the body chassis 147 is connected to at least one first linkage 121 via a first pivot 146A (e.g., a ball joint, a pin, etc.) inserted into the vertical support 147B of the body chassis 147, and the mouthpiece chassis 155 is connected to at least one second linkage 122 via a second pivot 149A (e.g., a ball joint, a pin, etc.). The second pivot 149A is inserted into the slots 148 (e.g., the elongated horizontal slot) of the vertical support 147C of the body chassis 147 and an opening in the second linkage 122. The first linkage 121, first pivot 146A, second linkage 122, and/or the second pivot 149A may each be a pair of linkages or pivots located on the left and right side of the body chassis 147 and the mouthpiece chassis 155, respectively, but are not limited thereto.

The first linkage 121 may be an angled or elbow linkage (e.g., angled less than 90 degrees) and the second linkage 122 may be a straight (e.g., linear) linkage, and the length of the first linkage 121 may be longer than the second linkage 122 to enable the proximal end of the capsule receptacle 175 and the door 151 to open, but the example embodiments are not limited thereto, and the linkages may have different shapes or lengths. The first linkage 121 is fixedly, rotatably attached to the body chassis 147 at a proximal end of body chassis 147, and the second linkage 122 is fixedly, rotatably attached at the distal end of the door chassis 153, but the example embodiments are not limited thereto.

The second linkage 122 and the second pivot 149A may laterally travel within the slots 148 in response to the door 151 being opened or closed, and/or the second linkage 122 may provide an assisting force to the door 151 to open or close in response to the second pivot 149A being laterally moved (e.g., being laterally moved by at least one compression spring 123, etc.). According to some example embodiments, a proximal end of the second linkage 122 may be open (e.g., U-shaped), but the example embodiments are not limited thereto, and for example the proximal end of the second linkage 122 may be closed (e.g., closed and defining slot openings for receiving pins 149A). At least one compression spring 123 is disposed on a spring mount (e.g., spring mount 123A of FIG. 4A), which is disposed on the proximal wall at a lower section of the vertical support 147B of the body chassis 147, e.g., and the spring mount 123A via bosses on the proximal end piece 152, but the example embodiments are not limited thereto.

According to some example embodiments, there are at least two compression springs 123 on the left and right sides, respectively, of the body chassis 147, but the example embodiments are not limited thereto. The compression springs 123 are biased against and/or contact a lower, proximal section of the mouthpiece chassis 155. When the door 151 is opened, the mouthpiece chassis 155 is caused to move in a proximal lateral direction due to the proximal lateral movement of the second linkage 122 and the second pivot 149A, thereby causing the compression of the compression springs 123. Additionally, this proximal lateral movement of the mouthpiece chassis 155 causes the mouthpiece 160 and the chimney 161 to disengage and/or move to the extended position due to the connection of the mouthpiece 160 to the mouthpiece chassis 155.

As shown in FIGS. 2C and 2D, the opposite end of the first linkage 121 is rotatably connected to a side face(s) (e.g., left or right side) of the capsule receptacle 175 (e.g., a capsule receptacle housing, a capsule housing, a capsule holder, etc.) via at least one pin 146B, and the second linkage 122 is rotatably connected to a side face(s) of the door chassis 153 via at least one pin 149B. As discussed above, when the door 151 is opened and/or raised, the capsule receptacle 175 is moved to the proximal end of the door 151 due to the connection to the first linkage 121. Additionally, the movement of the door 151 and the connection to the door chassis 153 causes the second linkage 122 to move in the proximal lateral direction along the slots 148 (e.g., the door 151 pushes the second linkage 122 and the mouthpiece chassis 155 forward).

When a closing force is applied to the door 151 and/or the door 151 begins to be closed (e.g., the door 151 is rotated to the closed position), the previously compressed spring 123 converts its stored potential energy into kinetic energy to assist in the movement of (e.g., push) the mouthpiece chassis 155 towards the distal end of the body chassis 147 (e.g., closed position), thereby causing the door 151 to completely close due to the connection of the first linkage 121 and the second linkage 122 to the capsule receptacle 175 and the door chassis 153, respectively.

According to some example embodiments, if the adult operator is applying a closing force to the door 151, the springs 123 may provide an assisting closing force for the closure of the door. Additionally, while the mouthpiece chassis 155 is being pushed to the closed position by the biasing force of the springs 123 and/or the closing force applied by the adult operator to the door 151, the capsule receptacle 175 is moved and/or pushed to the distal end (e.g., closed position) of the door chassis 153 due to the connection of the first linkage 121 to the capsule receptacle 175. Moreover, when the mouthpiece chassis 155 is moved to the closed position by the biasing force of the springs 123, the mouthpiece 160 is also moved to the closed/retracted position due to the connection (described in detail below) of the mouthpiece 160 with the mouthpiece chassis 155, and is caused to engage an inserted capsule 170. Additionally, the biasing force of the springs 123 may maintain the mouthpiece 160, mouthpiece chassis 155, and the door 151 in the closed/retracted positions.

While the body chassis 147 illustrated in FIGS. 2C to 2E is shown as being a single piece, the example embodiments are not limited thereto and the body chassis may be formed using a plurality of pieces, for example, the body chassis 147 may include a left piece and a right piece, and/or a distal piece and a proximal piece, etc.

According to some example embodiments, the base frame of the body chassis 147 is substantially rectangular shaped, but the example embodiments are not limited thereto, and for example, may have a curved shape corresponding to the contours of the device bodying housing 101, etc., and/or any other shape. The base of the body chassis 147 may include a concave section which corresponds to the location of the first recess section 141, and may have substantially similar dimensions as the first recess section 141.

Referring now to FIG. 2E, according to at least one example embodiment, when the door 151 is in the open state, the capsule receptacle 175 is moved to and/or positioned at a proximal end of the door chassis 151. The capsule receptacle 175 may be a housing formed from a plastic with a high temperature resistance, such as polyether ether ketone (PEEK) plastic, liquid crystal polymer (LCP), Acetal, etc., or other materials capable of withstanding high temperatures (e.g., approximately 80° C. or higher, etc.), but the example embodiments are not limited thereto. Additionally, according to some example embodiments, metals, such as aluminum or stainless steel, may be used as well. As shown in FIGS. 8A to 8B and 9A to 9C, the capsule receptacle 175 is a substantially rectangular prism shape and includes a front surface, a rear surface, a left surface, a right surface, and a proximal face and a distal face, but is not limited thereto, and for example may have other shapes. The capsule receptacle 175 includes an opening on the proximal face of the capsule receptacle 175, the proximal opening configured to receive the capsule 170, thereby allowing for the insertion of a capsule 170 into the capsule receptacle 175. The proximal opening of the capsule receptacle 175 may have the same, or substantially similar, shape as an end cap of the housing of the capsule 170, to facilitate the proper alignment and/or fitment of the capsule 170 and to avoid the insertion of non-capsule objects into the capsule receptacle 175, but the capsule receptacle 175 is not limited thereto and other shaped proximal openings may be used.

Additionally, the capsule receptacle 175 also includes an opening on a distal face of the capsule receptacle 175. The distal opening of the capsule receptacle 175 may be smaller than the distal end of the capsule 170, such that the capsule 170 is held in place by one or more restraining members (e.g., 172A and 172B) protruding from the edges of the capsule receptacle 175, and prevented from falling into the interior cavity of the device body housing 101. The restraining members 172A and 172B may be disposed on the front and rear of the distal opening of the capsule receptacle 175, thereby securing the capsule 170 inside of the capsule receptacle 175, while defining an opening sufficiently large enough to allow a capsule connector 177 to enter the opening and connect to, attach to, and/or mate with electrical contacts and/or an air inlet disposed on the distal end of the capsule 170. Moreover, the restraining members 172A and 172B may have dimensions such that the surface area of the capsule receptacle and the restraining members contacting the capsule is reduced and/or minimized, thereby reducing and/or minimizing the thermal contact between the capsule and the aerosol generating device 100. For example, according to one example embodiment, the capsule may have approximate dimensions of 12.4 mm×6 mm, the restraining members may each be approximately 4 mm long and protrude approximately 0.8 mm from the edge of the capsule receptacle, but the example embodiments are not limited thereto. However, the example embodiments are not limited thereto, and for example, the restraining members 172 and 172B may be located on the left and rights sides of the capsule receptacle 175, and/or there may be a greater or lesser number of restraining members, etc.

According to at least one example embodiment, the device body housing 101 may further include a capsule detection switch 183 (e.g., a capsule detection sensor, etc.), a door detection switch 186 (e.g., a door detection sensor, etc.), and/or a haptic feedback motor 185, etc., but the example embodiments are not limited thereto, and for example, one or more of the capsule detection switch 183, door detection switch 186, and/or the haptic feedback motor 185, may be omitted. The capsule detection switch 183 may be a pressure switch, a contact switch, a sensor, etc., which is disposed inside of the device body housing 101 and detects a presence or absence of a capsule 170 within the device body housing 101. For example, the capsule detection switch 183 may be triggered by and/or may come into contact with a capsule 170 properly inserted into the capsule receptacle 175 when the door 151 is moved to the closed position, but is not limited thereto. In response to the capsule detection switch 183 detecting the presence of the capsule 170, the capsule detection switch 183 transmits a first electrical signal (e.g., a capsule detection signal, etc.) indicating the detection of the capsule to a control subsystem (e.g., 180 of FIG. 10). Additionally, the door detection switch 186 may be a pressure switch, a contact switch, a sensor, etc., which is disposed inside of the device body housing 101 and detects whether the door 151 and/or mouthpiece chassis 155 is moved to the closed and/or retracted position. For example, the door detection switch 186 may be triggered by and/or come into contact with the mouthpiece chassis 155 when the mouthpiece chassis 155 is moved to the closed and/or retracted position, thereby indicating that the door 151 is in the closed position due to the travel of the first linkage 121 and the second linkage 122, but the example embodiments are not limited thereto, and for example, the door detection switch 186 may be positioned such that it comes into direct contact with the door 151 when the door 151 is in the closed position, etc. When the door detection switch 186 detects that the door 151 is in the closed position (and/or the mouthpiece chassis 155 is in the closed/retracted position, etc.), the door detection switch 186 transmits a second electrical signal (e.g., a door detection signal, etc.) indicating the door 151 is closed to a control subsystem 180.

According to some example embodiments, in response to receiving the first electrical signal and the second electrical signal from the capsule detection switch 183 and the door detection switch 186, respectively, the control subsystem (e.g., 180 of FIG. 10) enables current to flow from the battery 182 to the capsule 170. Additionally, in response to the control subsystem (e.g., processing circuitry, control circuitry, etc.) not receiving the first electrical signal from the capsule detection switch 183 and/or not receiving the second electrical signal from the door detection switch 186, the control subsystem 180 may disable and/or prohibit the flow of current from the battery 182 to the capsule receptacle 175.

However, the example embodiments are not limited thereto, and the capsule detection switch 183 and/or the door detection switch 186 may be omitted and/or not used by the control subsystem to control the flow of current from the battery 182 to the capsule receptacle 175, etc. Additionally, according to some example embodiments, the first electrical signal and/or the second electrical signal may be binary signals with a first value indicating the detection of the capsule and/or door closure and a second value indicating the non-detection (e.g., absence) of the capsule and/or door closure, but the example embodiments are not limited thereto.

According to some example embodiments, the control subsystem may further control the haptic motor 185 (e.g., a haptic feedback motor, etc.) to provide a first haptic response (e.g., a vibration of a first desired intensity, first desired frequency, and/or a first desired interval, etc.) indicating that the capsule 170 has been properly installed into the aerosol generating device 100 in response to receiving the first electrical signal from the capsule detection switch 183. The control subsystem may also control the haptic motor 185 to provide a second haptic response (e.g., a vibration of a second desired intensity, second desired frequency, and/or a second desired interval, etc.) indicating that the capsule 170 has not been properly installed into the aerosol generating device 100 in response to receiving the second electrical signal from the capsule detection switch 183. According to some example embodiments, the control subsystem also controls the display panel 107/107A to display status information regarding the capsule 170 in response to receiving the first and/or second electrical signal from the capsule detection switch 183, etc. Additionally, according to some example embodiments, the aerosol generating device 100 also includes a speaker, and the control subsystem may additionally control the speaker to provide auditory feedback (e.g., tones, beeps, music, recorded messages, etc.) to an adult operator regarding the insertion and/or removal of a capsule 170 from the aerosol generating device 100, the status of the plant material included in the capsule 170, battery status information, etc.

While the Figures illustrate the elements of the door assembly and the mouthpiece assembly disposed in the proximal portion 150 of the aerosol generating device 100, the example embodiments are not limited thereto, and for example, the door assembly may be disposed in the distal portion 105 of the aerosol generating device 100, etc. Additionally, while the Figures illustrate the door 151 being disposed on a front face of the aerosol generating device 100, the example embodiments are not limited thereto, and the door 151 may be disposed on any other face of the aerosol generating device 100.

FIGS. 3A-3F illustrate various views of a door assembly of at least one example embodiment.

Figure 3A:
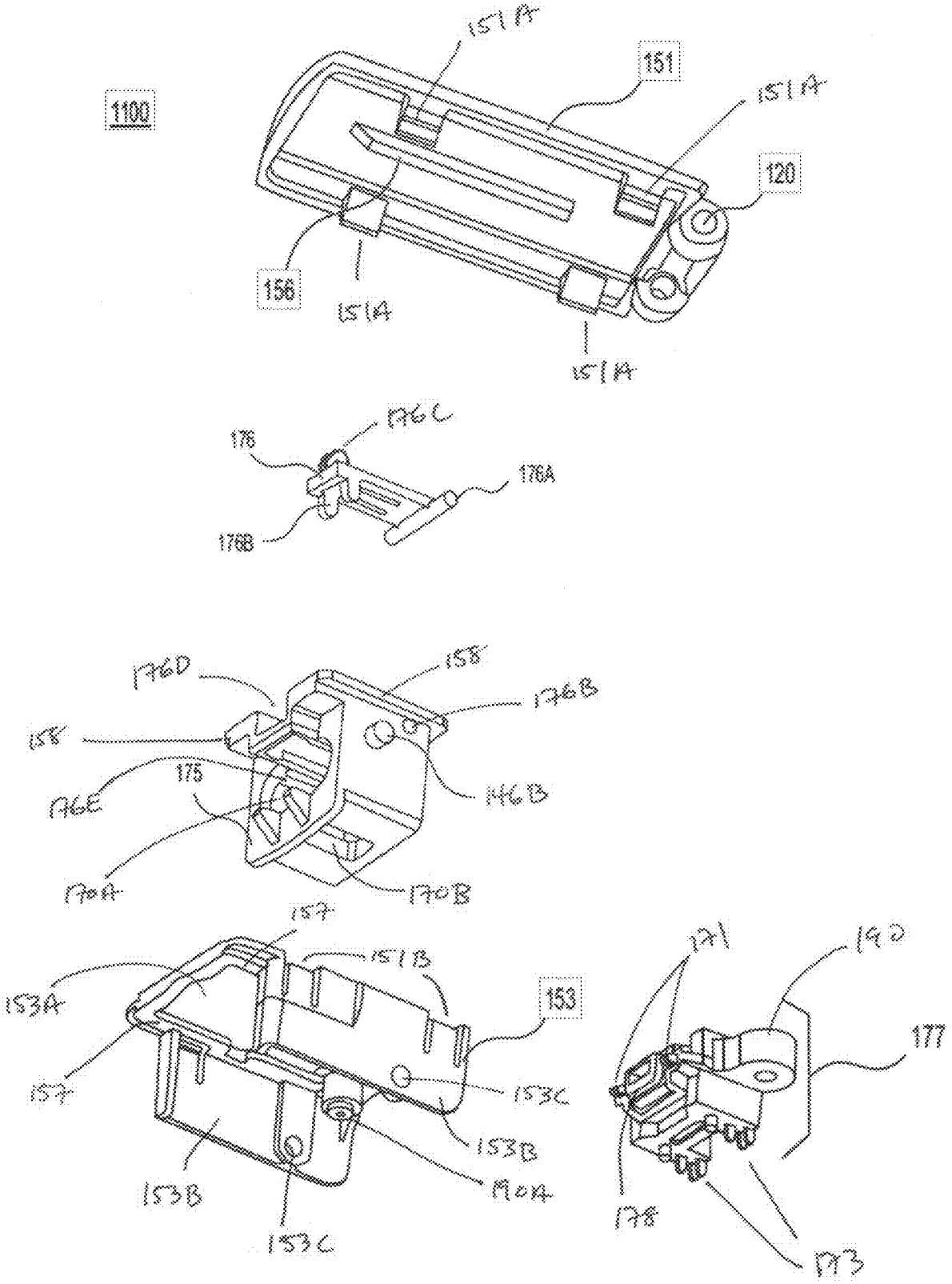
Figure 3B:
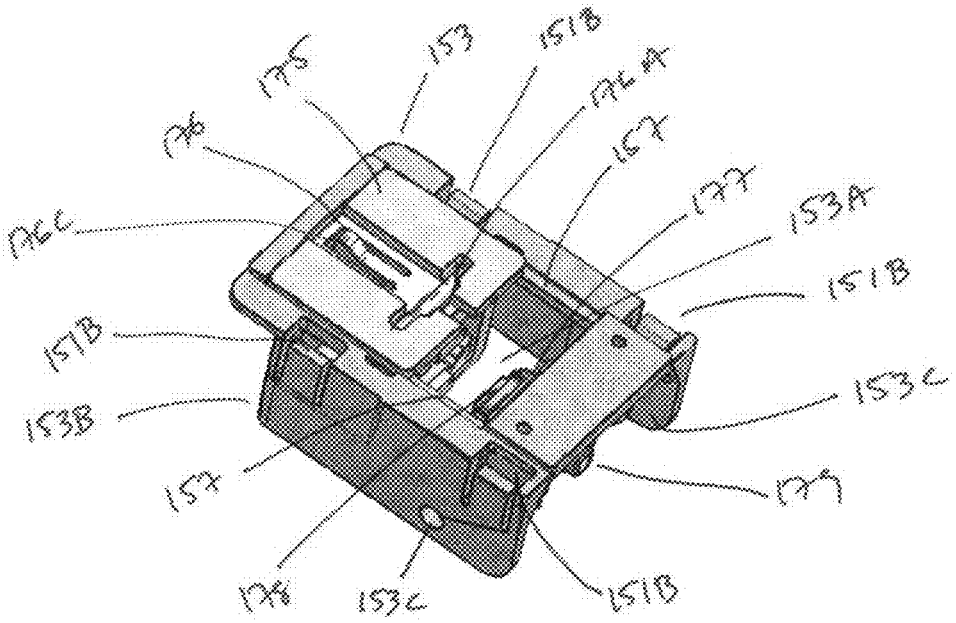
Figure 3C:
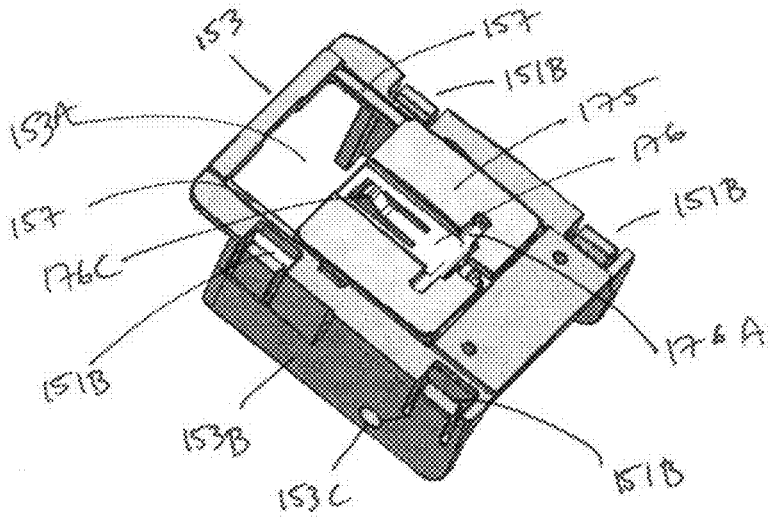
Figure 3D:
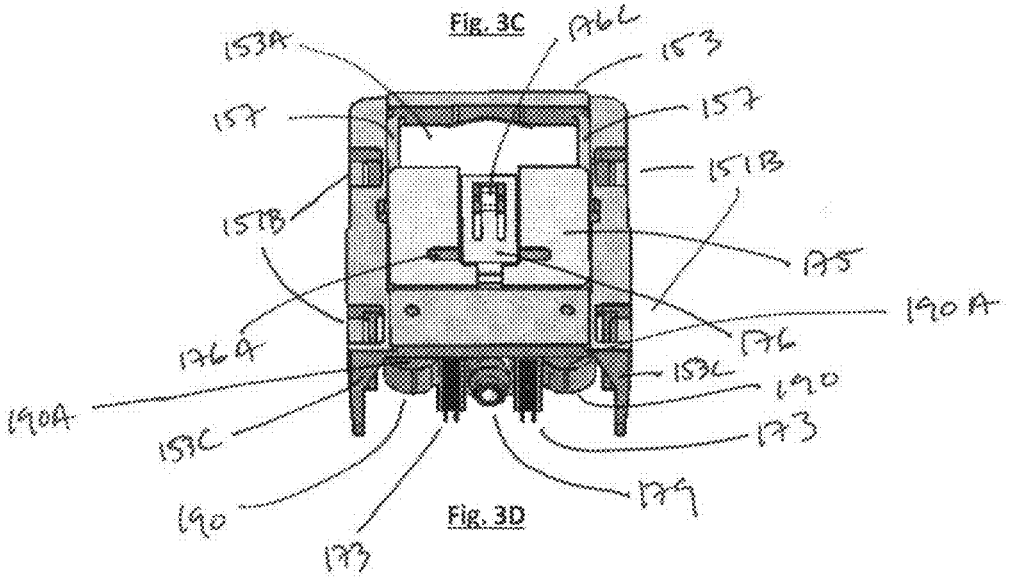

Referring now to FIGS. 3A to 3D, FIG. 3A illustrates an exploded view of the door assembly according to at least one example embodiment; FIG. 3B illustrates a bottom-front perspective view of the interior elements of the door assembly in the open position; FIG. 3C illustrates a bottom-front perspective view of the interior elements of the door assembly in the closed position; and FIG. 3D illustrates a bottom perspective view of the interior elements of the door assembly in the closed position.

According to at least one example embodiment, a door assembly 1100 may include a door 151, a door chassis 153, at least one cam-actuated restraining element 176, a capsule receptacle 175, and a capsule connector 177, but the example embodiments are not limited thereto. The door 151, door chassis 153, at least one cam-actuated restraining element 176, capsule receptacle 175, and capsule connector 177 may each be symmetrical along a longitudinal axis, but are not limited thereto.

According to at least one example embodiment, the door 151 may further include at least one cam 156 and the hinge 120, but is not limited thereto. The cam 156 and the cam-actuated restraining element 176 will be discussed in greater detail below. The door chassis 153 may be attached to the interior side of the door 151 via one or more clips 151A attached to the clip slots 151B, but the example embodiments are not limited thereto, and the door chassis 153 may be screwed, welded, and/or otherwise engaged to the interior side of the door 151. The door chassis 153 may define a substantially planar rectangular frame and may include a vertical opening 153A inside the planar rectangular frame, and may further include a set of lateral side wings 153B. According to at least one example embodiment, the door chassis 153 is open on a proximal, distal, and rear faces. Further, the door chassis 153 may further include at least one vertically oriented boss 190A to mate with the bosses 190 of a capsule connector 177, thereby attaching and/or fixing the capsule connector 177 to the door chassis 153, but the example embodiments are not limited thereto and other engagement types may be used as well. Additionally, the door chassis 153 includes a pair of openings 153C (e.g., hinge points, etc.) which connect with and/or mate with the pins 149B disposed at the distal end of the second linkages 122, and allow the second linkage 122 to rotate around the opening 153C. The door chassis 153 further include a pair of rails 157 (e.g., tracks, sliders, guide rails, etc.) on the lateral sides of the door chassis 153 frame, and when the capsule receptacle 175 is inserted (e.g., dropped) into the opening 153A from above, the rails 157 contact a pair of lateral overhang edges 158 of a front surface of the capsule receptacle 175, thereby allowing the capsule receptacle 175 to move (e.g., slide, travel, etc.) from a proximal end to the distal end of the opening 153A of the door chassis 153 upon the application of a longitudinal force.

Additionally, the capsule receptacle 175 is a substantially cubic shaped frame configured to hold a capsule 170. The capsule receptacle 175 includes a proximal surface which defines a proximal opening 170A for receiving the capsule 170, and the proximal opening 170A has the same dimensions and/or larger dimensions than the capsule 170, and substantially the same shape as the capsule 170. For example, the proximal opening and an interior cavity of the capsule receptacle 175 extend in a longitudinal direction towards the distal face of the capsule receptacle 175 and may have dimensions that are approximately 0.1 mm larger than the dimensions of the exterior housing of the capsule 170 in order to achieve an air gap between the capsule receptacle 175 and the exterior housing of the capsule 170, but the example embodiments are not limited thereto. Additionally, pairs of internal rails 176E may be defined in the interior walls (e.g., cavity walls) of the capsule receptacle 175 in the longitudinal direction, and the spaces next to each of the internal rails may be receded, cutaway, etc. The internal rails 176E may further contact and/or guide an inserted capsule 170 towards the capsule connector 177 in the event that the capsule 170 is not connected to the capsule connector 177 (e.g., while the door assembly 1100 is being moved to the closed position, etc.), as well as increase the air gap and/or air thermal insulation around the capsule 170 on the sides of the internal rails 176E. However, the example embodiments are not limited thereto, and according to some other example embodiments, the air gap may be omitted, may be greater or may be less than 0.1 mm. The air gap will be discussed in greater detail below.

Further, the capsule receptacle 175 may define a front surface channel 176D and a rear surface opening 170B according to some example embodiments. At least one cam-actuated restraining element 176 may be seated in the front surface channel 176D. The body of the cam-actuated restraining element 176 may be substantially planar shaped, which a hinge 176A disposed at a distal end of the cam-actuated restraining element 176, a hooked-shaped (or L-shaped) contact element 176B disposed at a proximal end of the cam-actuated restraining element 176, and a protrusion and/or bump 176C disposed on a front surface of the cam-actuated restraining element 176, but the example embodiments are not limited thereto, and the cam-actuated restraining element 176 may have different designs or configurations.

According to at least one example embodiment, the hinge 176A of the cam-actuated restraining element 176 may mate with the hinge openings 176B of the capsule receptacle 175. Additionally, the front surface channel 176D may further include a rear opening to the interior cavity 170A of the capsule receptacle 175, thereby allowing the contact element 176B of the cam-actuated restraining element 176 to drop into the interior cavity 170A and/or contact a capsule installed in the interior cavity 170A of the capsule receptacle 175. Further, the protrusion 176C may be configured to contact the cam 156 of the rear surface (e.g., interior surface) of the door 151 as the capsule receptacle 175 slides down the rails 157 of the door chassis 153, thereby forcing the cam-actuated restraining element 176 to contact the surface of an installed capsule 170, etc.

Additionally, the capsule receptacle 175 includes at least one hinge point 146B (e.g., hinge pin, etc.) for attachment to the distal end of at least one first linkage 121, which causes the movement of the capsule receptacle 175 towards the capsule connector 177 when the door assembly 1100 is moved to the closed position, or causes movement of the capsule receptacle 175 away from the capsule connector 177 when the door assembly 110 is moved to the open position, etc. The capsule receptacle 175 also defines a rear opening 170B. A capsule detection switch (e.g., capsule detection switch 183) disposed on a PCB on the rear interior surface of the device body housing 101 may fit within the rear opening 170B of the capsule receptacle 175 when the door assembly 1100 is rotated to the closed position, and may contact and/or detect a capsule 170 installed within the capsule receptacle 175 when the capsule receptacle 175 is in the closed position, but the example embodiments are not limited thereto.

The door assembly 1100 may also include a capsule connector 177, which provides air and electrical connections to a capsule installed in the capsule receptacle 175, but is not limited thereto. According to some example embodiments, when the capsule 170 is present within the capsule receptacle 175 and the capsule receptacle 175 is moved to the distal end of the door chassis 153 in response to the door 151 being closed (e.g., the door assembly is in the closed position), the capsule 170 is connected to both the electrical subsystem and the airflow subsystem (e.g., air hose 116, etc.) of the of the aerosol generating device 100, or in other words, the capsule 170 is automatically positioned, steered, and/or self-guided into the proper position, thereby ensuring that a robust electrical connection and fluidic seal is achieved between the capsule 170 and the aerosol generating device 100. The electrical subsystem and airflow subsystem will be discussed in greater detail below.

The capsule connector 177 may be fixedly attached (e.g., screwed, welded, bossed, etc.) to the door chassis 153 and/or the door 151, but is not limited thereto. As shown in FIGS. 3A and 3D, the capsule connector 177 is embossed to the bosses 190A disposed on the interior surface of the door via bosses 190. The capsule connector 177 further includes capsule connector sealing element 178 which aligns with and forms an air-tight and/or substantially air-tight seal with the distal end of the capsule 170. The capsule connector 177 will be discussed in further detail below.

Referring now to FIGS. 3E and 3F, FIG. 3E illustrates a cross section view of a cam-actuated restraining element and the door assembly in a closed state according to at least one example embodiment. FIG. 3F illustrates a cross section view of a cam-actuated restraining element and the door assembly in the open state according to at least one example embodiment.

According to some example embodiments, the capsule receptacle 175 further includes at least one cam-actuated restraining element 176 (e.g., a restraining element, an anti-bounce cam, a finger element, etc.) to frictionally engage and restrain any capsule 170 inserted into the opening of the capsule receptacle 175 from being accidentally removed and/or dislodged from the capsule receptacle 175 during the movement of the door 151 from the open position to the closed position and/or during the movement of the door 151 from the closed position to the open position. Additionally, the at least one cam-actuated restraining element 176 restrains any capsule 170 inserted into the opening of the capsule receptacle 175 from being accidentally removed, dislodged, and/or disconnected from the capsule connector 177 while the door 151 is in the closed position. As shown in FIGS. 3A, 3E, and 3F, the cam-actuated restraining element 176 includes a hinge 176A at a distal end of the capsule receptacle 175, and a hook-shaped contact element 176B (e.g., a "finger" piece, a T-shaped piece, etc.) at a proximal end of the capsule receptacle 175, however the example embodiments are not limited thereto and the contact element may have a different shape. The door 151 may include at least one cam 156 which engages, contacts, and/or restrains, an upper surface of the capsule 170 while the door 151 is being rotated to the closed position, thereby reducing and/or preventing the capsule 170 from being removed and/or dislodged from the capsule connector 177 when the door 151 is in the closed position. More specifically, the cam 156 has a slanted proximal edge (e.g., a leading edge) which contacts a protruding element 176C (e.g., a bump) disposed on a front surface of the cam-actuated restraining element 176 as the cam-actuated restraining element 176 and the capsule receptacle 175 moves towards the distal end of the door 151.

As shown in FIG. 3E, while the cam-actuated restraining element 176 is in contact with the cam 156, the contact element of the cam-actuated restraining element 176 is pushed in a downwards direction (e.g., towards a capsule, towards the interior space of the device body housing, etc.). According to the example embodiments, the cam-actuated restraining element 176 will engage with the capsule 170, thereby holding the capsule 170 in place. Moreover, according to the example embodiments, the cam-actuated restraining element 176 will engage the capsule 170 and restrain/hold the capsule 170 in place even if the orientation of the aerosol generating device 100 is changed (e.g., the aerosol generating device 100 is held upside down, backwards, upright, etc.).

Additionally, when the cam-actuated restraining element 176 is engaged by the cam 156, the contact element 176B restrains the capsule 170 from becoming displaced, moving, and/or bouncing when the door 151 is closed using friction between the contact element 176B and the surface of the capsule 170. Additionally, when the door 151 is in the fully open position and the cam-actuated restraining element 176 and capsule receptacle 175 are in the open position, the cam-actuated restraining element 176 loses contact with the cam 156 due to a recess in the door 151, thereby causing the contact element 176B of the cam-actuated restraining element 176 to disengage with and/or move away from the surface of the capsule 170, thereby allowing an adult operator to remove the capsule 170 from the capsule receptacle 175.

Additionally, as shown in FIG. 3F, the proximal opening of the capsule receptacle 175 may have dimensions that are greater than the dimensions of the capsule 170 in order to provide an air gap 174 between the capsule 170 and the interior walls of the capsule receptacle 175 on at least two sides of the capsule 170 (e.g., the lateral sides of the capsule 170), but the example embodiments are not limited thereto. For example, the proximal opening may be approximately 12.6 mm×6.2 mm at its widest points, and there may be an air gap 174 of approximately 0.1 mm between the outer diameter of the capsule and the proximal opening of the capsule receptacle 175, but the example embodiments are not limited thereto. The air gap provides thermal insulation between the heated capsule 170 and the device body housing 101, thereby reducing the temperature of the device body housing 101 and decreasing and/or minimizing any heat-related discomfort felt by the adult operator during operation of the aerosol generating device 100.

According to some example embodiments, the capsule receptacle 175 may also include one or more internal pairs of rails 176E defined on one or more interior sides of the capsule receptacle 175 to guide the capsule 170 into the interior cavity of the capsule receptacle 175 while the capsule 170 is not connected to the capsule connector 177 (e.g., the capsule 170 may contact the internal rails 176E due to the force of gravity, misalignment, etc.). However, the dimensions of the internal pairs of rails 176E may be configured so that the internal rails 176E do not protrude into the interior cavity of the capsule receptacle 175 and therefore the air gap 174 around the capsule 170 is established and/or maintained when the capsule 170 is mated to and/or connected to the capsule connector 177. In other words, the capsule 170 is not in contact with the internal rails 176E of the capsule receptacle 175 while the door 151 is in the fully closed position (and the capsule receptacle 175 is positioned at the distal end (e.g., closed position) of the door chassis 153), but while the door 151 is in motion and/or is in the open position, e.g., the capsule 170 is disengaged from the capsule connector 177, the capsule 170 may come into contact with the internal rails 176E of the capsule receptacle 175.

Figure 4A:
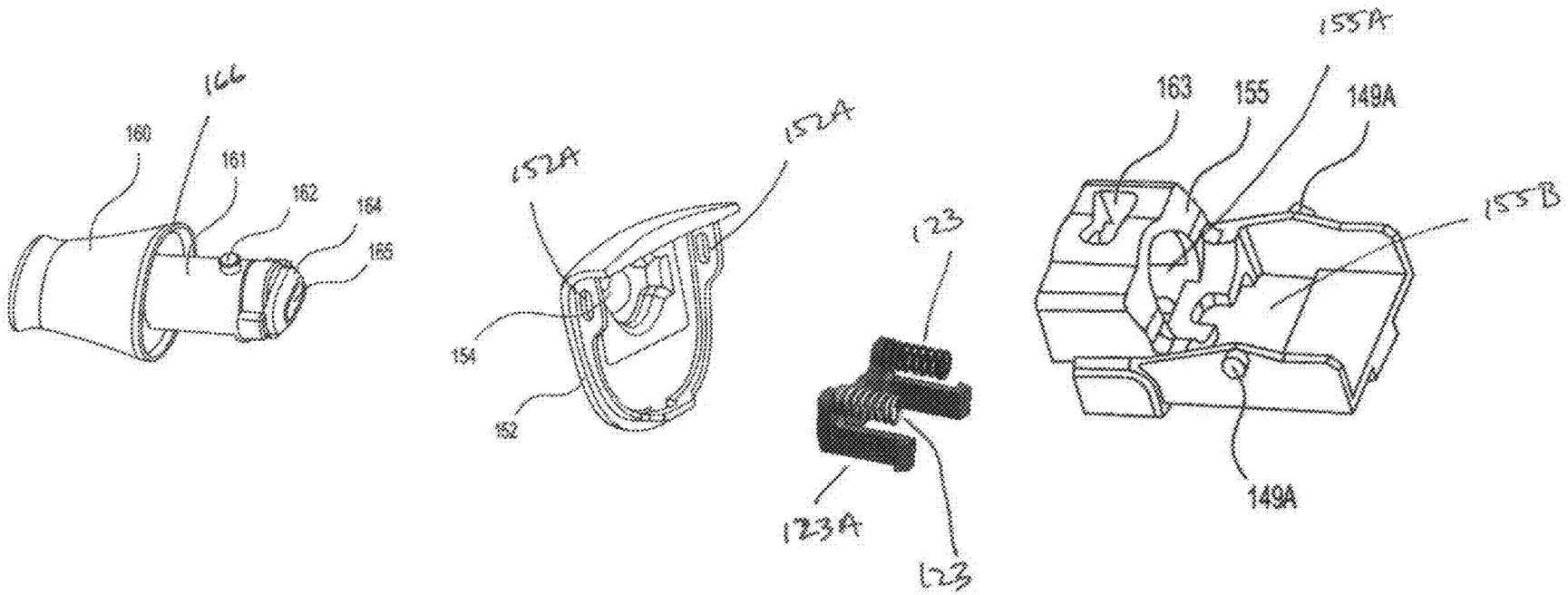
FIGS. 4A to 4F illustrate various views of the mouthpiece assembly according to some example embodiments.
Figure 4B:
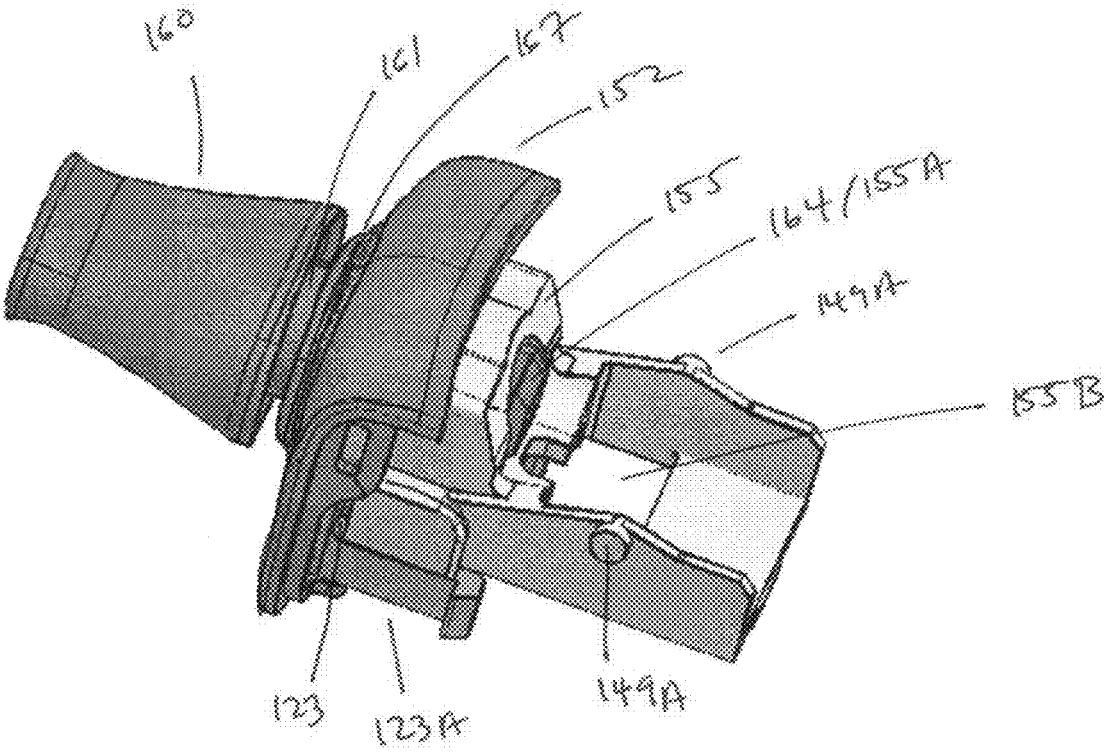
Figure 4C:
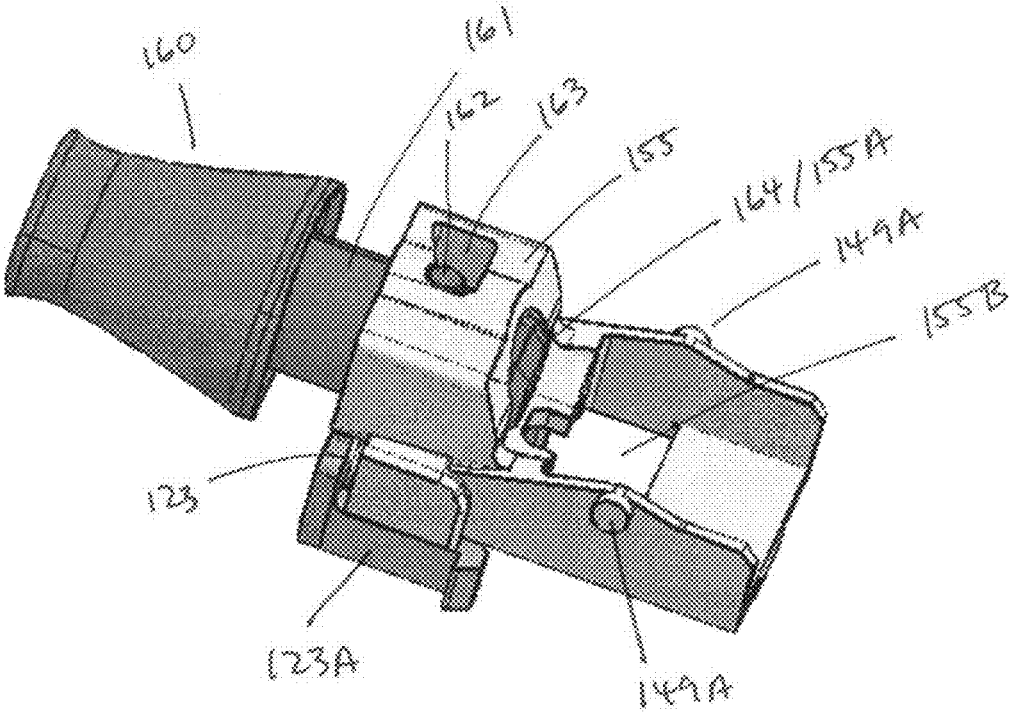
Figure 4D:
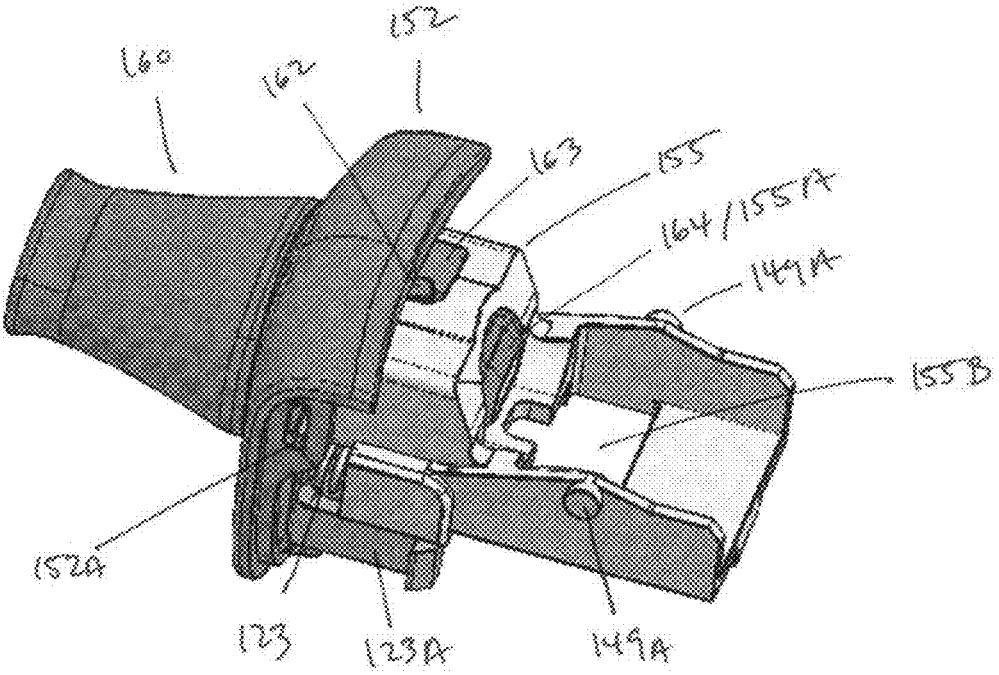
Figure 4E:
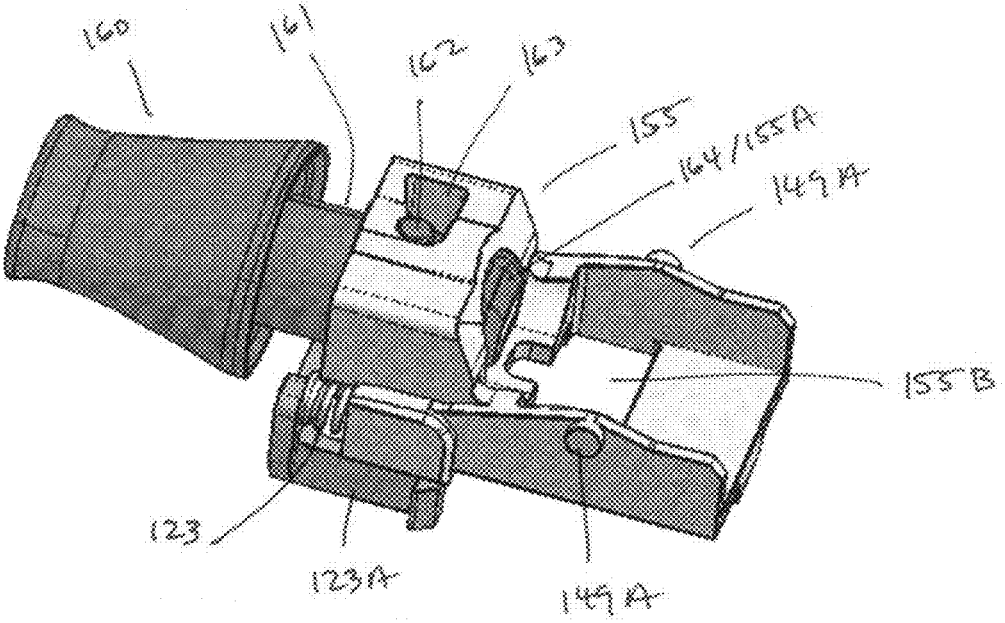
Figure 4F:
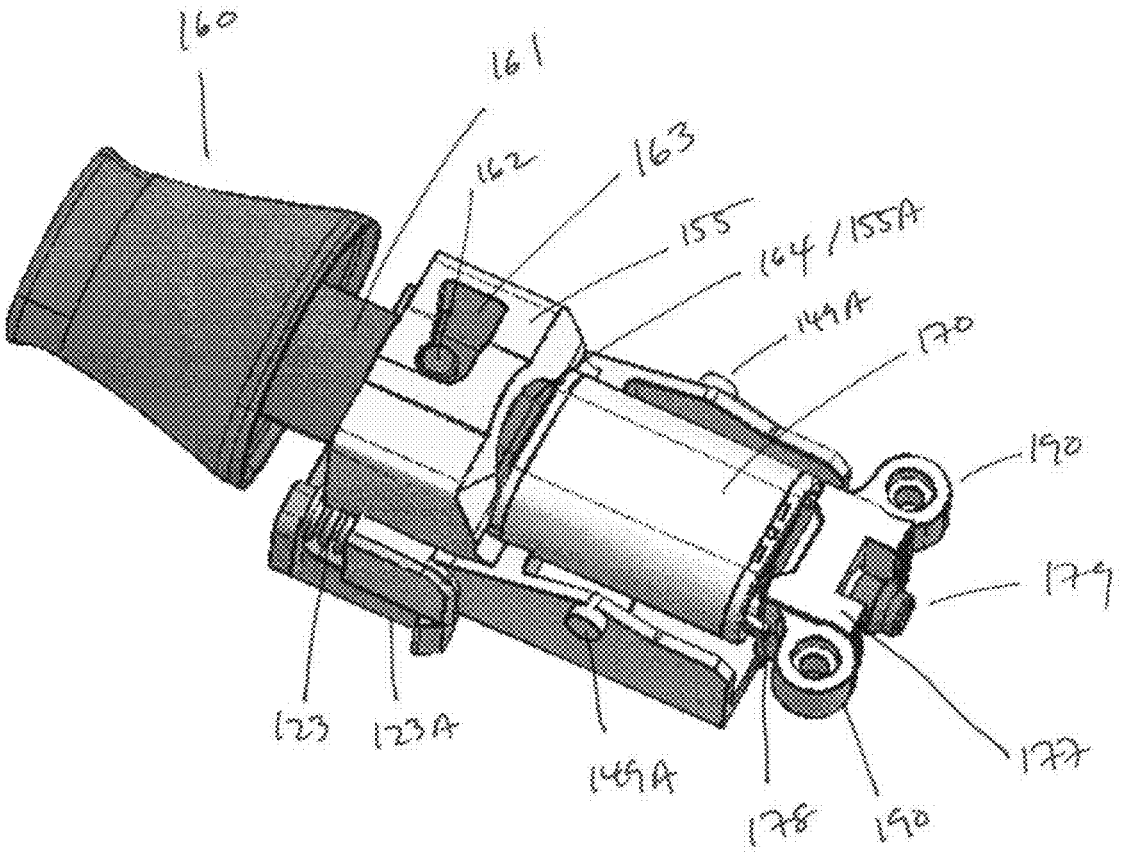

FIGS. 4A to 4F illustrate various views of the mouthpiece assembly according to some example embodiments. More specifically, FIG. 4A illustrates an exploded view of a mouthpiece assembly according to at least one example embodiment; FIG. 4B illustrates the mouthpiece assembly of FIG. 4A in the open position; FIG. 4C illustrates a second view of the mouthpiece assembly of FIG. 4B in the open position and without the proximal end piece; FIG. 4D illustrates the mouthpiece assembly of FIG. 4A in the closed position; and FIG. 4E illustrates a second view of the mouthpiece assembly of FIG. 4D in the closed position and without the proximal end piece; and FIG. 4F illustrates mouthpiece assembly of FIG. 4D aligned with a capsule and capsule connector in the closed position according to some example embodiments.

According to at least one example embodiment, a mouthpiece assembly 1200 may include a removable mouthpiece 160, a chimney 161 connected (e.g., integral) with the mouthpiece 160, and a mouthpiece chassis 155, but the example embodiments are not limited thereto, and for example, the chimney 161 may be detachable from the mouthpiece 160, etc. As shown in FIGS. 4A to 4D, the various elements of the mouthpiece assembly 1200 are substantially symmetrical along a longitudinal axis, but the example embodiments are not limited thereto. The mouthpiece assembly 1200 may be installed in an interior space of the device body housing 101 of the aerosol generating device 100, and more specifically the proximal end piece 152 and/or a spring mount 123A may be attached to the stationary internal frame (e.g., body chassis 147) of the device body housing 101 via, for example, clips such as clips 152A, but the example embodiments are not limited thereto, and other equivalent attachment methods may be used.

Additionally, the mouthpiece chassis 155 may be moveably (e.g., slideably, etc.) attached to a stationary body chassis (e.g., body chassis 147) of the device body housing 101, but is not limited thereto. The mouthpiece chassis 155 may be moveably (e.g., slideably, etc.) attached to rails (e.g., slots 148) of the stationary body chassis using one or more pins 149A, such that the mouthpiece chassis 155 travels in a longitudinal direction along the interior of the device body housing 101. Further, the one or more pins 149A are also rotatably and/or slidingly attached and/or connected to at least one second linkage (e.g., second linkage 122) which provides a force to the mouthpiece chassis 155 via the pin 149A to move in the lateral direction within the slots 148 of the body chassis 147. The mouthpiece chassis 155, when viewed from the side, may be a substantially "L-shaped," with the vertical portion of the mouthpiece chassis 155 further defining an opening 155A configured to receive a chimney 161 of the mouthpiece 160. The horizontal portion of the mouthpiece chassis 155 may define a rear opening 155B which aligns with the rear opening 170B of the capsule receptacle 175 when the capsule receptacle 175 and the mouthpiece chassis 155 are in the closed position, thereby allowing sensors, such as the capsule detection switch 183, etc., to access a capsule 170 installed in the capsule receptacle 175, etc.

Additionally, the mouthpiece chassis 155 may include at least one bayonet enclosure 163 for receiving at least one bayonet connector 162 of the chimney 161, and locking the mouthpiece 160 to the mouthpiece chassis 155. For example, there may be two or more bayonet connectors and bayonet enclosures, but the example embodiments are not limited thereto. At least one compression spring 123 may be mounted on a U-shaped spring frame 123A, and the spring frame 123A may be attached to the proximal end piece 152 (e.g., via screws, welds, etc.), and/or the body chassis (e.g., body chassis 147), and may be disposed between the proximal end piece 152 and the mouthpiece chassis 155, but the example embodiments are not limited thereto. As shown in FIG. 4A, there may be two or compression springs 123 mounted on two or more arms of the spring frame 123A, but the example embodiments are not limited thereto. The compression springs 123 may be biased against the mouthpiece chassis 155 such that the mouthpiece chassis 155 compresses the compression spring 123 when traveling in the proximal longitudinal direction. Additionally, when the compression spring 123 is released, the compressed compression spring 123 applies a biasing force on the mouthpiece chassis 155 in the distal longitudinal direction thereby moving and/or assisting with the movement of the mouthpiece chassis 155 in the distal longitudinal direction. The movement of the mouthpiece chassis 155 will be discussed in greater detail in connection with FIGS. 5A to 5C and 6A to 6C.

The removable mouthpiece 160 may include an elongated chimney 161 defining at least one aerosol outlet 165, the at least one bayonet connector 162, and a sealing element 164, but is not limited thereto. The chimney 161 may be inserted through an opening 154 in the proximal end piece 152 and connected to (e.g., attached, fixed, etc.) to the mouthpiece chassis 155 using the bayonet connectors 162. As discussed above, the mouthpiece chassis 155 may move in a longitudinal direction a desired distance (e.g., towards the proximal and distal ends of the aerosol generating device, etc.) corresponding to the length of the slots 148 of the body chassis 147, etc. When the mouthpiece 160 is attached to the mouthpiece chassis 155 and the mouthpiece chassis 155 moves in either the proximal and distal longitudinal directions, the mouthpiece 160 will also move in the proximal and distal longitudinal directions with the mouthpiece chassis 155. Additionally, when the mouthpiece 160 is moved to the closed position, the mouthpiece engages a detent 167 disposed on a top exterior surface of the proximal end piece 152, as shown in FIG. 4D. Moreover, as shown in FIG. 4F, when the mouthpiece assembly 1200 and the door assembly 1100 are both moved to the closed position, the mouthpiece chassis 155 and the capsule receptacle 175 are arranged such that the mouthpiece chimney 161 and mouthpiece sealing element 164 sealingly aligns with the proximal end of the capsule 170, and the distal end of the capsule 170 sealingly aligns with the capsule connector sealing element 178 of the capsule connector 177, etc.

Figure 5A:
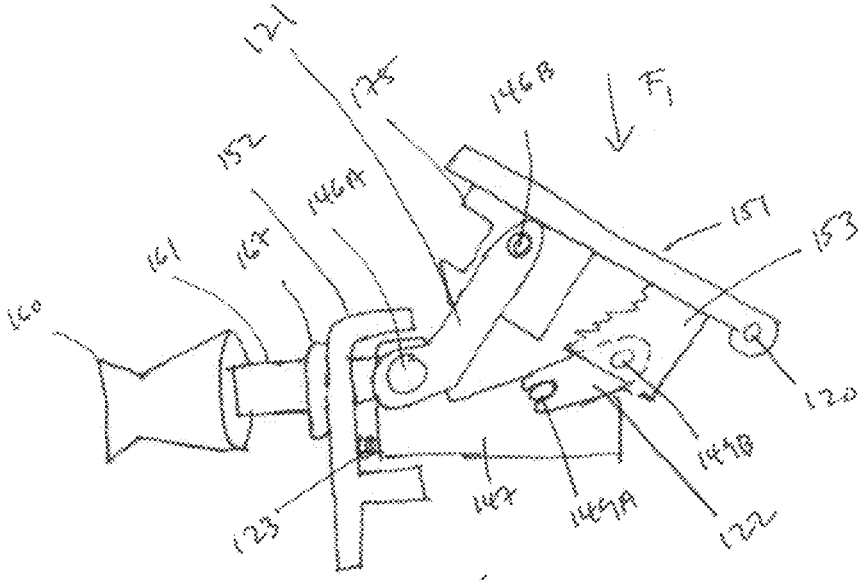
FIGS. 5A to 5C are diagrams illustrating the movement of the door assembly and the mouthpiece assembly when the door of the aerosol generating device is moved from an initial open state to a final closed state according to at least one example embodiment.
Figure 5B:
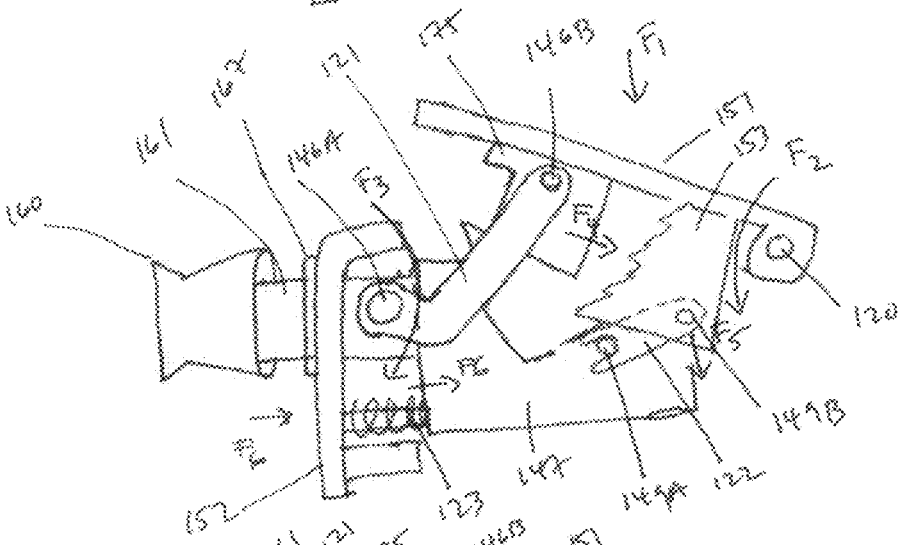
Figure 5C:
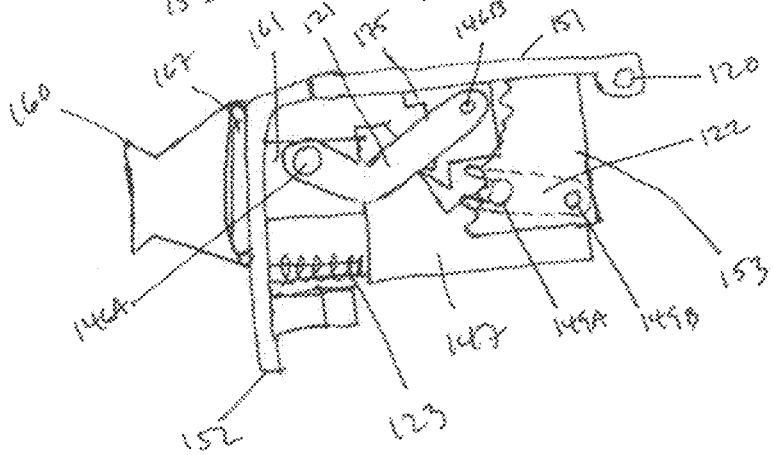

FIGS. 5A to 5C are diagrams illustrating the movement of the door assembly and the mouthpiece assembly when the door of the aerosol generating device is moved from an initial open state to a final closed state according to at least one example embodiment. More specifically, FIG. 5A illustrates the door assembly and the mouthpiece assembly in the initial open state; FIG. 5B illustrates the door assembly and the mouthpiece assembly in an intermediate state; and FIG. 5C illustrates the door assembly and the mouthpiece assembly in the final closed state. FIGS. 5A to 5C show a simplified version of the door assembly and the mouthpiece assembly, for example showing only a portion of the door chassis 153, mouthpiece 160, and the mouthpiece chassis 155, and omitting the body chassis 147, capsule 170, capsule connector 177, etc., to more clearly illustrate the operations of the various elements of the door assembly (e.g., door assembly 1100) and the mouthpiece assembly (e.g., mouthpiece assembly 1200), etc., according to at least one example embodiment.

According to at least one example embodiment, the door assembly 1100 (e.g., door 151, etc.) may be assumed to start in an initial open state, and an external downward force $F_1$ may be applied to the door 151 and/or door assembly 1100 by an adult operator to close the door 151. The force $F_1$ causes the door 151 to rotate (e.g., pivot, etc.) around the hinge point 120 in a downward direction $F_2$. The moveable capsule receptacle 175 is rotatably attached to at least one first linkage 121 at a pivot point 146B (e.g., pin, etc.). Additionally, the first linkage 121 is rotatably attached to the stationary body chassis 147 at a pivot point 146A. As shown in FIG. 5B, when the door 151 begins to rotate in the downward direction $F_2$, the first linkage 121 also rotates (e.g., pivots) in the downward direction $F_3$ around the pivot point 146A, thereby causing the moveable capsule receptacle 175 to move along direction $F_4$ to the distal end of the door 151/door chassis 153 and towards the capsule connector 177 (not shown in FIGS. 5A to 5C), thereby causing the connection and/or engagement of a capsule installed in the capsule receptacle 175 to the capsule connector 177.

Concurrently, the rotation of the door 151 in the downward direction (e.g., $F_2$) causes at least one second linkage 122, which is rotatably attached to a pivot point 149B of the door chassis 153, to move in the downward direction $F_5$. Due to the length of the second linkage 122, according to some example embodiments, the distal end of the second linkage 122 (e.g., the end attached to pivot point 149B which is attached to the mouthpiece chassis 155) may move to the same or lower height than the opposing end of the second linkage 122 (e.g., the end attached to pivot point 149A) when the door 151 is rotated towards the closed position. This causes the second linkage 122 to be released from an "over-center" position, thereby releasing the compressed spring 123. The released compressed spring 123 releases stored potential energy causing the compressed spring 123 to apply a biasing force and/or assisting force to push the moveable mouthpiece chassis 155 in the proximal direction along the slot 148 (not shown) of the body chassis 147, e.g., in direction $F_6$, and also pushing the connected mouthpiece 160 to a closed (e.g., attached, connected, etc.) position abutting the proximal end piece 152, thereby causing the mouthpiece 160 to engage and/or connect to a detent 167 disposed on the exterior of the proximal end piece 152.

Figure 6A:
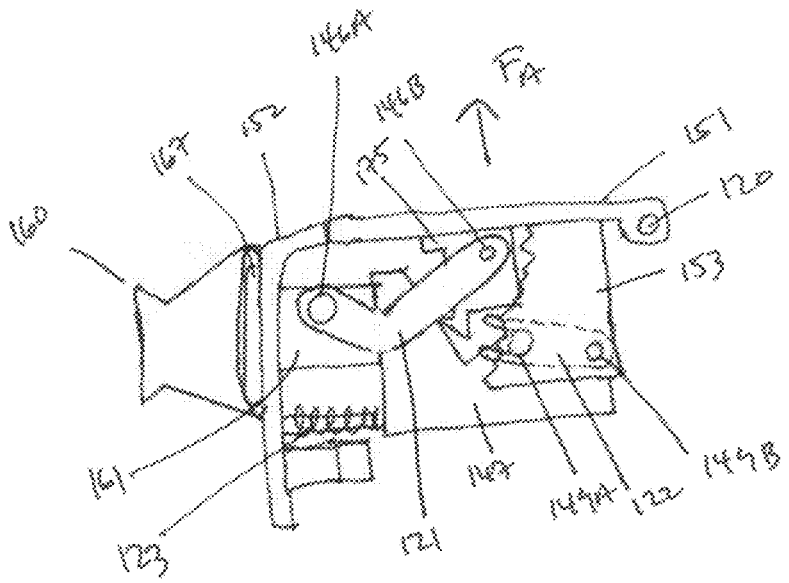
FIGS. 6A to 6C are diagrams illustrating the movement of the door assembly and the mouthpiece assembly when the door of the aerosol generating device is moved from an initial closed state to a final open state according to at least one example embodiment.
Figure 6B:
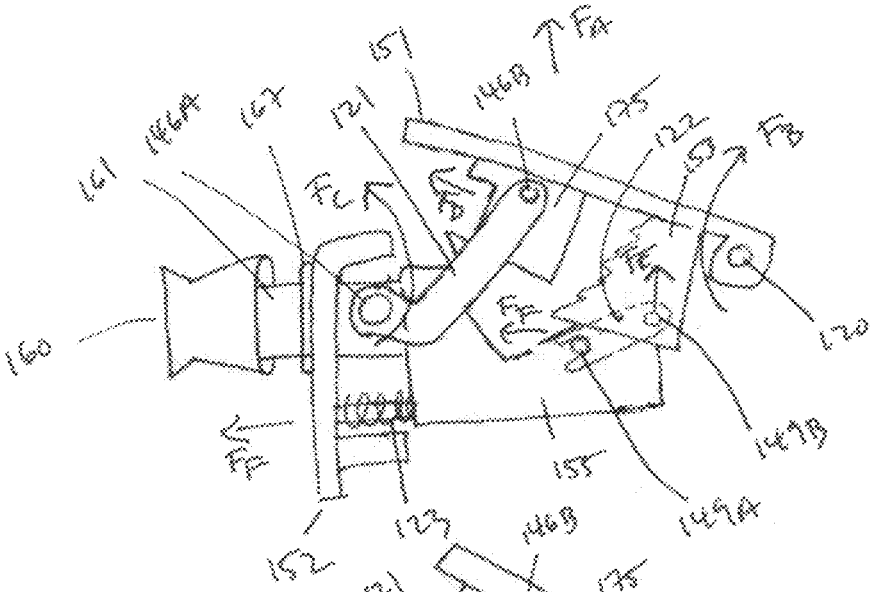
Figure 6C:
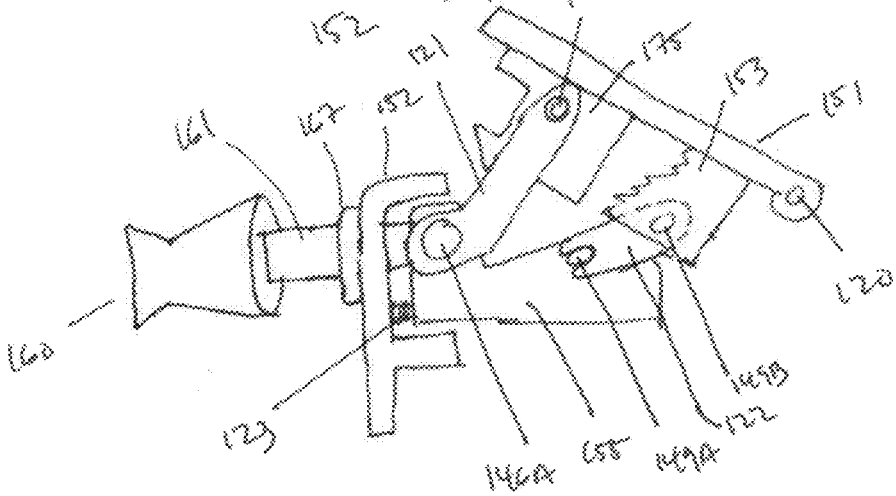

FIGS. 6A to 6C are diagrams illustrating the movement of the door assembly and the mouthpiece assembly when the door of the aerosol generating device is moved from an initial closed state to a final open state according to at least one example embodiment. More specifically, FIG. 6A illustrates the door assembly and the mouthpiece assembly in the initial closed state; FIG. 6B illustrates the door assembly and the mouthpiece assembly in an intermediate state; and FIG. 6C illustrates the door assembly and the mouthpiece assembly in the final open state. Similar to FIGS. 5A to 5C, FIGS. 6A to 6C show a simplified version of the door assembly and the mouthpiece assembly, for example showing only a portion of the door chassis 153, mouthpiece 160, and the mouthpiece chassis 155, and omitting the body chassis 147, capsule 170, capsule connector 177, etc., to more clearly illustrate the operations of the various elements of the door assembly (e.g., door assembly 1100) and the mouthpiece assembly (e.g., mouthpiece assembly 1200), etc., according to at least one example embodiment.

According to at least one example embodiment, the door assembly 1100 (e.g., door 151, etc.) may start in an initial closed state, and an adult operator may apply an external upward (e.g., lifting) force $F_A$ on the door assembly 1100/door 151. The upward force $F_A$ causes the door assembly 1100/door 151 to rotate in the upwards direction $F_B$ around the pivot point (e.g., hinge) 120. The upwards rotation $F_B$ causes the at least one first linkage 121 to rotate in the upwards direction Fc around pivot point 146A. The combination of the rotation $F_B$ and the upwards direction Fc causes the moveable capsule receptacle 175 to start to move to a proximal end of the door 151 and door chassis 153 due to the attachment of the first linkage 121 to the capsule receptacle 175, thereby disengaging a capsule 170 (not shown) installed in the capsule receptacle 175 from the capsule connector 177 (not shown).

Concurrently, the upwards force $F_A$ and rotation movement $F_B$ of the door assembly 1100/door 151 causes the door chassis 153 to rotate in the upwards direction $F_E$. The upwards movement $F_E$ causes the distal end of the second linkage 122 to move in the upwards direction as well, due to the connection at pivot point 149B to the door chassis 153. This in turn causes the opposing end of the second linkage 122 to move in a lateral longitudinal direction $F_F$ along the slots 148 of the body chassis 147 towards the proximal end of the aerosol generating device 100, which causes the mouthpiece chassis 155 to move in the lateral longitudinal direction $F_F$ and compress the spring 123. Additionally, the lateral longitudinal movement $F_F$, also causes the mouthpiece 160 connected to the mouthpiece chassis 155 to disengage from the detent 167 and move in the $F_F$ direction to the extended and/or open position as shown in FIG. 6C. Additionally, the second linkage 122 acts as an over-center mechanism and the second linkage 122 and the door assembly 1100 are held in the stopped position (e.g., the open position) when the door assembly 1100 and the mouthpiece assembly 1200 are in the open position, as shown in FIG. 6C.

Figure 7A:
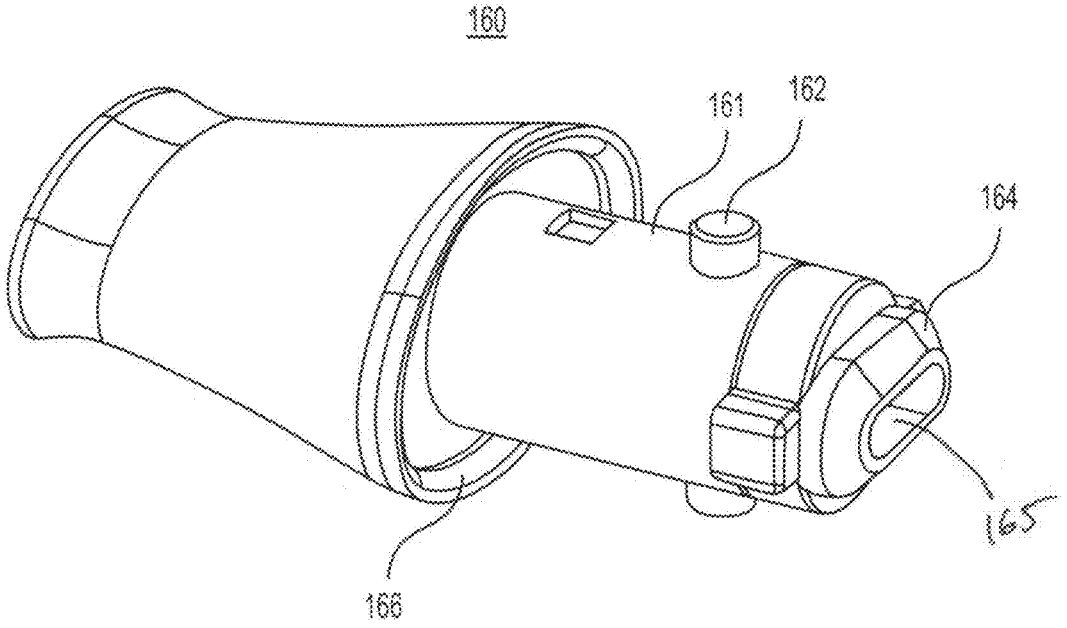
FIGS. 7A to 7F illustrate views of various mouthpieces according to some example embodiments.
Figure 7B:
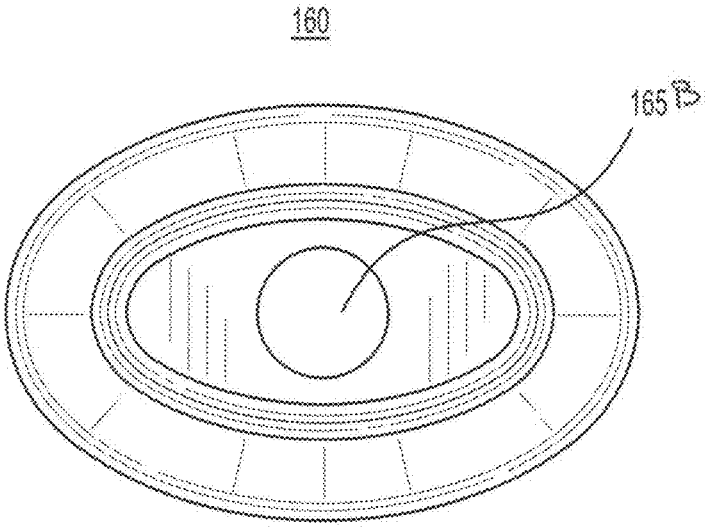
Figure 7D:
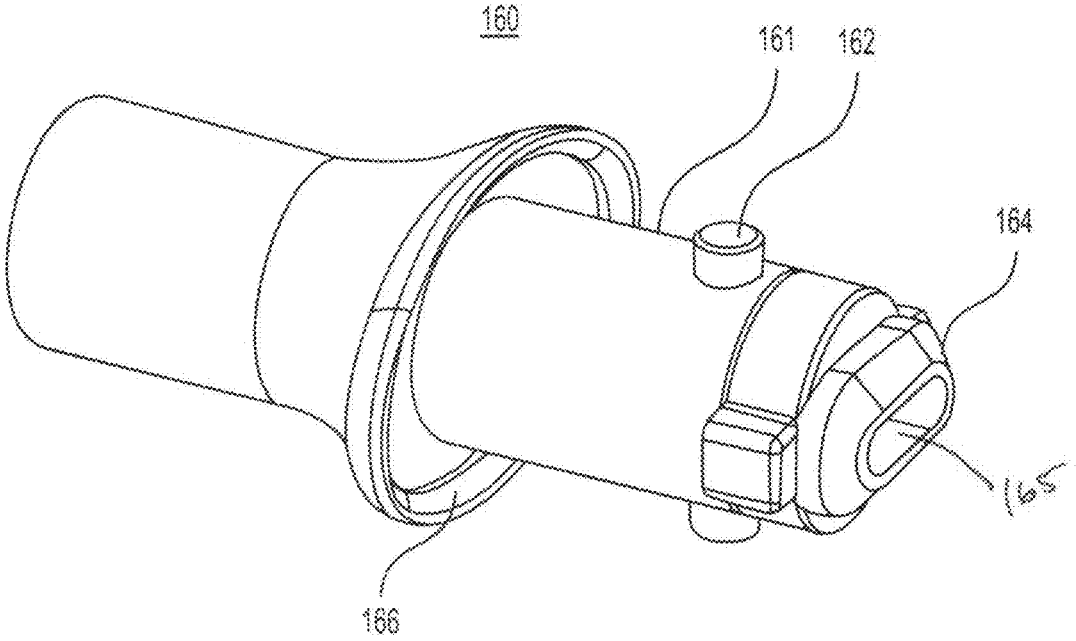
Figure 7C:
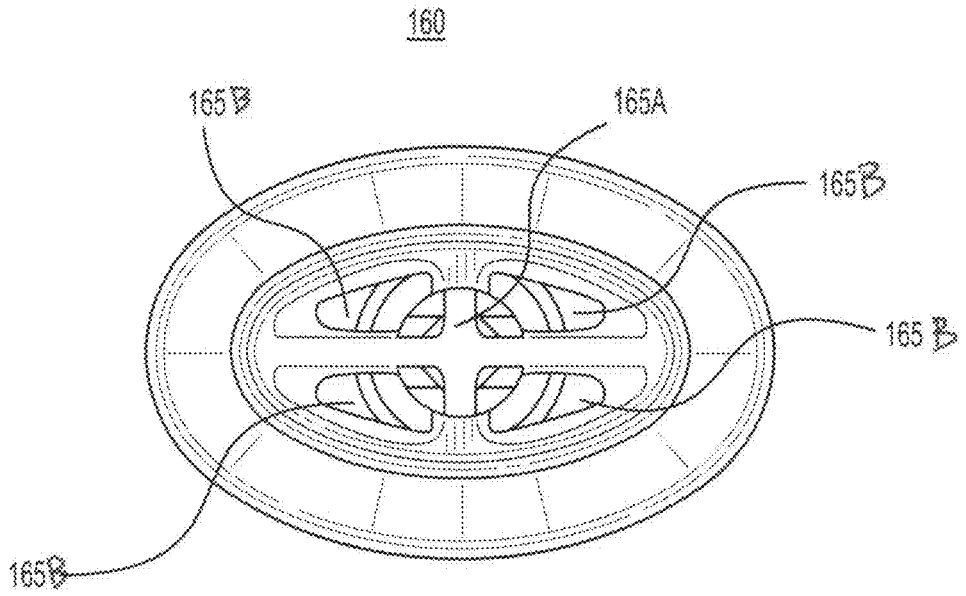
Figure 7E:
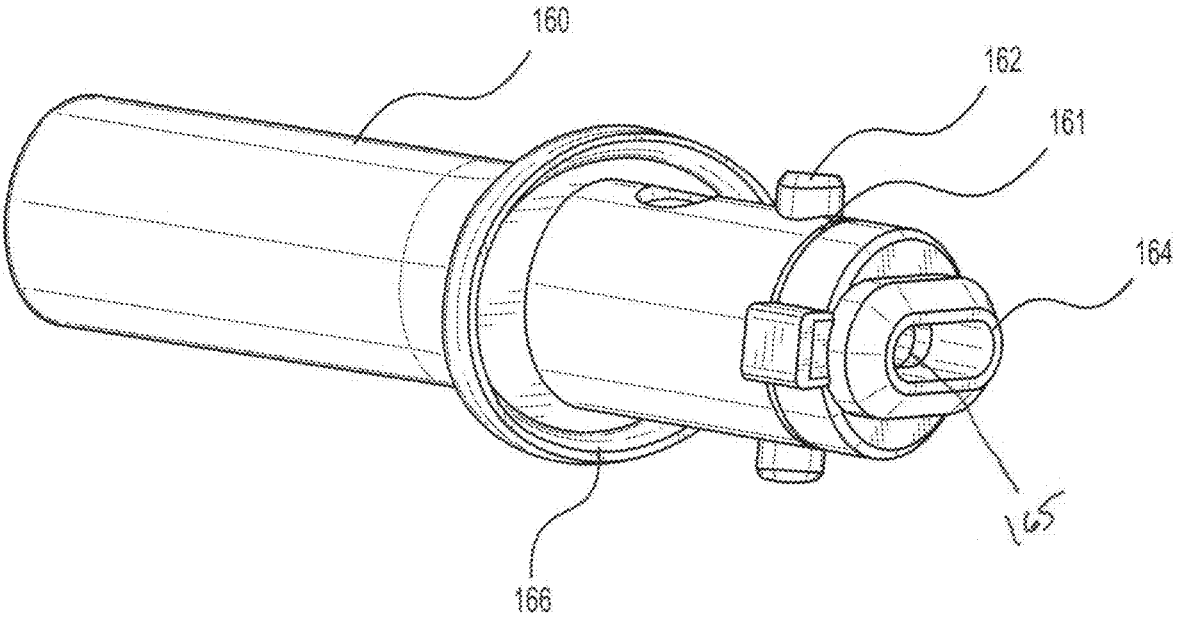
Figure 7F:
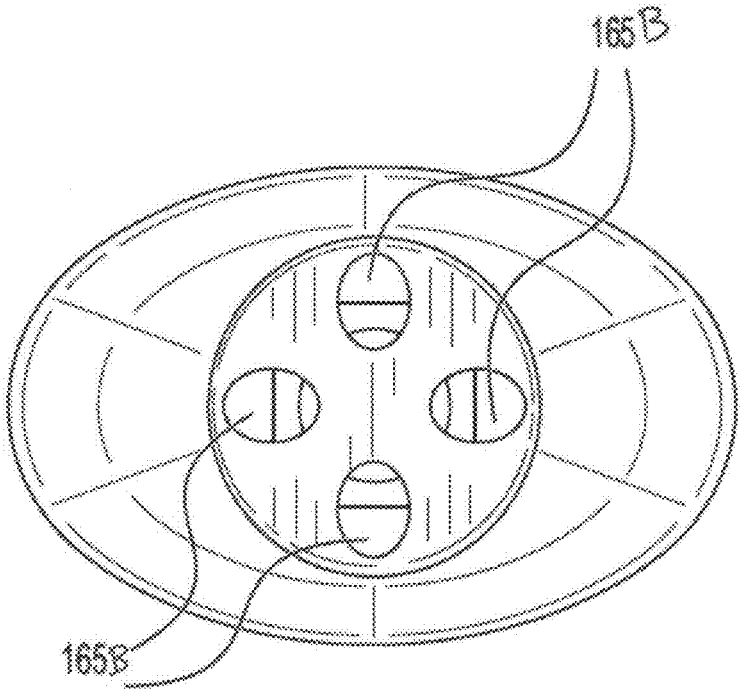

FIGS. 7A to 7F illustrate views of various mouthpieces according to some example embodiments. FIG. 7A illustrates a rear-front perspective view of a first set of mouthpiece designs according to at least one example embodiment; FIG. 7B illustrates a top view of a first design of the first set of mouthpieces of FIG. 7A; FIG. 7C illustrates a top view of a second design of the first set of mouthpieces of FIG. 7A; FIG. 7D illustrates a first rear-front perspective view of a second set of mouthpiece designs according to at least one example embodiment; FIG. 7E illustrates a second rear-front perspective view of the second set of mouthpiece designs according to at least one example embodiment; and FIG. 7F illustrates a top view of the second set of mouthpieces of FIGS. 7D and 7E.

According to at least one example embodiment, a chimney 161 of a mouthpiece 160 may further include a bayonet connector 162 (e.g., male fitment) to connect with and/or attach to a bayonet enclosure 163 (e.g., female fitment) of the mouthpiece chassis 155 and/or the body chassis 147 to allow for the removal of the mouthpiece 160 and/or replacement of the mouthpiece 160. For example, the chimney 161 is inserted into the mouthpiece opening at the proximal end of the device body housing 101 and rotated to lock the bayonet connector 162 into the bayonet enclosure 163. However, the example embodiments are not limited thereto, and for example, the mouthpiece 160 may be attached using, without limitation, a snug-fit, detent, clamp, threaded connector, sliding fit, sleeve fit, alignment fit, threaded connector, magnetic, clasp, or any other type of connection, and/or combinations thereof. Additionally, haptic feedback may be provided in response to the bayonet connector 162 being locked into and/or unlocked from the bayonet enclosure 163, such as a sound (e.g., a click, etc.), a vibration, etc., thereby notifying an adult operator that the mouthpiece 160 has been properly installed and/or uninstalled from the mouthpiece chassis 155. Moreover, because the mouthpiece 160 is removable from the device body housing 101, an adult operator may clean the mouthpiece 160 and the chimney 161, as well as allowing the adult operator to replace the mouthpiece 160 when desired, and/or use different mouthpiece designs and/or configurations with the device body housing 101.

The distal end of the chimney 161 further includes an integrated sealing element 164 and/or integrated sealing adapter configured to form a sealed connection with outlets included in the proximal end of the capsule 170 to facilitate the passage of generated aerosol from the capsule 170 to at least one aerosol outlet of the mouthpiece 160. The integrated sealing element 164 may be formed from silicone, other food grade rubber, and/or equivalent materials, but the example embodiments are not limited thereto. For example, the integrated sealing element 164 may be formed using any material which is resistant to high temperatures (e.g., >80° C., etc.), is rated for food contact, and is capable of forming an air seal between the chimney 161 and the capsule 170, etc., but the example embodiments are not limited thereto.

FIGS. 7A to 7C illustrate a first set of example mouthpieces according to at least one example embodiment. As shown in FIGS. 7A to 7B, a proximal end of the mouthpiece 160 has a prismatic shape with an oval-shaped proximal end of the mouthpiece 160 having a smaller width than an oval-shaped distal end of the of the mouthpiece 160, and the proximal end having a single aerosol outlet 165B, but the example embodiments are not limited thereto. Additionally, as shown in FIG. 7C, the prismatic-shaped mouthpiece 160 of FIG. 7A may have a differently shaped proximal end, wherein the mouthpiece 160 has a plurality (e.g., four) of aerosol outlets 165B defined by a cross-shaped diffuser element 165A. However, the example embodiments are not limited thereto, and there may be a different number of aerosol outlets 165 and the diffuser element 165A may have different shapes and/or designs.

As a second set of example mouthpieces according to other example embodiments, FIGS. 7D to 7F illustrate an alternate mouthpiece 160 which has a cylindrical shape, wherein the proximal end is generally a circular shape with a cylindrical body before a wider width oval-shaped distal end. Additionally, as shown in FIG. 7F, the proximal end of the mouthpiece 160 has a plurality of aerosol outlets 165, but is not limited thereto, and for example, may have a greater or lesser number of aerosol outlets 165. Moreover, as shown in FIGS. 7A and 7D to 7E, the distal end may further include a rim 166 which contacts the proximal end piece 152 of the device body housing 101. When the rim 166 of the mouthpiece 160 is securely fastened and/or pushed over a detent 167 included on a surface of the proximal end piece 152 of the device body housing 101, e.g., when the door 151 is properly closed and the mouthpiece 160 is in the retracted position, the rim 166 provides haptic feedback indicating that the mouthpiece 160 has been properly retracted, such as a clicking, popping and/or snapping sound, etc. Additionally, when the mouthpiece 160 is pushed away from the proximal end piece 152 while the door 151 is being opened, haptic feedback (e.g., a click, a pop, a snap, etc.) is provided again by the separation of the rim 166 from the detent 167 of the proximal end piece 152, to indicate that the mouthpiece 160 is separated from the device body housing 101.

As shown in FIGS. 7D to 7E, the length of the cylindrical mouthpiece 160 may be different desired lengths, but the example embodiments are not limited thereto.

Figure 8A:
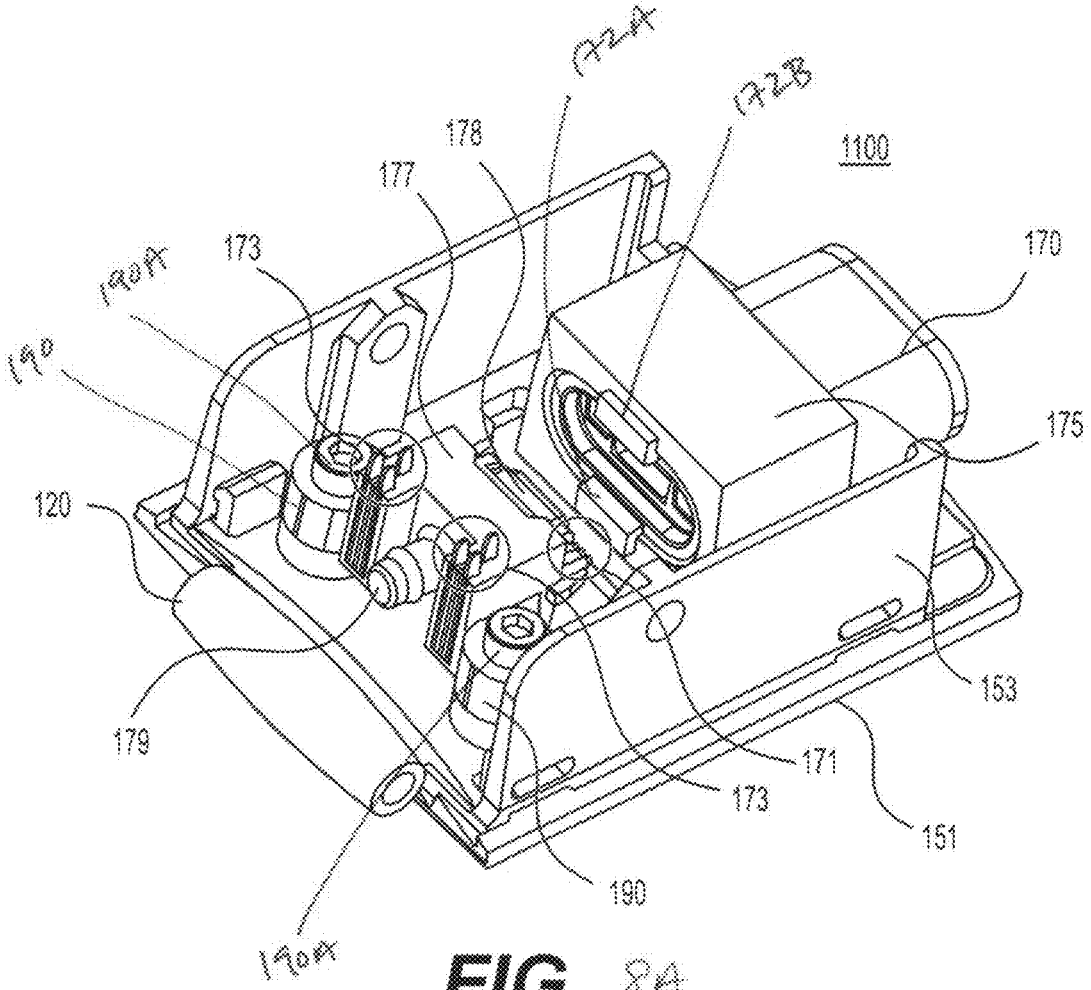
Figure 8B:
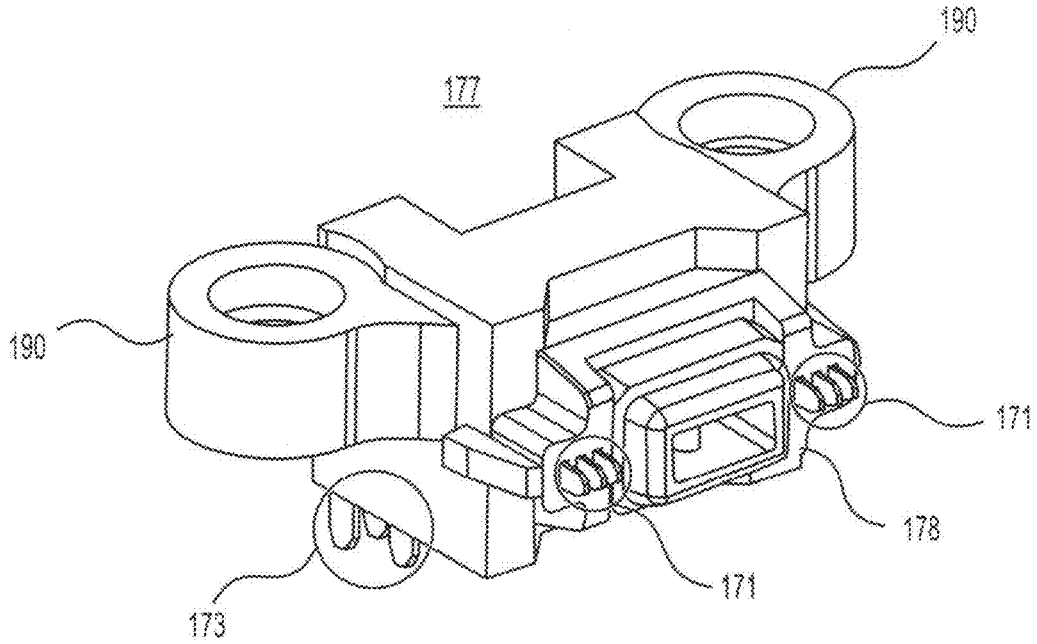

FIGS. 8A to 8E illustrate various views of the door assembly, capsule receptacle, and capsule connector according to some example embodiments. FIG. 8A illustrates a reverse view of a door assembly according to at least one example embodiment. FIG. 8B illustrates a top-front perspective view of the capsule connector of FIG. 8A. FIG. 8C illustrates a bottom-front perspective view of the capsule connector of FIG. 8A. FIGS. 8D and 8E illustrate a first and second example of the electrical contact structure of the capsule connector according to some example embodiments.

According to at least one example embodiment, the door chassis 153 also includes a capsule connector 177 at a distal section of the door chassis 153, or in other words, an opposing end of the door chassis 153 away from the capsule receptacle 175. When the door 151 (e.g., door assembly 1100) is moved to the closed position, the capsule receptacle 175 is moved such that the capsule connector 177 is inserted into the distal opening of the capsule receptacle 175 and a connection and/or seal is formed between the capsule 170 and the capsule connector 177. More specifically, the capsule connector 177 includes at least one capsule connector sealing element 178, at least one capsule connector air inlet 179, at least one vertical electrical contact 173, and at least one horizontal electrical contact 171, etc. The capsule connector 177 is fixedly mounted and/or otherwise attached to the rear side (e.g., interior side) of the door chassis 153, using for example, bosses 190 mated to bosses 190A of the door chassis 153, but the example embodiments are not limited thereto. For example, the capsule connector 177 may be secured to the door chassis 153 screws, welds, etc., but is not limited thereto. When the door 151 is moved to the open position, the capsule receptacle 175 is moved by the door assembly such that the connection and/or seal between the capsule connector 177 and the capsule 170 is severed.

According to at least one example embodiment, at least one capsule connector sealing element 178 is a silicone sealing element and/or other compressible sealing material disposed on a proximal face of the capsule connector 177 which defines an air channel between the capsule connector air inlet 179 and one or more capsule air inlets disposed on the distal end of the capsule 170. The capsule connector 177 may also include at least one horizontal electrical contact 171. The capsule connector sealing element 178 further includes angled and flat surfaces which guide and mate with the recess 221 of the capsule 170, thereby forming a seal for the fluidic communication of air between the capsule connector 177 and the capsule 170.

For example, as shown in FIG. 8B, there are a plurality of horizontal electrical contacts 171 on the proximal face of the capsule connector 177, with a first set of horizontal electrical contacts on a first side of the capsule connector sealing element 178, and a second set of horizontal electrical contacts on a second side of the capsule connector sealing element 178, but the example embodiments are not limited thereto and the horizontal electrical contacts may be arranged in other patterns and/or locations. When the door 151 is in the closed position, the horizontal electrical contacts 171 come into contact with electrical contacts of the capsule 170, thereby establishing an electrical connection between the capsule connector 177 and the capsule 170, and more specifically, establishing an electrical circuit between the at least one heater 230 of the capsule 170 and the battery 182, etc. According to at least one example, the horizontal electrical contacts 171 and/or the capsule connector sealing element 178 extend past the proximal face of the capsule connector 177, and consequently when the capsule 170 is moved to the closed position, the horizontal electrical contacts 171 and/or the capsule connector sealing element 178 become compressed, ensuring an improved electrical and/or fluidic connection between the capsule connector 177 and the capsule 170.

As shown in FIGS. 2E and 8B, the capsule connector 177 may also include at least one vertical electrical contact 173. As shown in FIG. 8B, the at least one vertical electrical contact 173 may be a plurality of vertical electrical contacts 173 which extend downward from the capsule connector 177. According to at least one example embodiment, the vertical electrical contacts 173 may be permanently electrically connected (e.g., soldered, etc.) to the electrical wiring 184, integrated with the electrical wiring 184, and/or may be a continuation of the electrical wiring 184, but the example embodiments are not limited thereto.

According to another example embodiment, as shown in FIG. 2B, the vertical electrical contacts 173 are not permanently electrically connected to the electrical wiring 184. Instead, when the door 151 is in the closed position, the vertical electrical contacts 173 come into contact with the electrical wiring 184 of the device body housing 101, thereby establishing an electrical connection between the capsule connector 177 and the electrical subsystem of the aerosol generating device 100.

In both example embodiments, the electrical wiring 184 may provide power (e.g., current) from the rechargeable battery 182 to the capsule connector 177 when the vertical electrical contacts 173 are connected to the electrical wiring 184, and the capsule connector 177 may then provide the power to the capsule 170 via the horizontal electrical contacts 171. When the door 151 is in the open position (and/or when the door 151 is not in the closed position), the capsule connector 177 is moved away from its closed position, thereby severing the connection between both the horizontal electrical contacts 171 and the capsule 170, and the vertical electrical contacts 173 and the electrical wiring 184.

While some Figures, such as FIG. 2B, illustrate the electrical wiring 184 to be a plurality of coils, the example embodiments are not limited thereto and the electrical wiring may be arranged in any manner. According to at least one example embodiment, the electrical wiring 184 includes at least one coil, a flexible wiring, etc. For example, two or more coils of the electrical wiring 184 may be spaced a desired distance apart (e.g., the width of a vertical electrical contact 173) and positioned such that two or more the coils of the electrical wiring 184 contact both sides of one or more of the vertical electrical contacts 173, or in other words provide multiple points of contact with one or more of the vertical electrical contacts 173, in order to ensure a secure electrical connection between the electrical wiring 184 and the vertical electrical contacts 173, and also reduce the possibility of the vertical electrical contacts 173 being dislodged from contact with the electrical wiring 184 due to vibration, shock, jostling, etc., of the aerosol generating device 100.

Referring now to FIGS. 8D and 8E, FIG. 8D illustrates a first design for the electrical contacts of the capsule connector 177 with a linear vertical contact 173, and FIG. 8E illustrates a second design for the electrical contacts of the capsule connector 177 with an offset vertical contact 173, according to some example embodiments. As shown in FIGS. 8D and 8E, the horizontal electrical contacts 171 and the vertical electrical contacts 173 are integrated into a single electrical wiring structure, however the example embodiments are not limited thereto, and other designs, configurations, and/or arrangements for the horizontal electrical contacts 171 and the vertical electrical contacts 173 may be used. As shown in both FIGS. 8D and 8E, the horizontal electrical contacts 171 may include a first straight portion 171 and a second spring-like and/or serpentine portion 171A. In response to the capsule receptacle 175 being moved to the closed position and being connected to the capsule connector 177, the first portion 171 of the horizontal electrical contact comes into contact with opposing electrical contacts on the distal end of the capsule 170. In addition, the second portion 171A of the horizontal electrical contact allows the horizontal electrical contact 171 to become compressed, thereby improving the electrical connection between the horizontal electrical contact 171 and the opposing electrical contact of the capsule 170, as well as reducing the possibility that the electrical connection becomes severed due to vibrations, bumps, shocks, etc., suffered by the aerosol generating device 100.

Referring now to FIG. 8C, the capsule connector air inlet 179 is configured to connect to, mate with, attach to, etc., at least one air hose 116 of the device body housing 101 when the door 151 is in the closed position. The at least one connector air inlet 179 receives external air from the body housing air inlet 113 via the air hose 116 upon a draw event and/or the application of negative pressure at the mouthpiece 160 when the door 151 is in the closed position and the external air flows to the air inlets of the capsule 170. When the door 151 is in the open position, the connection between the air hose 116 and the connector air inlet 179 is severed, and therefore air is not provided to the capsule 170.

Figure 9A:
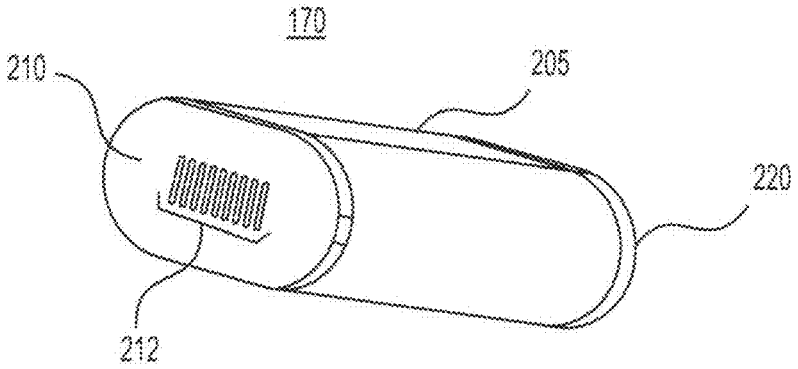
FIGS. 9A to 9C illustrate a capsule according to at least one example embodiment.
Figure 9B:
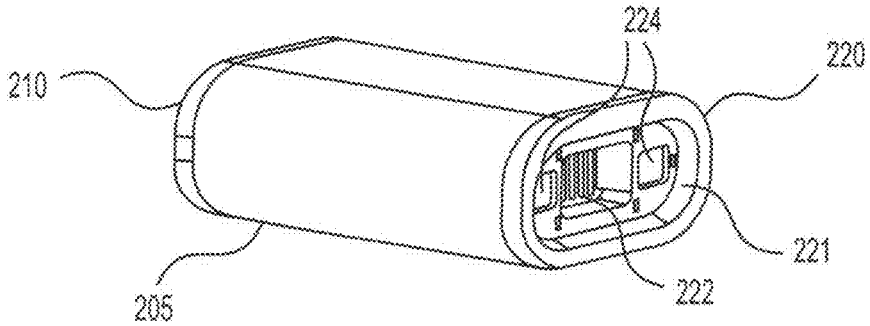
Figure 9C:
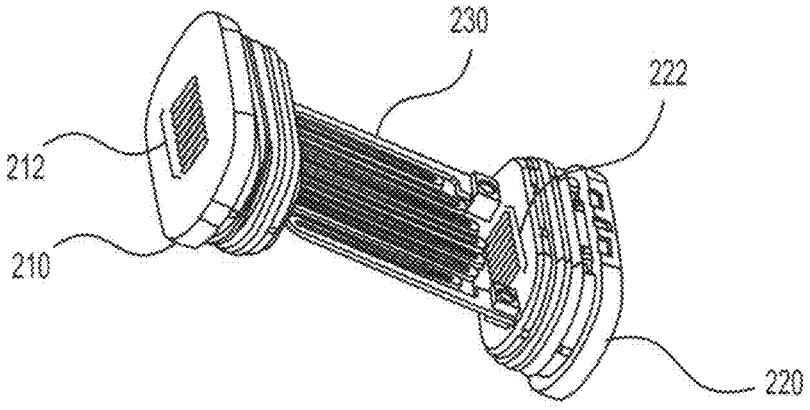

FIGS. 9A to 9C illustrate a capsule according to at least one example embodiment. More specifically, FIG. 9A illustrates a top-front perspective view of the capsule according to some example embodiments; FIG. 9B illustrates a bottom-front perspective view of the capsule; and FIG. 9C illustrates a heater of the capsule, according to some example embodiments.

As shown in FIG. 9A, the exterior of the capsule 170 includes a proximal end cap 210, a distal end cap 220, and/or an exterior shell 205, etc., but is not limited thereto. The capsule 170 may include a housing 205 and a heater 230 (e.g., FIG. 4C) within the housing 205. The housing 205 of the capsule 170 has interior surfaces defining at least one chamber configured to hold an aerosol-forming substrate. The proximal end cap 210 (e.g., a first face and/or a first end) and the distal end cap 220 (e.g., a second face and/or a second end) of the capsule 170 may be permeable to an aerosol. For example, the proximal end cap 210 may also include at least one aerosol outlet 212 to facilitate the flow of an aerosol from at least one chamber of the housing 205 to the chimney 161, and the distal end cap 220 may include at least one capsule air inlet 222 to facilitate the flow of air into the at least one chamber of the housing 205 from the air hose 116. Additionally, the distal end cap may define a recess 221 (e.g., an alignment recess) which may further include electrical contacts (e.g., electrodes) 224 and the at least one air inlet 222, but is not limited thereto. The recess 221 may be an alignment recess which forms a seal and/or connection (e.g., mates) with the angled and flat alignment features 178 of a proximal end of a capsule connector 177, such that the capsule 170 and the capsule connector 177 form a proper electrical connection and a sealed fluidic connection.

Although the capsule 170 is shown in the figures as resembling a rectangle with curved sides and/or oval shaped ends (e.g., obround cross-section), it should be understood that other configurations may be employed. For example, in some instances, the capsule 170 may have an ovoid or ellipsoid shape with an oval or elliptical cross-section. In other instances, the capsule 170 may have a cuboid-like shape (e.g., rounded rectangular cuboid) with a rectangular cross-section. The chamber defined within the capsule 170 may have the same or a different shape as the exterior of the capsule 170. For instance, the cross-sections of the chamber and the exterior of the capsule 170 may both be obround. In another instance, the cross-section of the chamber may be non-obround (e.g., rectangular), while the cross-section of the exterior of the capsule 170 may be obround (or vice versa).

As discussed herein, an aerosol-forming substrate is a material or combination of materials that may yield an aerosol. An aerosol relates to the matter generated or output by the devices disclosed, claimed, and equivalents thereof. The material may include a compound (e.g., nicotine, cannabinoid), wherein an aerosol including the compound is produced when the material is heated. The heating may be below the combustion temperature so as to produce an aerosol without involving a substantial pyrolysis of the aerosol-forming substrate or the substantial generation of combustion byproducts (if any). Thus, in an example embodiment, pyrolysis does not occur during the heating and resulting production of aerosol. In other instances, there may be some pyrolysis and combustion byproducts, but the extent may be considered relatively minor and/or merely incidental.

The aerosol-forming substrate may be a fibrous material. For instance, the fibrous material may be a botanical material. The fibrous material is configured to release a compound when heated. The compound may be a naturally occurring constituent of the fibrous material. For instance, the fibrous material may be plant material such as tobacco, and the compound released may be nicotine. The term "tobacco" includes any tobacco plant material including tobacco leaf, tobacco plug, reconstituted tobacco, compressed tobacco, shaped tobacco, or powder tobacco, and combinations thereof from one or more species of tobacco plants, such as *Nicotiana rustica* and *Nicotiana tabacum*.

In some example embodiments, the tobacco material may include material from any member of the genus *Nicotiana*. In addition, the tobacco material may include a blend of two or more different tobacco varieties. Examples of suitable types of tobacco materials that may be used include, but are not limited to, flue-cured tobacco, Burley tobacco, Dark tobacco, Maryland tobacco, Oriental tobacco, rare tobacco, specialty tobacco, blends thereof, and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. In some example embodiments, the tobacco material is in the form of a substantially dry tobacco mass. Furthermore, in some instances, the tobacco material may be mixed and/or combined with at least one of propylene glycol, glycerin, sub-combinations thereof, or combinations thereof.

The compound may also be a naturally occurring constituent of a medicinal plant that has a medically-accepted therapeutic effect. For instance, the medicinal plant may be a cannabis plant, and the compound may be a cannabinoid. Cannabinoids interact with receptors in the body to produce a wide range of effects. As a result, cannabinoids have been used for a variety of medicinal purposes (e.g., treatment of pain, nausea, epilepsy, psychiatric disorders). The fibrous material may include the leaf and/or flower material from one or more species of cannabis plants such as *Cannabis sativa, Cannabis indica*, and *Cannabis ruderalis*. In some instances, the fibrous material is a mixture of 60-80% (e.g., 70%) *Cannabis sativa* and 20-40% (e.g., 30%) *Cannabis indica*.

Examples of cannabinoids include tetrahydrocannabinolic acid (THCA), tetrahydrocannabinol (THC), cannabidiolic acid (CBDA), cannabidiol (CBD), cannabinol (CBN), cannabicyclol (CBL), cannabichromene (CBC), and cannabigerol (CBG). Tetrahydrocannabinolic acid (THCA) is a precursor of tetrahydrocannabinol (THC), while cannabidiolic acid (CBDA) is precursor of cannabidiol (CBD). Tetrahydrocannabinolic acid (THCA) and cannabidiolic acid (CBDA) may be converted to tetrahydrocannabinol (THC) and cannabidiol (CBD), respectively, via heating. In an example embodiment, heat from a heater may cause decarboxylation so as to convert the tetrahydrocannabinolic acid (THCA) in the capsule 170 to tetrahydrocannabinol (THC), and/or to convert the cannabidiolic acid (CBDA) in the capsule 170 to cannabidiol (CBD).

In instances where both tetrahydrocannabinolic acid (THCA) and tetrahydrocannabinol (THC) are present in the capsule 170, the decarboxylation and resulting conversion will cause a decrease in tetrahydrocannabinolic acid (THCA) and an increase in tetrahydrocannabinol (THC). At least 50% (e.g., at least 87%) of the tetrahydrocannabinolic acid (THCA) may be converted to tetrahydrocannabinol (THC) during the heating of the capsule 170. Similarly, in instances where both cannabidiolic acid (CBDA) and cannabidiol (CBD) are present in the capsule 170, the decarboxylation and resulting conversion will cause a decrease in cannabidiolic acid (CBDA) and an increase in cannabidiol (CBD). At least 50% (e.g., at least 87%) of the cannabidiolic acid (CBDA) may be converted to cannabidiol (CBD) during the heating of the capsule 170.

Furthermore, the compound may be or may additionally include a non-naturally occurring additive that is subsequently introduced into the fibrous material. In one instance, the fibrous material may include at least one of cotton, polyethylene, polyester, rayon, combinations thereof, or the like (e.g., in a form of a gauze). In another instance, the fibrous material may be a cellulose material (e.g., non-tobacco and/or non-cannabis material). In either instance, the compound introduced may include nicotine, cannabinoids, and/or flavorants. The flavorants may be from natural sources, such as plant extracts (e.g., tobacco extract, cannabis extract), and/or artificial sources. In yet another instance, when the fibrous material includes tobacco and/or cannabis, the compound may be or may additionally include one or more flavorants (e.g., menthol, mint, vanilla). Thus, the compound within the aerosol-forming substrate may include naturally occurring constituents and/or non-naturally occurring additives. In this regard, it should be understood that existing levels of the naturally occurring constituents of the aerosol-forming substrate may be increased through supplementation. For example, the existing levels of nicotine in a quantity of tobacco may be increased through supplementation with an extract containing nicotine. Similarly, the existing levels of one or more cannabinoids in a quantity of cannabis may be increased through supplementation with an extract containing such cannabinoids.

Referring now to FIGS. 9B and 9C, in at least one example embodiment, the at least one heater 230 is configured to undergo Joule heating (which is also known as ohmic/resistive heating) upon the application of an electric current thereto. Stated in more detail, the heater 230 may be formed of one or more conductors and configured to produce heat when an electric current passes therethrough. The electric current may be supplied to the heater 230 from a power source (e.g., battery) 182 within the aerosol generating device 100. Suitable conductors for the heater 230 include an iron-based alloy (e.g., stainless steel) and/or a nickel-based alloy (e.g., nichrome), but the example embodiments are not limited thereto. The heater 230 may have a thickness of about 0.1-0.3 mm (e.g., 0.15-0.25 mm) and a resistance of about 0.5-2.5 Ohms (e.g., 1.0-2.0 Ohms), but is not limited thereto.

The electric current from the power source 182 within the aerosol-generating device may be transmitted from the horizontal electrical contacts 171 of the capsule connector 177 via electrodes 224 of the distal end cap 220 configured to electrically contact the heater 230. In a non-limiting embodiment, the electrodes 224 may be spring-loaded to enhance an engagement with the heater 230 of the capsule 170. Also, the movement (e.g., engagement, release) of the electrodes may be achieved by mechanical actuation. Furthermore, the supply of the electric current from the aerosol-generating device 100 to the capsule 170 may be a manual operation (e.g., button-activated using button 106, etc.) or an automatic operation (e.g., puff-activated).

Additional details and/or alternatives for the aerosol-generating device, the capsule, and/or the aerosol-forming substrate may be found in U.S. application Ser. No. 17/151,277, titled "Capsules Including Embedded Heaters And Heat-Not-Burn (HNB) Aerosol-Generating Devices", filed concurrently herewith; U.S. application Ser. No. 29/766,691, titled "Aerosol-Generating Capsules", filed concurrently herewith; U.S. application Ser. No. 17/151,327, titled "Heat-Not-Burn (HNB) Aerosol-Generating Devices and Capsules", filed concurrently herewith; U.S. application Ser. No. 17/151,375, titled "Heat-Not-Burn (HNB) Aerosol-Generating Devices Including Energy Based Heater Control, And Methods of Controlling A Heater", filed concurrently herewith; and U.S. application Ser. No. 17/151,409, titled "Heat-Not-Burn (HNB) Aerosol-Generating Devices Including Intra-Draw Heater Control, And Methods of Controlling A Heater" (Atty. Dkt. No. 24000NV-000670-US), filed concurrently herewith; the entire contents of each of which are incorporated herein by reference.

Figure 10:
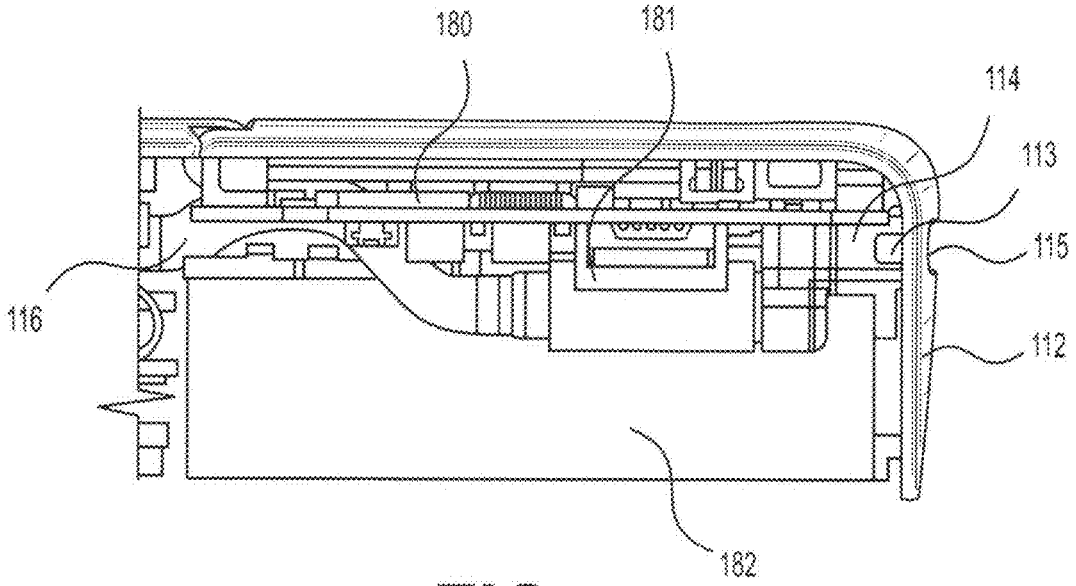
FIG. 10 illustrates the internal construction of the first section of the aerosol generating device according to at least one example embodiment.

FIG. 10 illustrates the internal construction of the first section of an aerosol generating device according to at least one example embodiment.

As shown in FIG. 10, the first section 105 includes at least one connector port 114, at least one body housing air inlet 113, at least one air hose 116, at least one flow sensor 181 (e.g., air flow sensor, etc.), a control subsystem 180, and/or at least one power source 182, but the example embodiments are not limited thereto. When connected to an external power source, the connector port 114 provides power to the electrical circuitry of the aerosol generating device 100 and/or recharges the battery 182. Additionally, the air inlets 113 supply external air to at least one air hose 116. The air hose 116 may also be connected to a flow sensor 181, the flow sensor 181 (e.g., a puff-sensor, etc.) configured to detect the application of negative air pressure (e.g., a puff, etc.) and/or the flowing of air within the air hose 116 and provide a control signal to the control subsystem 180 (e.g., processing circuitry, control circuitry, a controller, a processor, etc.). In response to the detection of the application of negative air pressure within the at least one air hose 116 by the flow sensor 181, the control subsystem may transmit control signals to the battery 182 to supply electrical current (e.g., power) to a heater to heat the aerosol-generating substrate, but the example embodiments are not limited thereto. For example, the control subsystem may be additionally configured to selectively electrically connect the battery 182 to supply current to the heater in response to the pressing of the button 106, etc. Additionally, as a second condition to be satisfied prior to the supply of current to the heater, the control subsystem may enable the supply of electrical current to the heater based on the detection of a capsule by a capsule detection switch and the detection of a draw and/or negative air pressure by the flow sensor 181 and/or the activation of the button 106, etc.

In at least one example embodiment, the power supply 182 is a battery, such as a lithium ion battery. The battery may be a Lithium-ion battery or one of its variants, for example a Lithium-ion polymer battery. Alternatively, the battery is a Nickel-metal hydride battery, a Nickel cadmium battery, a Lithium-manganese battery, a Lithium-cobalt battery, a fuel cell or a solar cell. Any other power sources or battery technology may be used. In an example embodiment, aerosol generating device 100 may be usable until the energy in the power supply 182 is depleted and/or lowered below a certain threshold. Alternatively, the power supply 182 may be rechargeable and reusable, and may include circuitry allowing the battery to be chargeable by an external charging device, or may be rechargeable via solar power. In some example embodiments, the circuitry of the control system 180, when charged, may provide power for a desired (or alternatively, a determined) number of draws, until the energy in power supply 182 is depleted, and/or until the energy in power supply 182 is lowered below a certain threshold, after which the circuitry must be re-connected to an external charging device.

Figure 11:
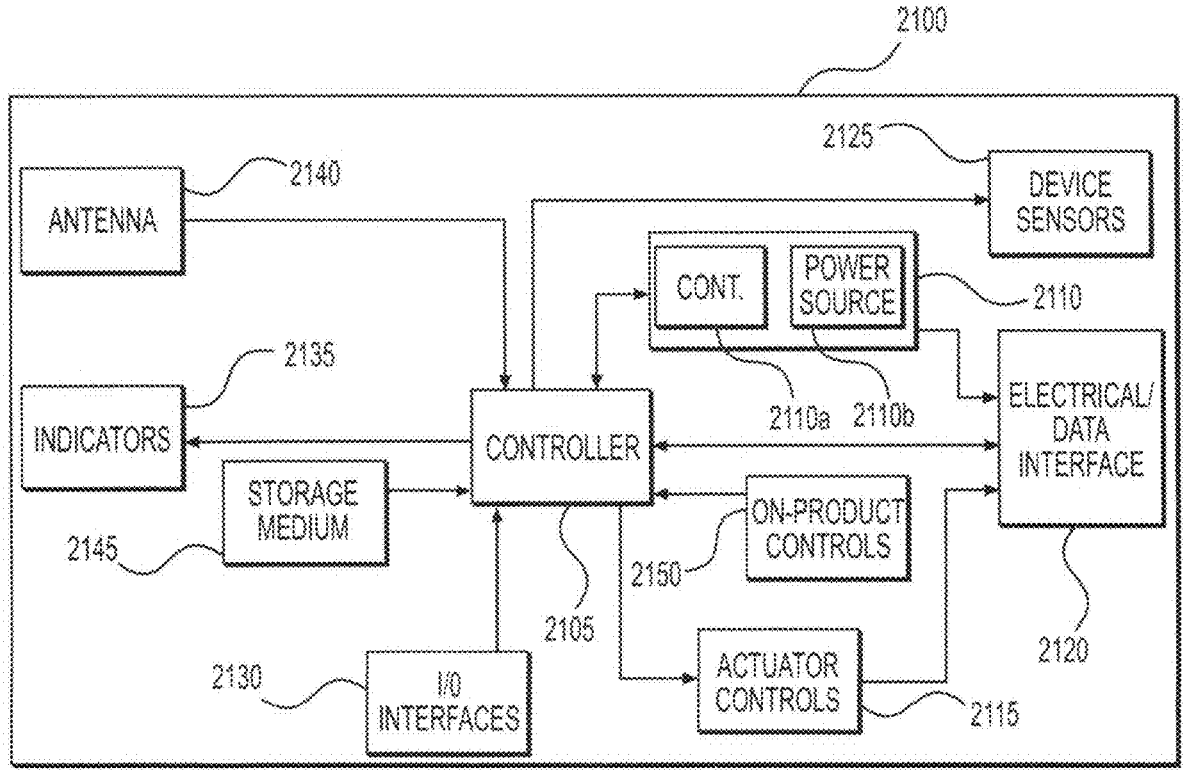
FIG. 11 illustrates an example block diagram of a control subsystem of the aerosol generating device according to some example embodiments.

FIG. 11 illustrates an example block diagram of a control subsystem of the aerosol generating device according to some example embodiments.

As shown in FIG. 11, according to at least one example embodiment, a control subsystem 2100 (which may correspond to the control subsystem 180 of FIG. 10, etc.) includes a controller 2105, a power supply 2110, actuator controls 2115, a capsule electrical/data interface 2120, device sensors 2125, input/output (I/O) interfaces 2130, aerosol indicators 2135, at least one antenna 2140, and/or a storage medium 2145, etc., but the example embodiments are not limited thereto. For example, the control-subsystem system 2100 may include additional elements. However, for the sake of brevity, the additional elements are not described. In other example embodiments, the capsule electrical/data interface 2120 may be an electrical interface only, etc.

The controller 2105 (e.g., processing circuitry, control circuitry, etc.) may be hardware including logic circuits; a hardware/software combination such as a processor executing software; or a combination thereof. For example, the controller 2105 may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), etc.

In the event where the controller 2105 is, or includes, a processor executing software, the controller 2105 is configured as a special purpose machine (e.g., a processing device) to execute the software, stored in memory accessible by the controller 2105 (e.g., the storage medium 2145 or another storage device), to perform the functions of the controller 2105. The software may be embodied as program code including instructions for performing and/or controlling any or all operations described herein as being performed by the controller 2105.

As disclosed herein, the term "storage medium", "computer readable storage medium" or "non-transitory computer readable storage medium" may represent one or more devices for storing data, including read only memory (ROM), random access memory (RAM), magnetic RAM, core memory, magnetic disk storage mediums, optical storage mediums, flash memory devices and/or other tangible machine readable mediums for storing information. The term "computer-readable medium" may include, but is not limited to, portable or fixed storage devices, optical storage devices, and various other mediums capable of storing, containing or carrying instruction(s) and/or data.

The controller 2105 communicates with the power supply 2110, the actuator control 2115, the electrical/data interface 2120, the device sensors 2125, the input/output (I/O) interfaces 2130, the aerosol indicators 2135, on-product controls 2150, and/or the at least one antenna 2140, etc. According to at least some example embodiments, the on-product controls 2150 can include any device or devices capable of being manipulated manually by an adult operator to indicate a selection of a value. Example implementations include, but are not limited to, one or more buttons (e.g., button 106, etc.), a dial, a capacitive sensor, and a slider, etc.

The I/O interfaces 2130 and the antenna 2140 allow the control subsystem 2100 to connect to various external devices such as smart phones, tablets, and PCs, etc. For example, the I/O interfaces 2130 may include a USB-C connector, a micro-USB connector, etc. The USB-C connector (e.g., connector port 114) may be used by the control subsystem 2100 to charge the power source 2110*b* (e.g., battery 182), and may also be used to transmit and/or receive data from at least one external device, such as aerosol profiles, heater profiles, device performance log data (e.g., controller performance data, memory performance data, battery performance data, heater performance data, etc.), firmware upgrades, software upgrades, etc., but the example embodiments are not limited thereto.

The controller 2105 may include on-board RAM and flash memory to store and execute code including analytics, diagnostics and software upgrades. As an alternative, the storage medium 2145 may store the code. Additionally, in another example embodiment, the storage medium 2145 may be on-board the controller 2105.

The controller 2105 may further include on-board clock, reset and power management modules to reduce an area covered by a PCB in the device body housing 101.

The device sensors 2125 may include a number of sensor transducers that provide measurement information to the controller 2105. The device sensors 2125 may include a power supply temperature sensor, an external capsule temperature sensor, a current sensor for the heater, power supply current sensor, air flow sensor and an accelerometer to monitor movement and orientation. The power supply temperature sensor and external capsule temperature sensor may be a thermistor or thermocouple and the current sensor for the heater and power supply current sensor may be a resistive based sensor or another type of sensor configured to measure current. The air flow sensor (e.g., flow sensor 181) may be a pressure sensor (e.g., a capacitive pressure sensor, etc.) configured to detect positive or negative air pressure (e.g., a draw or a puff), a microelectromechanical system (MEMS) flow sensor, and/or another type of sensor configured to measure air flow such as a hot-wire anemometer. Further, instead of, or in addition to, measuring air flow using a flow sensor included in the device sensors 2125 of the control subsystem 2100 of the device body housing 101, air flow may be measured using a hot wire anemometer 2220A located in the capsule 170. According to at least one example embodiment, the device sensors 2125 further includes a capsule detection sensor for detecting the presence of the capsule in the aerosol generating device 100, such as the capsule detection switch 183, and/or a door detection switch for detecting the closure of a door and/or lid of the aerosol generating device, such as door detection switch 186, but the example embodiments are not limited thereto.

The data generated from one or more of the device sensors 2125 may be detected based on a binary signal (e.g., on/off signal) using a general purpose input/output (GPIO) circuit, etc., and/or may be sampled at a sample rate appropriate to the parameter being measured using, for example, a discrete, multi-channel analog-to-digital converter (ADC), etc.

The controller 2105 may adapt heater profiles for an aerosol generating substrate and other profiles based on the measurement information received from the controller 2105. For the sake of convenience, these are generally referred to as aerosol profiles. The heater profile identifies the power profile to be supplied to the heater during the few seconds when aerosol drawing takes place and/or the power profile to be supplied to the heater in between aerosol drawing instances in order to apply continual heating to the capsule (e.g., to provide an "oven mode" where a desired temperature is maintained within the capsule for a desired period of time). For example, a heater profile can deliver maximum power to the heater when an instance of aerosol drawing is initiated, but then after a second or so immediately reduce the power to half way or a quarter way. According to at least some example embodiments, the modulation of electrical power provided to the heater is may be implemented using pulse width modulation, but is not limited thereto.

In addition, a heater profile can also be modified based on a detected draw and/or application of negative pressure on the aerosol generating device 100. The use of the flow sensor allows aerosol drawing strength to be measured and used as feedback to the controller 2105 to adjust the power delivered to the heater of the capsule, which may be referred to as heating or energy delivery.

According to at least some example embodiments, when the controller 2105 recognizes the capsule 170 which is currently installed (e.g., via SKU, etc.), the controller 2105 matches an associated heating profile that is designed for that particular capsule. The controller 2105 and the storage medium 2145 will store data and algorithms that allow the generation of heating profiles for all SKUs, capsule types, aerosol generating substrate types, etc. In another example embodiment, the controller 2105 may read the heating profile from the capsule. Additionally, the adult operators may also adjust heating profiles to suit their preferences using the on-product controls 2150, using an external device wirelessly paired with the aerosol generating device 100 and/or connected to the aerosol generating device 100 via the I/O interfaces 2130, etc. In other example embodiments, the controller 2105 may use the heating profile applied for a previously installed capsule, which has been stored in memory, to a currently installed capsule on the assumption that the current capsule is of a same type as the previously installed capsule, etc.

The controller 2105 may send data to and receives data from the power supply 2110. The power supply 2110 includes a power source 2110*b* and a power controller 2110*a* to manage the power output by the power source 2110*b*.

The power source 2110*b* may be a Lithium-ion battery or one of its variants, for example a Lithium-ion polymer battery. Alternatively, the power source 2110*b* may be a Nickel-metal hydride battery, a Nickel cadmium battery, a Lithium-manganese battery, a Lithium-cobalt battery or a fuel cell. Alternatively, the power source 2110*b* may be rechargeable and include circuitry allowing the battery to be chargeable by an external charging device. In that case, the circuitry, when charged, provides power for a desired (or alternatively a pre-determined) number of instances of aerosol drawing, after which the circuitry must be re-connected to an external charging device.

In addition to supplying power to the capsule, the power supply 2110 also supplies power to the controller 2105. Moreover, the power controller 2110*a* may provide feedback to the controller 2105 indicating performance of the power source 2110*b*.

The controller 2105 sends data to and receives data from the at least one antenna 2140. The at least one antenna 2140 may include a NFC modem and a Bluetooth Low Energy (LE) modem and/or other modems for other wireless technologies (e.g., WiFi, etc.). In an example embodiment, the communications stacks are in the modems, but the modems are controlled by the controller 2105. The Bluetooth LE modem is used for data and control communications with an application on an external device (e.g., smart phone, etc.). The NFC/Bluetooth LE/WiFi modem may be used for pairing of the aerosol generating device 100 to the application and transmission of diagnostic information, data, profile information, capsule information, hardware parameter information, firmware updates, etc. Moreover, the Bluetooth LE/WiFi modem may be used to provide location information (for an adult operator to find the aerosol generating device) or authentication during a purchase, etc.

As described above, the control subsystem 2100 may generate and adjust various profiles for aerosol generation. The controller 2105 uses the power supply 2110 and the actuator controls 2115 to regulate the profile for the adult operator.

The actuator controls 2115 include passive and active actuators to regulate a desired aerosol profile. For example, the device body housing 101 may include actuators within an air inlet path and/or air inlet channel of the device body housing 101, such as within the air flow subsystem of the aerosol generating device 100 (e.g., the body housing air inlet 113, the air hose 116, the capsule connector air inlet 179, etc.). The actuator controls 2115 may control the flow of air within the air inlet channel using the actuators based on commands from the controller 2105 associated with the desired aerosol profile.

Moreover, the actuator controls 2115 are used to energize the heater in conjunction with the power supply 2110. More specifically, the actuator controls 2115 are configured to generate a drive waveform associated with the desired aerosol profile. As described above, each possible profile is associated with a drive waveform. Upon receiving a command from the controller 2105 indicating the desired aerosol profile, the actuator controls 2115 may produce the associated modulating waveform for the power supply 2110.

The controller 2105 supplies information to the aerosol indicators 2135 to indicate statuses and occurring operations to the adult operator. The indicators 2135 include a power indicator displayed on the display panel 107A, a separate indicator light (e.g., a LED indicator light, etc.) that may be activated when the controller 2105 senses a button pressed by the adult operator. The indicators 2135 may also include a haptic feedback motor (e.g., haptic feedback motor 185), speaker, an indicator for a current state of an adult operator-controlled aerosol parameter (e.g., generated aerosol volume) and other feedback mechanisms.

In at least some example embodiments, the aerosol generating device in accordance with at least some example embodiments (such as, the aerosol generating device 100 illustrated in FIGS. 1 to 11) are configured to heat a capsule (e.g., capsule 170) to generate an aerosol. In an example embodiment, a method of generating an aerosol may include initially loading a capsule 170 into the aerosol-generating device 100. To load the capsule 170, the door 151 is rotated and/or pivoted to the open position, and the capsule 170 is inserted into the capsule receptacle 175 (e.g., a capsule-receiving cavity, etc.). Next, rotating the door 151 to the closed position such that the door 151 contacts the device body housing 101, causes attached linkages 121 and 122 to move the capsule receptacle 175 in the distal direction such that the capsule 170 is connected to a capsule connector 177. The door 151 will maintain the closed position while pressing the capsule 170 further into the capsule receptacle 175 to fully seat the capsule 170 against the capsule connector 177. Concurrently, the pivoting of the door 151 to the closed position causes the attached linkages 121 and 122, in combination with the biased spring 123, to move the mouthpiece chassis 155 in the distal direction such that the mouthpiece 160 contacts the device body housing 101, and the mouthpiece chimney 161 and the aerosol passageway 165 aligns with and contacts the capsule 170.

When the capsule 170 is fully seated within the capsule receptacle 175, the distal end section of the capsule 170 will be pressed against the electrical contacts 171 (e.g., the electrical contacts 224 of the capsule 170 will be pressed against the exposed tips of the contact surfaces 171), which will, in turn, be compressed and retracted via the spring features 171A of the contacts 171. While pressed against the electrical contacts 171, the distal end section of the capsule 170 may also contact the flat and angled surfaces of the capsule connector sealing element 178 in the capsule connector 177, such that the recess 221 (e.g., an alignment recess) of the capsule 170 may contact or otherwise be adjacent to the angled surfaces of the alignment members in the capsule receptacle 175. In other words, the inlet recess 221 of the capsule 170 may receive the capsule connector sealing element 178 for a resilient and sealed engagement. As a result, a relatively secure electrical connection and desirable seal may be established with the capsule 170.

The aerosol generating device 100 may be activated using the display panel 107 (e.g., by pressing the power button 106) and/or upon the detection of a draw event (e.g., via the flow sensor 181). Upon activation, the control subsystem 2100 is configured to instruct the power source 182 to supply an electrical current to the capsule 170 via the electrical contacts 171 in the capsule connector 177. Specifically, the capsule 170 includes a heater 230 that is configured to undergo resistive heating in response to the electrical current from the power source 182 that is introduced via its distal end section. As a result of the resistive heating, the temperature of the aerosol-forming substrate within the capsule 170 will increase such that volatiles are released so as to generate an aerosol. In at least one example embodiment, the heating of the aerosol-forming substrate within the capsule 170 may be below a combustion temperature of the aerosol-forming substrate so as to produce an aerosol without involving a substantial pyrolysis of the aerosol-forming substrate or the substantial generation of combustion byproducts (if any). Thus, in at least one example embodiment, pyrolysis does not occur during the heating and resulting production of aerosol. In other instances, there may be some pyrolysis and combustion byproducts, but the extent may be considered relatively minor and/or merely incidental.

Upon a draw or application of negative pressure to the aerosol generating device 100 (e.g., via the mouthpiece 160), ambient air is drawn into the aerosol-generating device 100 through the pores of a grille covering the body housing air inlet 113. Once inside, the air streams from the pores of the grille converge and may pass through the body housing air inlet 113 and into to the air hose 116, sealingly connected to the air inlets 113. The converged airflow may be optionally detected/monitored with a flow sensor 181 within the body housing air inlet 113 and/or the air hose 116. From the air hose 116, the airflow is directed to the capsule connector air inlet 179 of the capsule connector 177. The airflow then travels through the capsule connector sealing element 178 and enters the inlet openings 222 in the capsule 170. Inside the capsule 170, the air may flow (e.g., longitudinally) through the aerosol-forming substrate and along the plane of the heater 230 so as to entrain the volatiles released by the aerosol-forming substrate, which results in an aerosol. Finally, the resulting aerosol passes through the outlet openings 212 in the capsule 170 and through the mouthpiece chimney 161 before exiting the aerosol-generating device 100 (e.g., via the one or more outlets 165B in the mouthpiece 160).

In at least some example embodiments, the method of use regarding the aerosol-generating device 100 may include securing the replaceable mouthpiece (e.g., replaceable mouthpiece 160). For example, the method may include inserting the replaceable mouthpiece 160 into the mouthpiece opening of the proximal end piece 152 of the device body housing 101 and turning the replaceable mouthpiece 160 until the replaceable mouthpiece is locked into the mouthpiece chassis 155, e.g., a resistance is felt and/or a click is heard, which indicates that the bayonet connector 162 of the replaceable mouthpiece 160 is locked into the bayonet enclosure 163 of the mouthpiece chassis 155. In at least some example embodiments, the method of use may include replacing the replaceable mouthpiece (e.g., replaceable mouthpiece 160). Replacing the replaceable mouthpiece may including opening the door (e.g., 151), thereby causing the replaceable mouthpiece to be moved to an open position away from the proximal end piece (e.g., 152) of the device body housing (e.g., 101); disengaging the bayonet connector (e.g., 162) from the bayonet enclosure (e.g., 163) of the mouthpiece chassis (e.g., 155), and removing a first replaceable mouthpiece from the opening; and inserting a second replaceable mouthpiece into the opening and turning the second replaceable mouthpiece until the second replaceable mouthpiece is locked into the mouthpiece chassis (e.g., resistance is felt and/or a click is heard).

Although a capsule 170 has been illustrated as one example in connection with the aerosol-generating device 100, it should be understood other suitable examples are also available.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

Although described with reference to specific examples and drawings, modifications, additions and substitutions of example embodiments may be variously made according to the description by those of ordinary skill in the art. For example, the described techniques may be performed in an order different with that of the methods described, and/or elements such as the described system, architecture, devices, circuit, and the like, may be connected or combined to be different from the above-described methods, or results may be appropriately achieved by other elements or equivalents.

We claim:

1. An aerosol generating device, comprising:

a housing including a power supply and an air inlet;

a mouthpiece assembly movably attached to the housing, and providing an air outlet;

a door assembly moveably attached to the housing, the door assembly including a door and a receptacle movably attached to the door, the receptacle defining a cavity to receive a capsule including an aerosol generating substrate; and a linkage arrangement operationally connected to the door assembly, the mouthpiece assembly and the housing, and the linkage arrangement cooperatively moving the mouthpiece assembly and the receptacle in response to movement of the door to a closed state such that the capsule is retained within the housing and operationally connected with the power supply, the air inlet and the air outlet.

2. The aerosol generating device of claim 1, wherein the linkage arrangement includes at least one first linkage and at least one second linkage, each of the linkages including a first end and a second end.

3. The aerosol generating device of claim 2, wherein the housing further includes at least one first pivot point;

the at least one first linkage is rotatably connected to the receptacle at the first end of the at least one first linkage; and the at least one first linkage is rotatably connected to the housing at the at least one first pivot point at the second end of the at least one first linkage.

4. The aerosol generating device of claim 3, wherein in response to the movement of the door to the closed state:

the at least one first linkage moves the receptacle such that the capsule is operationally connected with the power supply and the air inlet.

5. The aerosol generating device of claim 3, wherein the housing further defines at least one elongated slot;

the housing further includes at least one compression spring;

the mouthpiece assembly further includes at least one pin movably inserted into the at least one elongated slot;

the at least one second linkage is rotatably connected to the door assembly at the first end of the at least one second linkage; and the at least one second linkage is rotatably and movably connected to the at least one pin at the second end of the at least one second linkage.

6. The aerosol generating device of claim 5, wherein in response to the movement of the door to the closed state:

the at least one second linkage releases the at least one compression spring from a compressed state; and the at least one compression spring moves the mouthpiece assembly along a length of the at least one elongated slot such that the air outlet is operationally connected to the capsule.

7. The aerosol generating device of claim 1, wherein the mouthpiece assembly includes a mouthpiece chassis; and the mouthpiece chassis defines an opening to receive a mouthpiece.

8. The aerosol generating device of claim 7, wherein
the mouthpiece chassis defines a portion of an attachment mechanism for removably attaching the mouthpiece to the mouthpiece chassis.

9. The aerosol generating device of claim 8, wherein the attachment mechanism is at least one of a bayonet connector, a snug-fit, a detent, a clamp, a threaded connector, a sliding fit, a sleeve fit, an alignment fit, a magnetic clasp, or any combinations thereof.

10. The aerosol generating device of claim 1, wherein
the door includes a cam disposed on an interior face of the door;
the receptacle includes a restraining element; and
in response to the movement of the door to the closed state, the linkage arrangement cooperatively moves the receptacle such that the cam actuates the restraining element, and the actuated restraining element restrains movement of the capsule within the receptacle.

11. The aerosol generating device of claim 1, wherein
the housing includes an airflow sensor, a door sensor, a capsule sensor, and processing circuitry;
the airflow sensor is configured to detect a draw event;
the door sensor is configured to detect whether the door is in the closed state;
the capsule sensor is configured to detect the capsule in the receptacle; and
the processing circuitry is configured to enable current to flow from the power supply to the capsule in response to the detected draw event, the door detected in the closed state, and the capsule detected in the receptacle, such that the current enables a heater included in the capsule to heat the aerosol generating substrate and generate an aerosol.

12. The aerosol generating device of claim 1, wherein
the housing further includes a display panel; and
the display panel is configured to display operational information related to the aerosol generating device or the capsule.

13. The aerosol generating device of claim 1, wherein in response to movement of the door to an open state:
the linkage arrangement cooperatively moves the mouthpiece assembly and the receptacle such that the capsule is operationally disconnected from the power supply, the air inlet, and the air outlet.

14. An aerosol generating device, comprising:
a housing including a power supply and an air inlet;
a mouthpiece assembly movably attached to the housing, and providing an air outlet;
a door assembly moveably attached to the housing, the door assembly including a door and a receptacle movably attached to the door, the receptacle defining a cavity to receive a capsule including an aerosol generating substrate and retain the capsule within the housing, and the capsule operationally connected to the power supply, the air inlet, and the air outlet when the door is in a closed state; and
a linkage arrangement operationally connected to the door assembly, the mouthpiece assembly and the housing, and the linkage arrangement cooperatively moving the mouthpiece assembly and the receptacle in response to movement of the door to an open state such that the capsule is operationally disconnected from the power supply, the air inlet and the air outlet.

15. The aerosol generating device of claim 14, wherein
the linkage arrangement includes at least one first linkage and at least one second linkage, each of the linkages including a first end and a second end.

16. The aerosol generating device of claim 15, wherein
the housing further includes at least one first pivot point;
the at least one first linkage is rotatably connected to the receptacle at the first end of the at least one first linkage; and
the at least one first linkage is rotatably connected to the housing at the at least one first pivot point at the second end of the at least one first linkage.

17. The aerosol generating device of claim 16, wherein in response to the movement of the door to the open state:
the at least one first linkage moves the receptacle such that the capsule is operationally disconnected with the power supply and the air inlet.

18. The aerosol generating device of claim 16, wherein
the housing further defines at least one elongated slot;
the housing further includes at least one compression spring;
the mouthpiece assembly further includes at least one pin movably inserted into the at least one elongated slot;
the at least one second linkage is rotatably connected to the door assembly at the first end of the at least one second linkage; and
the at least one second linkage is rotatably and movably connected to the at least one pin at the second end of the at least one second linkage.

19. The aerosol generating device of claim 18, wherein in response to the movement of the door to the open state:
the at least one second linkage moves the mouthpiece assembly along a length of the at least one elongated slot such that the air outlet is operationally disconnected from the capsule and the at least one compression spring enters a compressed state.

20. The aerosol generating device of claim 14, wherein
the mouthpiece assembly includes a mouthpiece chassis; and
the mouthpiece chassis defines an opening to receive a mouthpiece.

21. The aerosol generating device of claim 20, wherein
the mouthpiece chassis defines a portion of an attachment mechanism for removably attaching the mouthpiece to the mouthpiece chassis.

22. The aerosol generating device of claim 21, wherein the attachment mechanism is at least one of a bayonet connector, a snug-fit, a detent, a clamp, a threaded connector, a sliding fit, a sleeve fit, an alignment fit, a magnetic clasp, or any combinations thereof.

23. The aerosol generating device of claim 14, wherein
the receptacle includes a restraining element;
the door includes a cam disposed on an interior face of the door, the cam engaging the restraining element when the door is in the closed state such that the restraining element is caused to restrain the capsule within the capsule;
in response to the movement of the door to the open state, the linkage arrangement moves the receptacle such that the restraining element disengages from the cam; and
the restraining element does not restrain the capsule within the receptacle when the restraining element is fully disengaged from the cam.

24. The aerosol generating device of claim 14, wherein
the housing includes an airflow sensor, a door sensor, a capsule sensor, and processing circuitry;
the airflow sensor is configured to detect a draw event;
the door sensor is configured to detect whether the door is in the closed state;
the capsule sensor is configured to detect the capsule in the receptacle; and the processing circuitry is configured to disable current flow from the power supply to the capsule in response to no longer detecting any one of the draw event, the door in the closed state, and the capsule in the receptacle.

25. The aerosol generating device of claim 14, wherein the housing further includes a display panel; and the display panel is configured to display operational information related to the aerosol generating device or the capsule.

* * * * *